US008747018B2

(12) United States Patent
Smith et al.

(10) Patent No.: US 8,747,018 B2
(45) Date of Patent: Jun. 10, 2014

(54) METHOD OF INSTALLING A PAVING SYSTEM

(75) Inventors: Steven George Smith, St. Michael, MN (US); Steven John Thorkelson, Minnetonka, MN (US); Troy Matthew Achterkirch, Rogers, MN (US)

(73) Assignee: VAST Enterprises, LLC, Minneapolis, MN (US)

( * ) Notice: Subject to any disclaimer, the term of this patent is extended or adjusted under 35 U.S.C. 154(b) by 0 days.

(21) Appl. No.: 12/990,419

(22) PCT Filed: Nov. 26, 2008

(86) PCT No.: PCT/US2008/013153

§ 371 (c)(1),
(2), (4) Date: Nov. 19, 2010

(87) PCT Pub. No.: WO2009/134237

PCT Pub. Date: Nov. 5, 2009

(65) Prior Publication Data

US 2011/0052318 A1 Mar. 3, 2011

Related U.S. Application Data

(60) Provisional application No. 61/049,654, filed on May 1, 2008.

(51) Int. Cl.
*E01C 5/00* (2006.01)

(52) U.S. Cl.
USPC ..... 404/29; 404/34

(58) Field of Classification Search
CPC ..... E01C 5/00; E01C 5/001; E01C 5/22; E01C 5/223; E01C 2201/00; E01C 2201/02
USPC ..... 404/28–46
See application file for complete search history.

(56) References Cited

U.S. PATENT DOCUMENTS 123,219 A 1/1872 Beidler
222,025 A 11/1879 Devilliers (Continued)

FOREIGN PATENT DOCUMENTS

DE 29710241 U1 8/1997
DE 29710241 9/1997

(Continued)

OTHER PUBLICATIONS

U.S. Appl. No. 13/254,367, Preliminary Amendment filed Oct. 28, 2011, 9 pgs.

(Continued)

*Primary Examiner* — Matthew D Troutman
(74) *Attorney, Agent, or Firm* — Schwegman Lundberg & Woessner, P.A

(57) ABSTRACT

A method for installing a paver system includes positioning a first grid substrate adjacent to a second grid substrate. The first grid substrate and the second grid substrate are flexibly bridged with a first paver piece. A first portion of the first paver piece is movably coupled with the first grid substrate at a first joint, and a second portion of the first paver piece is movably coupled with the second grid substrate at a second joint, the first and second grid substrates and the first paver piece forming an articulated paver linkage. A second paver piece is coupled with the second grid substrate. A third paver piece is coupled with the first grid substrate. The articulated paver linkage is fit within the specified area by movement of at least one of the first, second and third paver pieces and the first and second grid substrates. The movement is transmitted along the articulated paver linkage to maintain a specified alignment and spacing of the first, second and third paver pieces.

37 Claims, 49 Drawing Sheets

(56) References Cited

U.S. PATENT DOCUMENTS

| | | | | | |
|---|---|---|---|---|---|
| 321,403 | A | | 6/1885 | Underwood | |
| 401,030 | A | | 4/1889 | Harger | |
| 1,601,465 | A | | 9/1926 | Barbour | |
| 3,213,768 | A | | 10/1965 | Lauritz | |
| 3,233,896 | A | | 2/1966 | Lee | |
| 4,655,018 | A | | 4/1987 | Pardo | |
| 4,885,882 | A | | 12/1989 | Forshee | |
| 5,226,273 | A | | 7/1993 | Burke | |
| 5,267,810 | A | * | 12/1993 | Johnson | 404/41 |
| 5,313,756 | A | | 5/1994 | Ways et al. | |
| 5,418,036 | A | | 5/1995 | Tokikawa et al. | |
| 5,429,451 | A | * | 7/1995 | Pettee, Jr. | 405/20 |
| 5,787,637 | A | | 8/1998 | Keen | |
| 5,850,720 | A | | 12/1998 | Willis | |
| 5,993,107 | A | | 11/1999 | Bauer | |
| 6,055,784 | A | * | 5/2000 | Geiger | 52/302.1 |
| 6,071,041 | A | * | 6/2000 | Knight | 405/16 |
| 6,171,015 | B1 | | 1/2001 | Barth | |
| 6,233,896 | B1 | | 5/2001 | Coup | |
| D457,254 | S | | 5/2002 | Stepanchick | |
| 6,422,784 | B1 | | 7/2002 | Pellegrino et al. | |
| 6,508,607 | B1 | * | 1/2003 | Smith et al. | 405/20 |
| 6,551,016 | B2 | | 4/2003 | Guidon | |
| 6,594,961 | B2 | | 7/2003 | Leines | |
| 6,769,217 | B2 | | 8/2004 | Nelson | |
| 6,851,236 | B1 | | 2/2005 | Harvey | |
| 6,872,434 | B2 | | 3/2005 | De Zen | |
| 7,028,437 | B2 | | 4/2006 | Hauck | |
| 7,237,766 | B2 | | 7/2007 | Lemay | |
| 7,244,076 | B2 | | 7/2007 | Whitson | |
| 7,270,497 | B2 | | 9/2007 | Von Langsdorff | |
| 7,300,224 | B2 | | 11/2007 | Slater | |
| 7,344,334 | B2 | | 3/2008 | Thorkelson | |
| 7,441,378 | B2 | | 10/2008 | Wood | |
| D581,549 | S | | 11/2008 | Thorkelson | |
| 7,448,176 | B2 | | 11/2008 | Drake | |
| 7,503,146 | B2 | | 3/2009 | Thomas | |
| 8,128,312 | B2 | | 3/2012 | Stuchell | |
| 8,336,278 | B2 | | 12/2012 | Smith et al. | |
| 8,696,234 | B2 | | 4/2014 | Smith et al. | |
| 2002/0095896 | A1 | | 7/2002 | Commins et al. | |
| 2002/0141821 | A1 | | 10/2002 | Guidon | |
| 2005/0284082 | A1 | | 12/2005 | Smith | |
| 2007/0269265 | A1 | | 11/2007 | Thorkelson | |
| 2008/0168732 | A1 | | 7/2008 | Stuchell | |
| 2010/0205899 | A1 | | 8/2010 | Califano | |
| 2010/0223880 | A1 | | 9/2010 | Smith et al. | |
| 2011/0286793 | A1 | | 11/2011 | Arguello | |
| 2012/0034030 | A1 | | 2/2012 | Smith et al. | |
| 2012/0121328 | A1 | | 5/2012 | White | |

FOREIGN PATENT DOCUMENTS

| | | | |
|---|---|---|---|
| GB | 2367086 | | 3/2002 |
| WO | WO-2009134237 | A1 | 11/2009 |
| WO | WO-2010/102143 | A1 | 9/2010 |

OTHER PUBLICATIONS

International Application Serial No. PCT/US2010/026263, International Search Report mailed Apr. 30, 2010, 2 pgs.
International Application Serial No. PCT/US2010/026263, Written Opinion mailed Sep. 15, 2011, 7 pgs.
International Application Serial No. PCT/US2008/013153, International Search Report mailed Mar. 20, 2009.
International Application Serial No. PCT/US2008/013153, Written Opinion mailed Mar. 20, 2009.
U.S. Appl. No. 12/717,856 , Response filed Apr. 11, 2012 to Final Office Action mailed Jan. 19, 2012, 14 pgs.
U.S. Appl. No. 12/717,856 , Response filed Aug. 1, 2011 to Restriction Requirement mailed Jul. 13, 2011, 10 pgs.
U.S. Appl. No. 12/717,856, Examiner Interview Summary mailed Apr. 11, 2012, 3 pgs.
U.S. Appl. No. 12/717,856, Examiner Interview Summary mailed Dec. 2, 2011, 3 pgs.
U.S. Appl. No. 12/717,856, Final Office Action mailed Jan. 19, 2012, 14 pgs.
U.S. Appl. No. 12/717,856, Non Final Office Action mailed Apr. 26, 2012, 16 pgs.
U.S. Appl. No. 12/717,856, Non Final Office Action mailed Sep. 2, 2011, 18 pgs.
U.S. Appl. No. 12/717,856, Response filed Nov. 2, 2011 to Non Final Office Action mailed Sep. 2, 2011, 19 pgs.
U.S. Appl. No. 12/717,856, Restriction Requirement mailed Jul. 13, 2011, 6 pgs.
U.S. Appl. No. 12/717,856 , Response filed Jul. 25, 2012 to Non Final Office Action mailed Apr. 26, 2012, 13 pgs.
U.S. Appl. No. 12/717,856, Corrected Notice of Allowability mailed Oct. 10, 2012, 5 pgs.
U.S. Appl. No. 12/717,856, Examiner Interview Summary mailed Aug. 1, 2012, 3 pgs.
U.S. Appl. No. 12/717,856, Notice of Allowance mailed Aug. 17, 2012, 8 pgs.
U.S. Appl. No. 13/254,367, Non Final Office Action mailed Oct. 5, 2012, 17 pgs.
U.S. Appl. No. 13/254,367, Examiner Interview Summary mailed Apr. 3, 2013, 3 pgs.
U.S. Appl. No. 13/254,367, Preliminary Amendment filed Sep. 1, 2011, 3 pgs.
U.S. Appl. No. 13/254,367, Response filed Mar. 4, 2013 to Non Final Office Action mailed Oct. 5, 2012, 17 pgs.
Canadian Application Serial No. 2748549, Office Action mailed Feb. 7, 2013, 3 pgs.
Canadian Application Serial No. 2,748,549, Response filed Aug. 7, 2013 to Office Action mailed Feb. 7, 2013.
U.S. Appl. No. 13/254,367, Notice of Allowance mailed Nov. 22, 2013, 7 pgs.
U.S. Appl. No. 14/196,353, Non Final Office Action Apr. 16, 2014, 6 pgs.

* cited by examiner

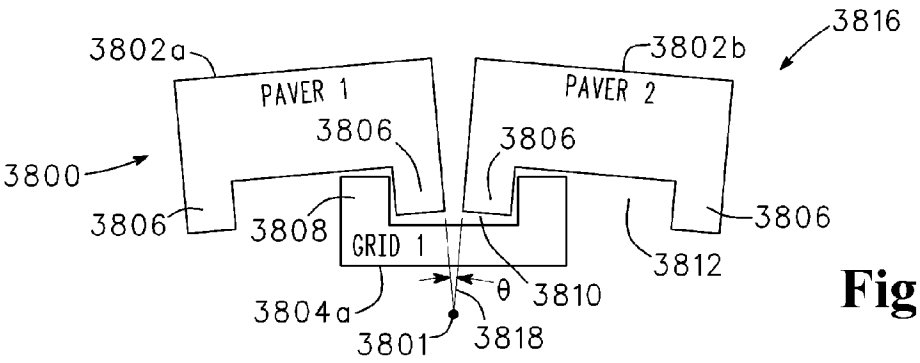
Fig. 38a
Fig. 38b
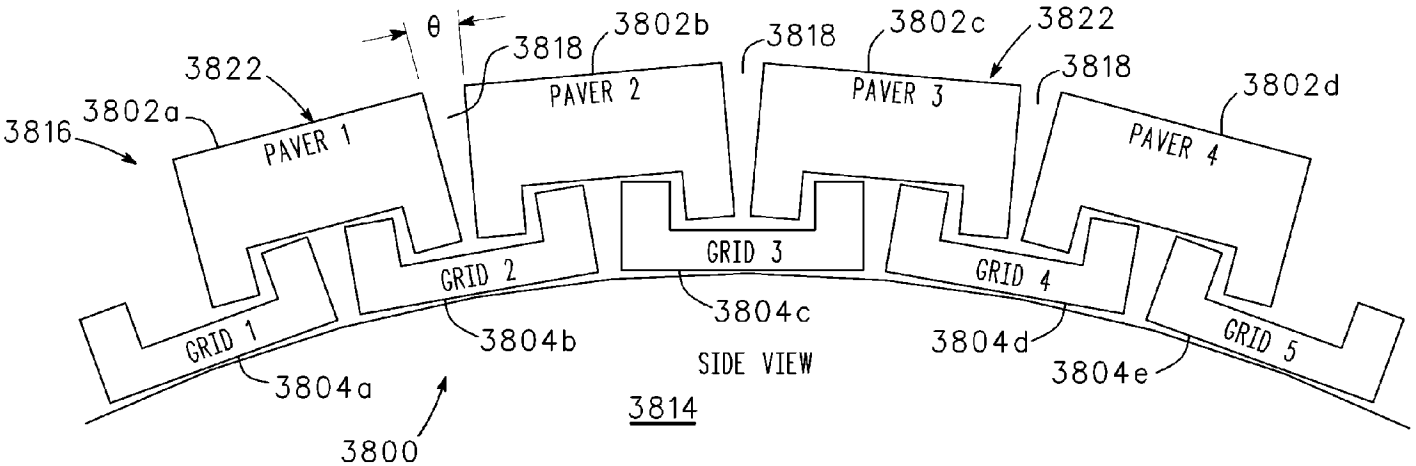

METHOD OF INSTALLING A PAVING SYSTEM

PRIORITY

This patent application is a U.S. National Stage Filing under 35 U.S.C. 371 from International patent application Ser. No. PCT/US2008/013153, filed Nov. 26, 2008, and published on Nov. 5, 2009 as WO 2009/134237 A1, which claims priority benefit of U.S. Provisional application Ser. No. 61/049,654, entitled "Method of Installing a Paving System", filed May 1, 2008, the contents of which are incorporated herein by reference in their entirety.

TECHNICAL FIELD

Paving systems and bricks for residential, commercial and municipal applications.

BACKGROUND

Paver systems are used in landscaping and outdoor construction. Construction pavers are used in residential, commercial, and municipal applications that include walkways, patios, parking lots, and road ways. In some cases, pavers are made from a cementitious mix (i.e., concrete) or clay and are traditionally extruded or molded into various shapes.

The typical manner of installing cementitious or clay pavers is labor intensive, time consuming, and generally includes substantial overhead equipment costs. The simple shapes of cementitious or clay pavers limit their installation to an intensive manual process. Pavers are laid over a bed of sand and tapped into place with adjacent pavers. Where the pavers do not perfectly fit a specified area, for instance a measured out bed for a sidewalk or patio, the pavers are cut with a powered saw to fit within the specified area. Alternatively, the installer must refit and retap each preceding paver to fit within the specified area. Because of these issues the costs for cementitious pavers and their installation are therefore high and include intensive manual labor.

BRIEF DESCRIPTION OF THE DRAWINGS

FIG. 38*a* is a side view one example of a paver system showing an articulated paver linkage in an undulated orientation.

FIG. 38*b* is a side view of one example of a paver system including multiple grid substrates and paver pieces aligned with a convex vertically non-linear specified area.

DESCRIPTION OF THE EMBODIMENTS

Figure 1:
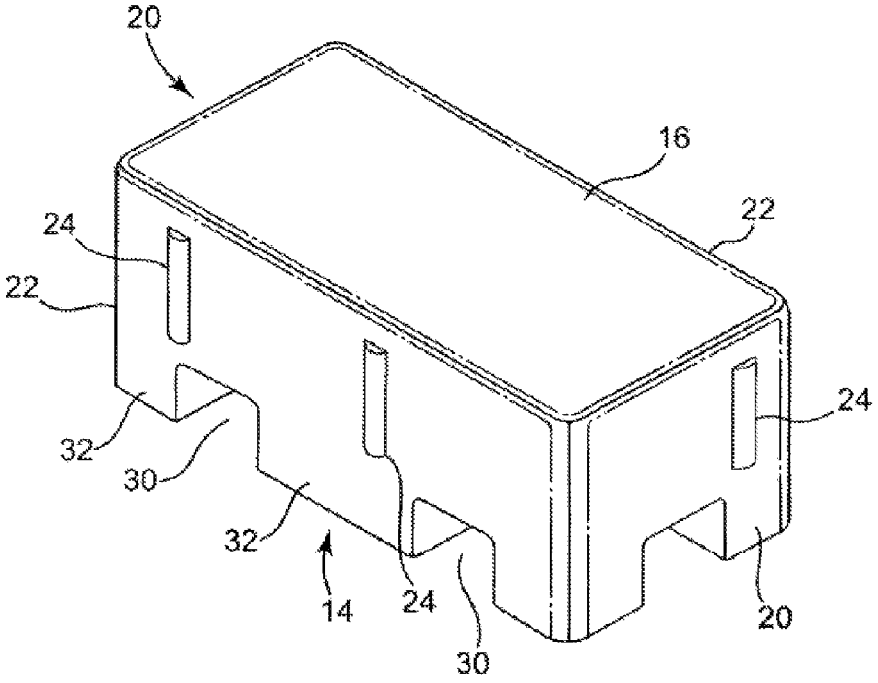
FIG. 1 is a top pictorial view of a paver piece in accordance with one embodiment.

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims and their equivalents.

A configurable paver system is provided. The paver system comprises a plurality of paver pieces formed of a polymeric material. The material is precisely formable and lightweight and may be a composite with materials held in a matrix with polymer binders. The paver pieces are interlocking with a substrate or with one another to prevent lateral migration relative to each other, i.e., motion in the plane of the paved surface. Additionally, the paver pieces, when placed on a plurality of substrates, may effectively prevent lateral migration of adjacent substrates with respect to one another. The paver system enables easy alignment, pre-configuration or pre-loading of installation units, improved distribution of load. Further, the paver system is configured to provide an articulated paver linkage for easy fitting within specified areas thereby substantially preventing the need for cutting of paver pieces and/or time consuming adjustments to the orientations of multiple paver pieces to fit within specified areas. Moreover, the paver system in another example, is configured to provide an articulated paver linkage for undulating a series of paver pieces and substrates to align the paver pieces along a non-linear specified area (e.g., a decorative patio, sidewalk and the like) where a non-linear configuration of pavers is necessary for aesthetics or specific space considerations, such as following an already curved path. In some embodiments, the paver system may be able to deform and to flex to accommodate non-level ground and/or sharp points extending from the ground, i.e., the surface to be paved.

The paver pieces comprise a formable, lightweight polymeric or composite-polymeric material. Any formable, lightweight polymeric material may be used with a suitable load bearing compressive strength, for example a composite of rubber and plastic. In contrast to brittle, cementitious materials previously used for paving systems, the formable, lightweight material permits precise forming or configuring of the paver pieces, including protrusions and sharp corners. Further, in some embodiments, the lightweight material is somewhat elastic to permit deformation of the paver system over small protrusions and flex of the paver system over non-level surfaces. Thus, in contrast to cementitious or clay paver systems wherein the payers may crack or break when subjected to tensile stress, the polymeric paver pieces resist such damage.

A method for manufacturing a composite polymeric material from recycled materials (e.g., a combination of recycled rubber from tires and recycled plastics such as polypropylene (PP) and/or high density polyethylene (HDPE)) is further provided.

Using a polymeric-matrix paver system, the weight of the paver system is significantly less per square unit than the weight of a traditional paver system. For example, the paver system may weigh no more than about 9 lbs per sq. ft. laid. The paver system including, for example, substrates and multiple paver pieces may be packaged in a ready-to-use preassembled unit for a consumer. The ready-to-use packages may be provided on a pallet. For smaller users, such as a homeowner laying a patio, the paver pieces and substrates may be packaged in a small container that is easy to carry. For example, a plurality of paver pieces and substrates may be provided in an approximately one cubic foot container (providing approximately three square feet of coverage) and weighing approximately 25 pounds.

The polymeric material is formed into paver pieces and, in some embodiments, a mating interlocking substrate for underlying more than one paver piece. The substrate, whether separate from or integral to the paver pieces, provides a positive locking system that prevents adjacent pavers from moving laterally relative to each other, provides a means to transfer and/or install multiple paver blocks at one time, and provides a means to disperse compression loads over a wide area. In various embodiments, the paver system provides a low-weight, efficiently-transportable, environmentally friendly, low-labor alternative to conventional cementitious or clay paver systems. In another embodiment, the paver system incorporates surface-to-ground drainage paths. Such paver system provides a means for water penetration, thus reducing and/or eliminating the need for costly and many times non-environmentally friendly run-off paths that are traditionally used with non-porous concrete and asphalt systems. In yet another embodiment, the paver system accommodates a conduit system filled with a variety of heating and/or coolant options (e.g., water, electric resistance cabling, etc.). The system provides a means to heat and/or cool the paver-substrate system, thus providing climate control of enclosed areas and surface temperature control of exterior areas.

The paver system may comprise a plurality of paver pieces and a substrate. The substrates and paver pieces may be coupled with a laterally stabilizing interlock, with the one or more paver pieces interlocking with the one or more substrates. In the embodiments shown, the paver pieces span adjacent substrates. The paver pieces thereby effectively interlock the substrates. In alternative embodiments, one or more substrates may be configured to interlock with one another and/or the one or more paver pieces may be configured to interlock with one another.

Figure 2:
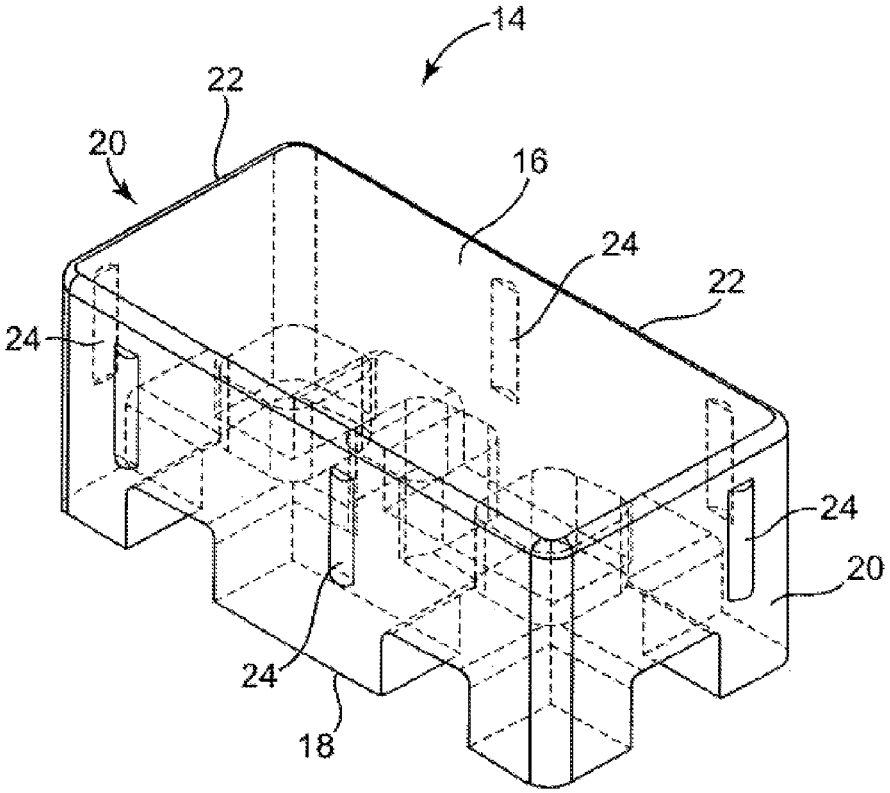
FIG. 2 is a top isometric perspective view of a paver piece in accordance with the embodiment of FIG. 1.
Figure 3:
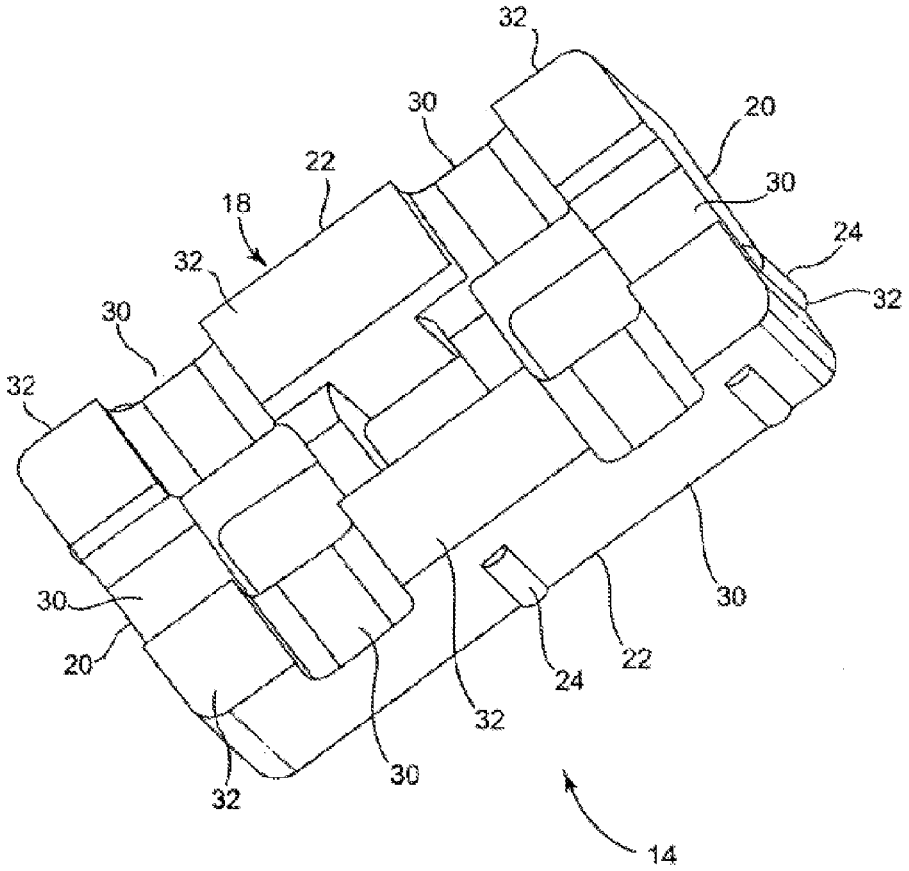
FIG. 3 is a bottom pictorial view of a paver piece in accordance with the embodiment of FIG. 1.
Figure 4:
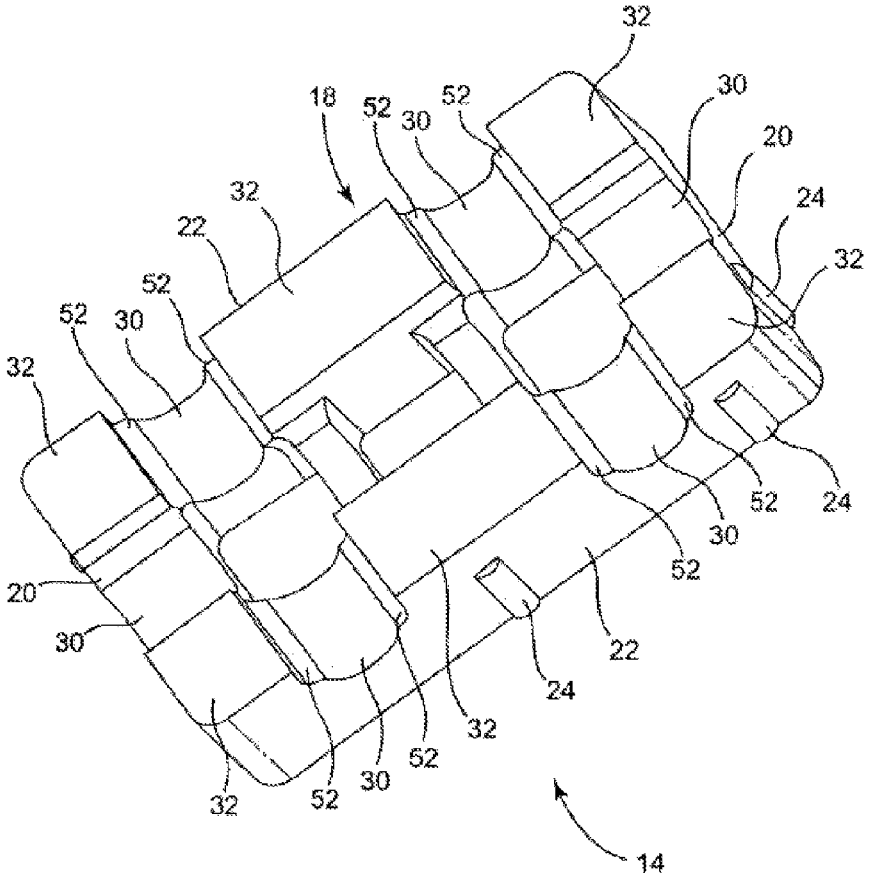
FIG. 4 is a bottom pictorial view of a paver piece having channels to receive a heating element in accordance with one embodiment.
Figure 5:
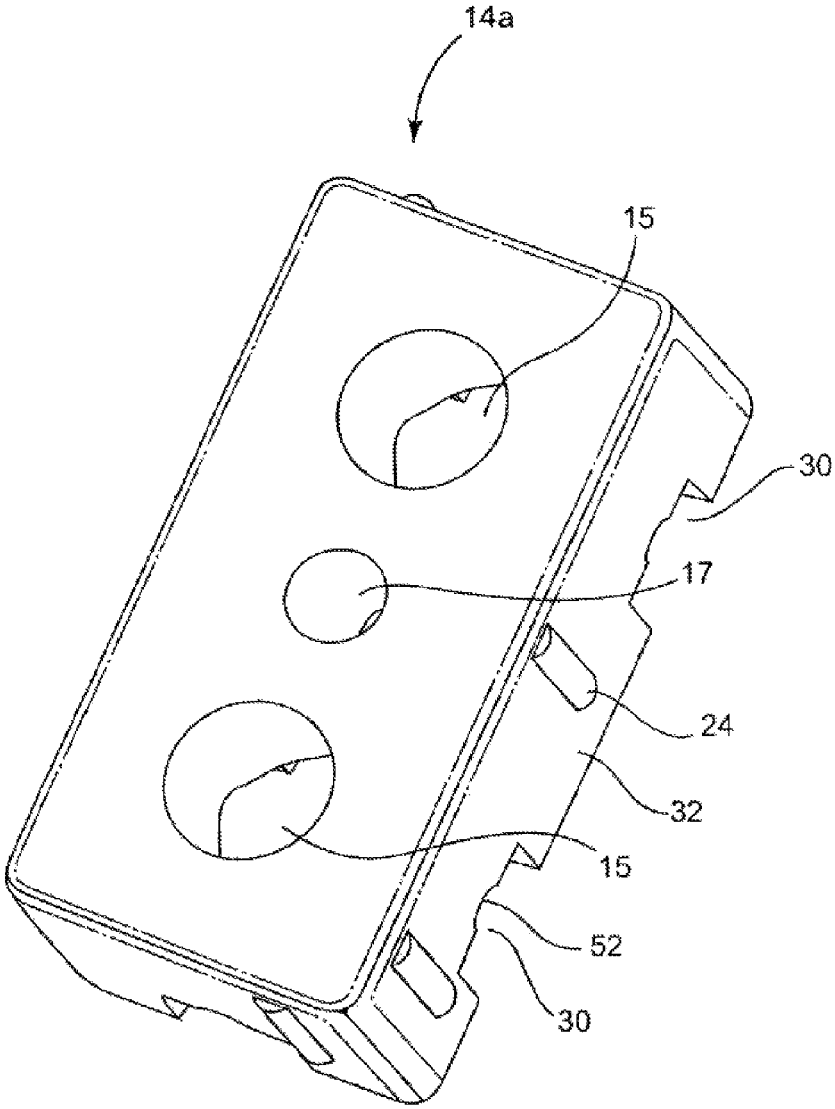
FIG. 5 is a top pictorial view of a paver piece in accordance with another embodiment.
Figure 6:
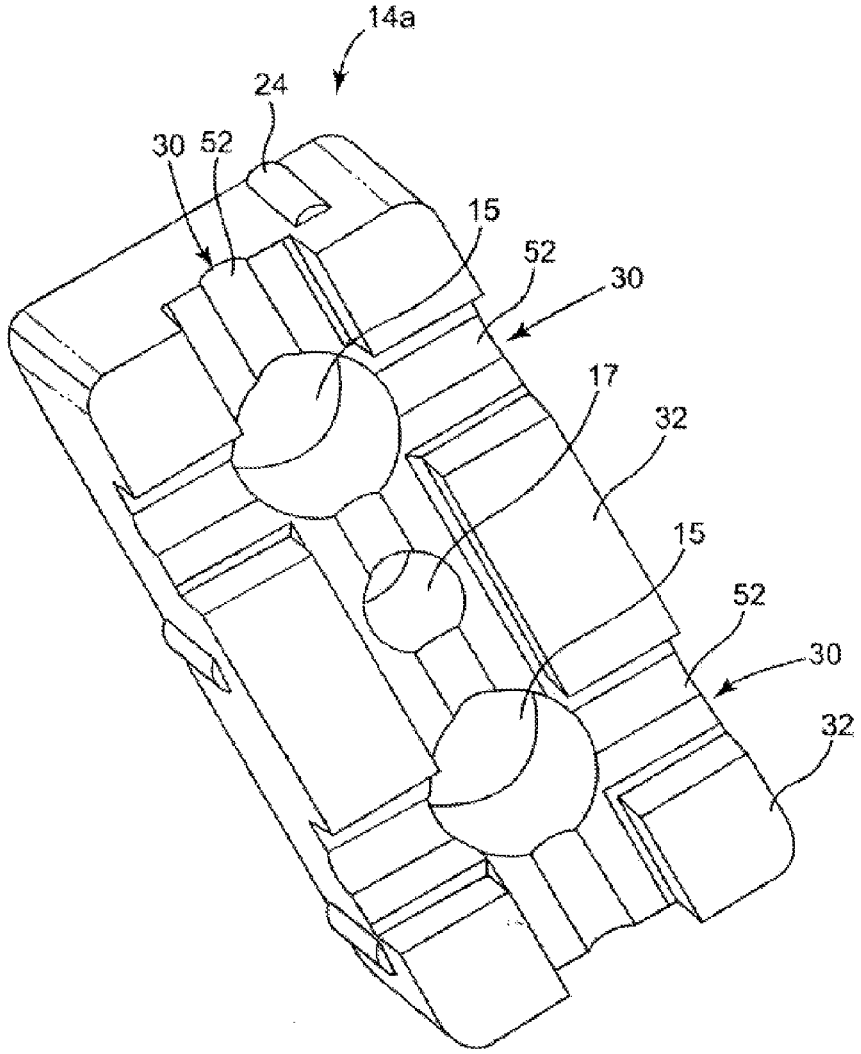
FIG. 6 is a bottom pictorial view of a paver piece in accordance with the embodiment of FIG. 5.
Figure 7:
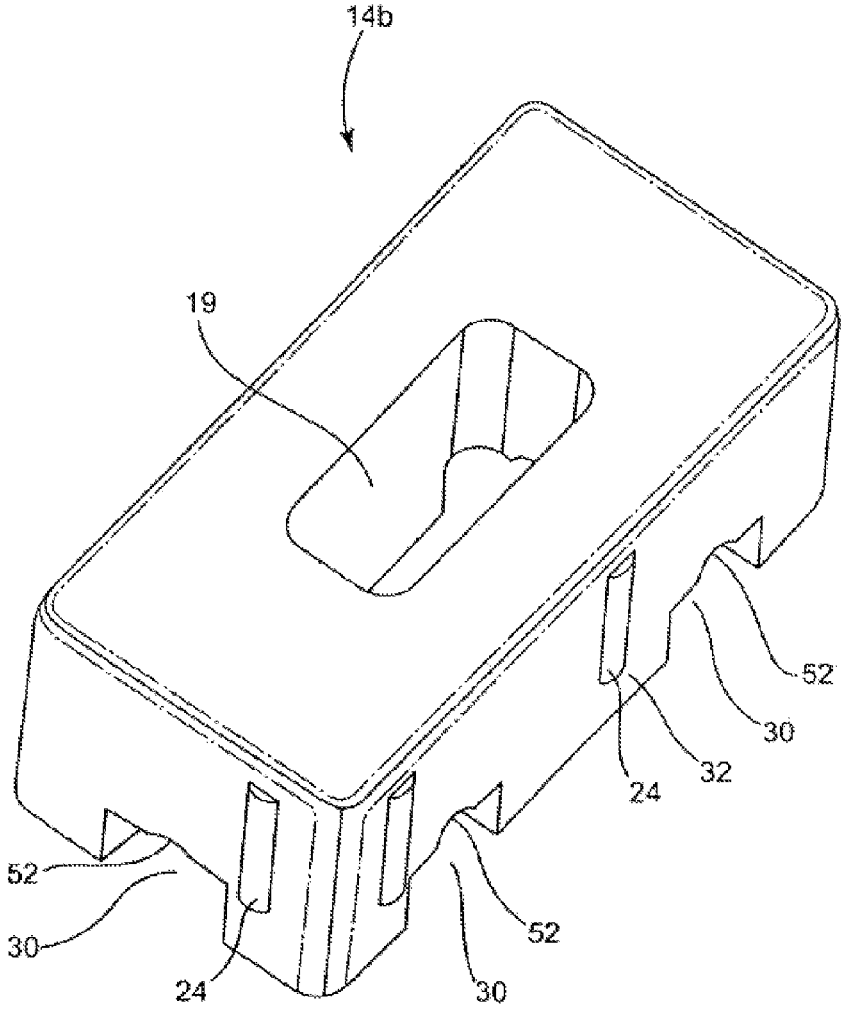
FIG. 7 is a top pictorial view of a paver piece in accordance with a further embodiment.

One example of a paver piece 14 for coupling to a substrate 12 (shown in FIGS. 8*a*-8*c*) is shown in FIGS. 1-4. Alternative paver piece embodiments for coupling to a substrate 12 are shown in FIG. 5-7. FIGS. 1 and 2 illustrate a paver piece 14 from a top perspective. FIGS. 3 and 4 illustrate paver pieces 14 from a bottom perspective. In the embodiments shown, each paver piece 14 comprises a generally rectangular form. As will be understood by one skilled in the art, each paver piece 14 may be shaped in any manner with different geometric shapes, such as squares, hexagons, triangles, etc. that form interlocking surface patterns. The paver pieces include a coupling feature and the substrate includes a complementary coupling feature whereby the paver pieces mate with the substrate. This method provides lateral stability and may also, in some embodiments, provide a friction fit for vertical stability.

As shown, the rectangular paver piece 14 has a generally flat top surface 16 and a bottom surface 18. As described with reference to FIGS. 3 and 4, the bottom surface 18 is configured with features for coupling with at least one substrate 12. The paver piece 14 has front and end walls 20 and first and second side walls 22. As shown, two spacers 24 are provided on each of the first and second side walls 22 and one spacer 24 is provided on each of the front and end walls 20. In alternative embodiments, spacers may be otherwise provided or may not be provided. The spacers 24 provide, at least, space for sand-locking between paver pieces 14. Thus, after placement of the pavers pieces 14, sand may be distributed over the surface of the paver system and permitted to infiltrate between the paver pieces 14 by the spacing of the spacers 24, thereby enabling sand-locking of the paver pieces 14. The size of the spacers 24 may be varied to adjust the spacing of the paver piece. Generally such size variation must correspondingly include variation in the size of the paver piece not including the spacers or variation in the spacing of complementary features of the substrate for coupling to the paver piece. In some embodiments, the size of the spacers 24 may be increased to provide drainage pathways between pavers.

The top surface 16 of the paver piece 14 may be roughened or textured such that it helps deter slippage. Roughness/texture may be imparted to the top surface 16 via mold design, manual roughening, or may be inherent in the top surface 16 due to the material used, e.g. granules of recycled tire or other material. Further, in alternative embodiments, due to the formability of the polymeric material, the top surface 16 may be configured with different textures or designs including imprinted corporate logos, alphanumeric messages (e.g., address, name, website), decorative prints (e.g., leaf impressions, rough pebble surface) etc.

The bottom surface 18 of a paver piece 14 is shown in FIGS. 3 and 4. FIG. 3 illustrates a standard configuration while FIG. 4 illustrates a configuration having channels for receiving a heating element (described more fully below). The bottom surface 18 is configured for coupling with the at least one substrate 12 (see FIGS. 8*a*-8*c*). The configuration of the bottom surface 18 may assume a number of forms complementary to a substrate, including those shown and variations thereof. Thus, the paver piece 14 and the substrate 12 have complementary features for achieving coupling therebetween for lateral stability.

As shown, the bottom surface 18 of the paver piece 14 includes recesses 30 for receiving protrusions from the substrate 12 and protrusions 32 for receipt by the substrate 12. In alternative embodiments, the bottom surface 18 may include only protrusions for receipt by recesses in the substrate, may include only recesses for receipt of protrusions from the substrate, or may have other suitable configuration for coupling with the substrate. Thus, in various embodiments, the complementary coupling features may comprise male and female features. Either of the male or the female feature may be provided on either of the paver piece 14 or the substrate 12. In embodiments comprising a female feature on the substrate 12, the female feature may be closed or may be open, thus creating an opening through the substrate 12.

Figure 8A:
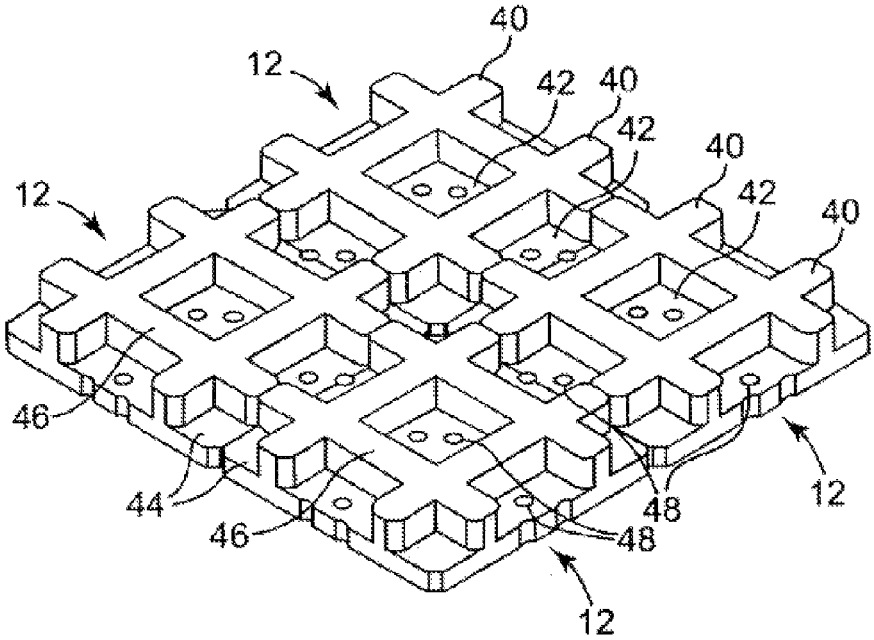
FIG. 8*a* is a pictorial view of a plurality of substrates, complementary with the paver pieces of FIGS. 1-7, in accordance with one embodiment.

The paver piece 14 may be provided in any suitable configuration so long as it is complementary with at least some feature of the substrate 12 to provide lateral stability to the paver pieces. Lateral stability includes, for example, retention of the paver piece at a desired location with some lateral movement available for compression, expansion and undulation of the paver system when used as an articulated paver linkage, as described below. It is to be noted that in addition to providing lateral stability of the paver pieces, lateral stability may be provided for adjacent substrates, discussed more fully below. Further, vertical stability may be imparted to the paver system by friction-fit of the paver pieces 14 on a substrate 12. Thus, for example, given a substrate 12 as shown in FIG. 8*a*, the paver piece 14 may alternately have any of the configurations of FIGS. 5-7. As shown in FIGS. 5 and 6, the paver piece 14*a* may include large openings 15 and a smaller central opening 17. Alternatively, as shown in FIG. 7, the paver piece 14*b* may include a single opening 19. The openings 15, 17, 19 may provide drainage through the paver piece 14.

Figure 9A:
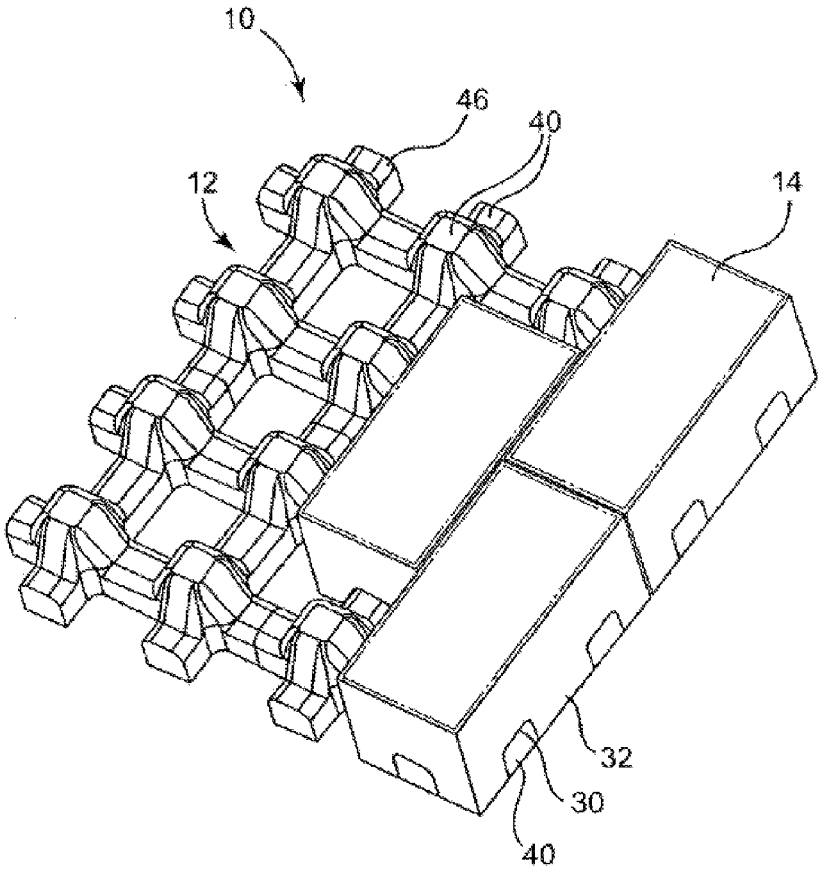
FIG. 9*a* is a pictorial view of a plurality of substrates with paver pieces of FIG. 1 coupled thereto in accordance with one embodiment.
Figure 9B:
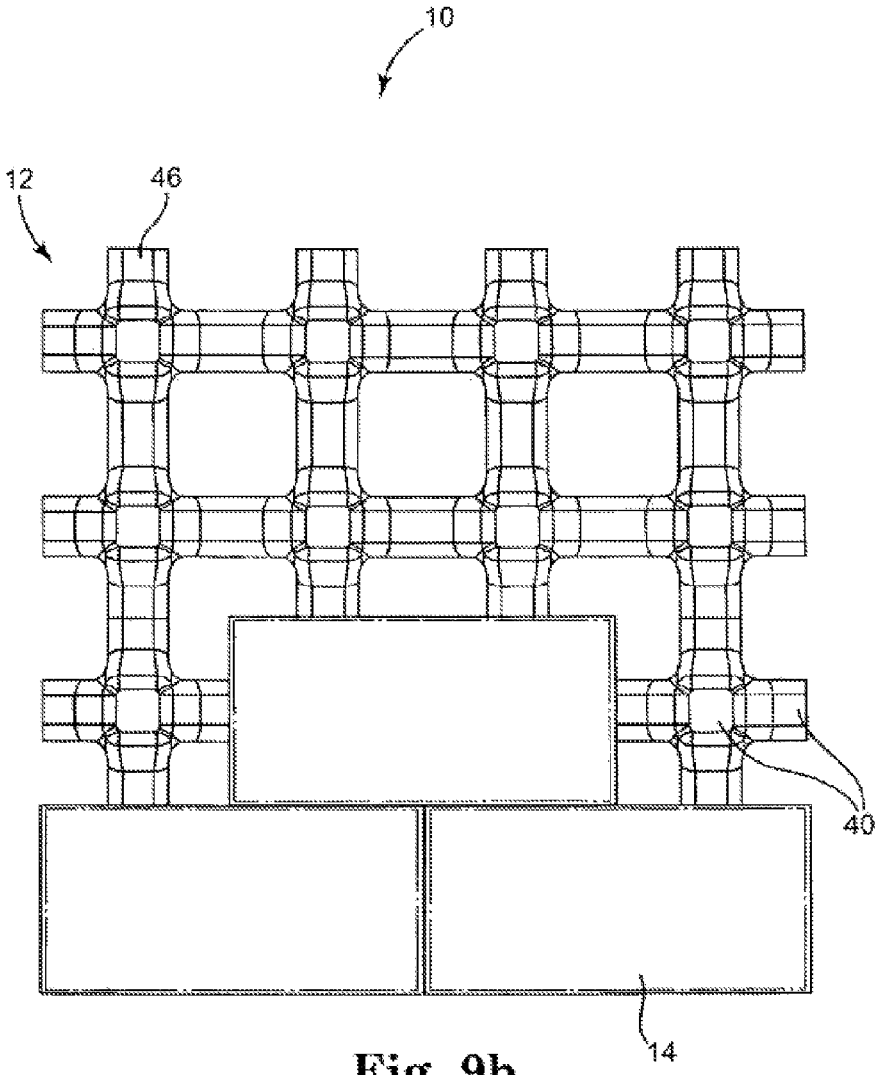
FIG. 9*b* is a top view of a plurality of substrates with paver pieces coupled thereto in accordance with the embodiment of FIG. 9*a*.

FIG. 8*a* illustrates a plurality of substrates 12 (e.g., grid substrates). The substrates may be flexible to contour to a graded but not entirely flat surface. Alternatively, the substrates may be substantially rigid to better disperse a compressive load. Each substrate 12 is configured for coupling with one or more paver pieces 14. The substrates 12 include protrusions 40 for receipt by recesses of the paver pieces 14. The substrates further include recesses 42 for receiving protrusions of the paver pieces 14. In the embodiment shown, the substrates 12 comprise a generally planar support 44 with a grid 46 provided thereupon. The planar support 44 and the grid 46 may be integrally formed. The structure of the grid 46 provides the protrusions 40 while the spacing in the grid 46 provides the recesses 42. In alternative embodiments, the substrates 12 may include only protrusions for receipt by recesses in the pavers, may include only recesses for receipt of protrusions from the paver pieces 14, or may have other suitable configuration for coupling with the paver pieces 14. In yet further embodiments, such as shown in FIGS. 9*a* and 9*b*, the substrate 12 may comprise open grids 46 without a continuous planar support surface.

As shown, a plurality of apertures 48 may be provided. Further, the apertures 48 provide drainage channels and reduce the overall weight of the substrate 12. The number of and placement of apertures 48 may be varied and, in some embodiments, no apertures may be provided.

FIGS. 8*b* and 8*c*, 9*a* and 9*b*, and 10*a*, 10*b*, 10*c*, and 10*d* illustrate paver systems 10 comprising a plurality of substrates 12 with a plurality of paver pieces 14 coupled thereto. As shown, in the coupled relationship, the top surfaces 16 of the paver pieces 14 are in a closely spaced relationship substantially in a common plane and the paver pieces 14 cover substantially the entire substrate 12. In the embodiments shown, each of the paver pieces 14 and the substrates 12 comprise complementary recesses and protrusions for a mating relationship. Any suitable configuration for an interlocking relationship may be used including an interlocking relationship where the paver pieces 14 and substrates 12 have some tolerance for lateral movement therebetween, as discussed below. In an alternative embodiment, overlapping paver pieces and substrates having a positive lock may be provided.

In each of the embodiments shown the paver pieces 14 are placed on the substrates 12 with protrusions of the substrates 12 (formed by the grid of the substrate) received in recesses of the paver pieces 14 and protrusions of the paver pieces 14 received by recesses of the substrates 12 (formed by the spacing of the grid). In various embodiments, coupling may optionally be affected via pressure fitting, friction fit, or may further include an adhesive applied to either or both of the substrates 12 and the pavers 14. As shown, the orientation of the paver pieces 14 on the substrates 12 may be varied and may include, for example, orientation along the x-axis or along the y-axis. As seen most clearly in FIG. 8*c*, the paver pieces 14 may be oriented on the substrates 12 such that one or more paver pieces 14 span more than one substrate. Thus, for example, paver piece 14*a* spans substrates 12*a* and 12*b* while paver pieces 14*b* spans substrates 12*a* and 12*c*. The paver pieces 14 thereby effectively interlock the substrates 12 for lateral stability.

Figure 8B:
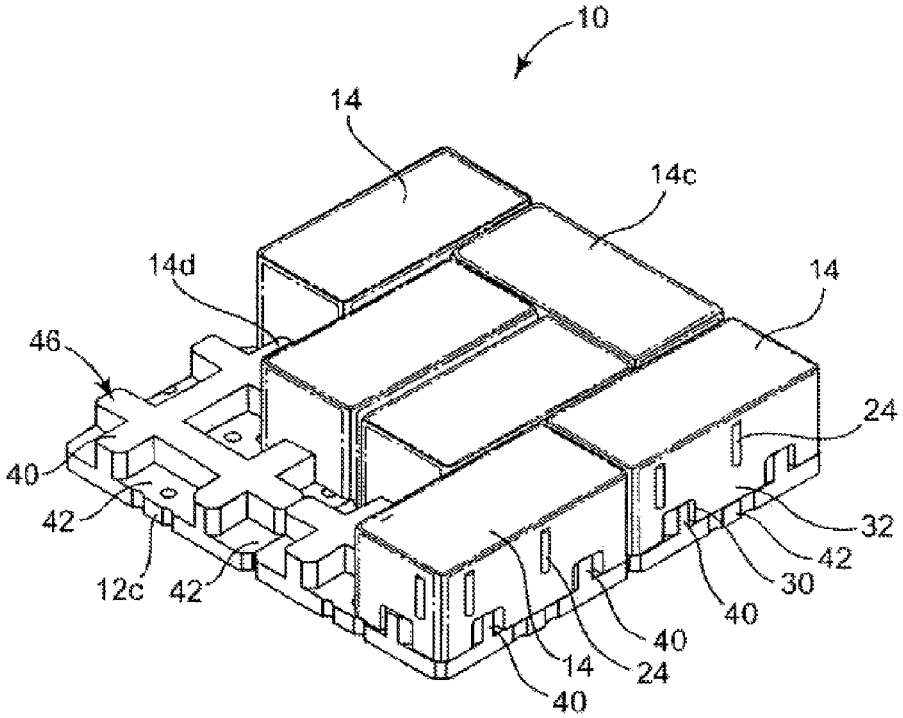
FIG. 8*b* is a pictorial view of a plurality of substrates with paver pieces of FIG. 1 coupled thereto in accordance with one embodiment.
Figure 8C:
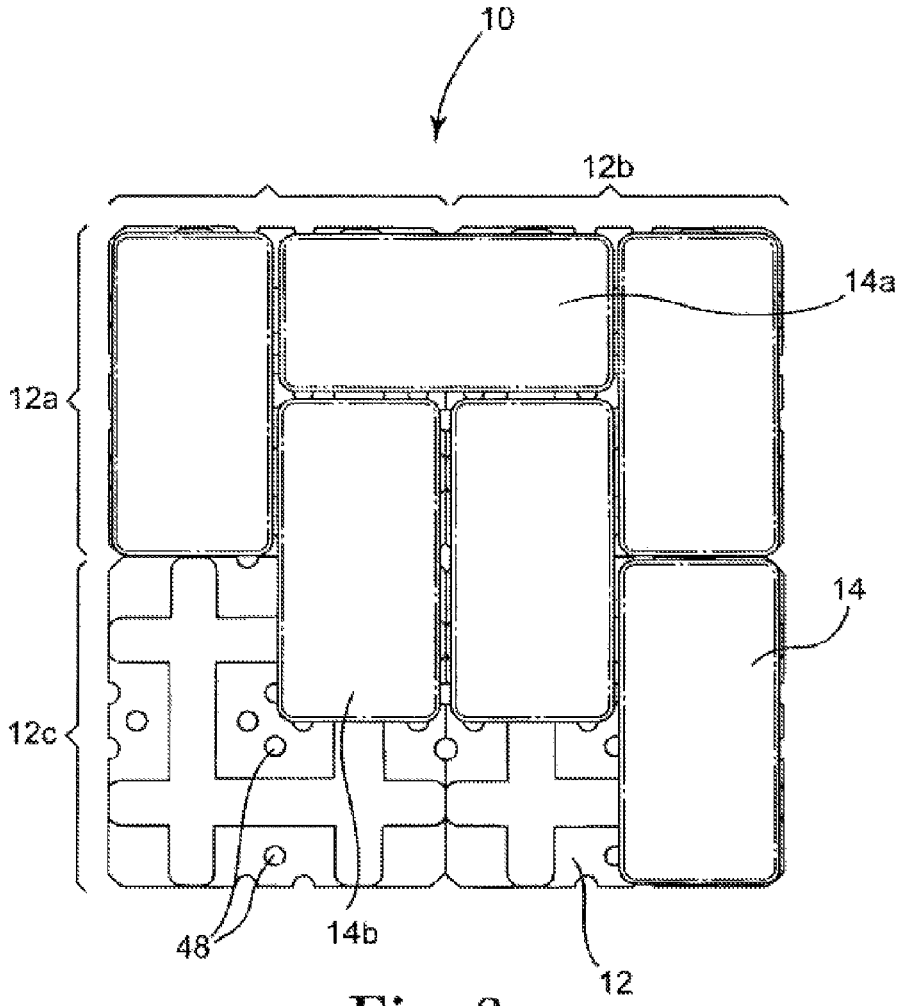
FIG. 8*c* is top view of a plurality of substrates with paver pieces coupled thereto in accordance with the embodiment of FIG. 8*b*.
Figure 10A:
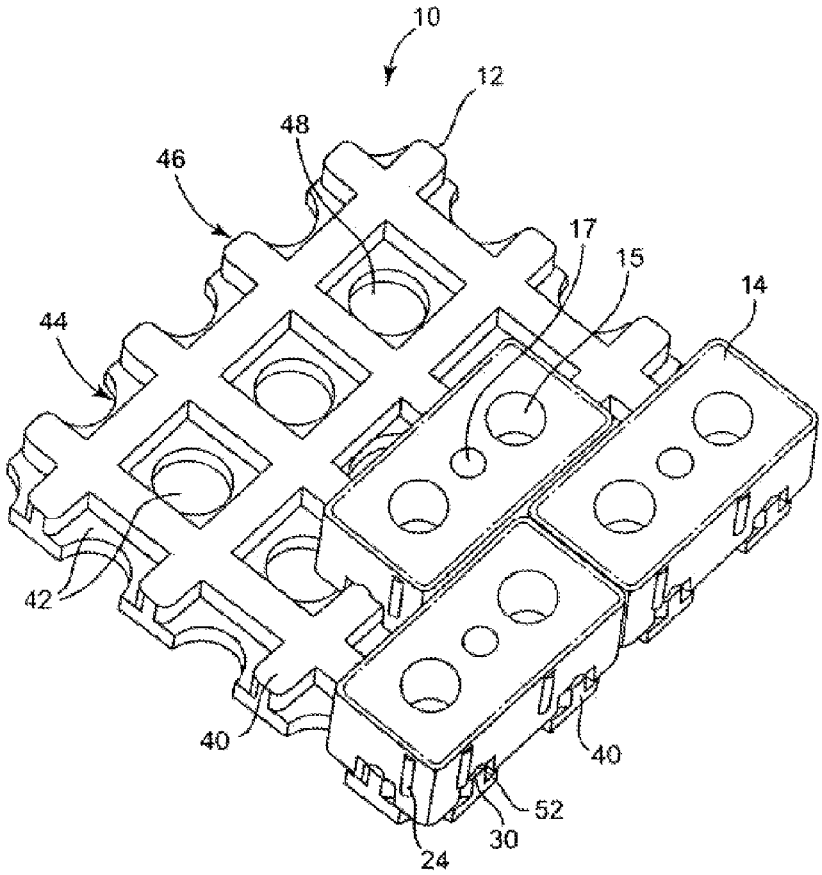
FIG. 10*a* is a pictorial view of a plurality of substrates with paver pieces of FIG. 5 coupled thereto in accordance with one embodiment.
Figure 10B:
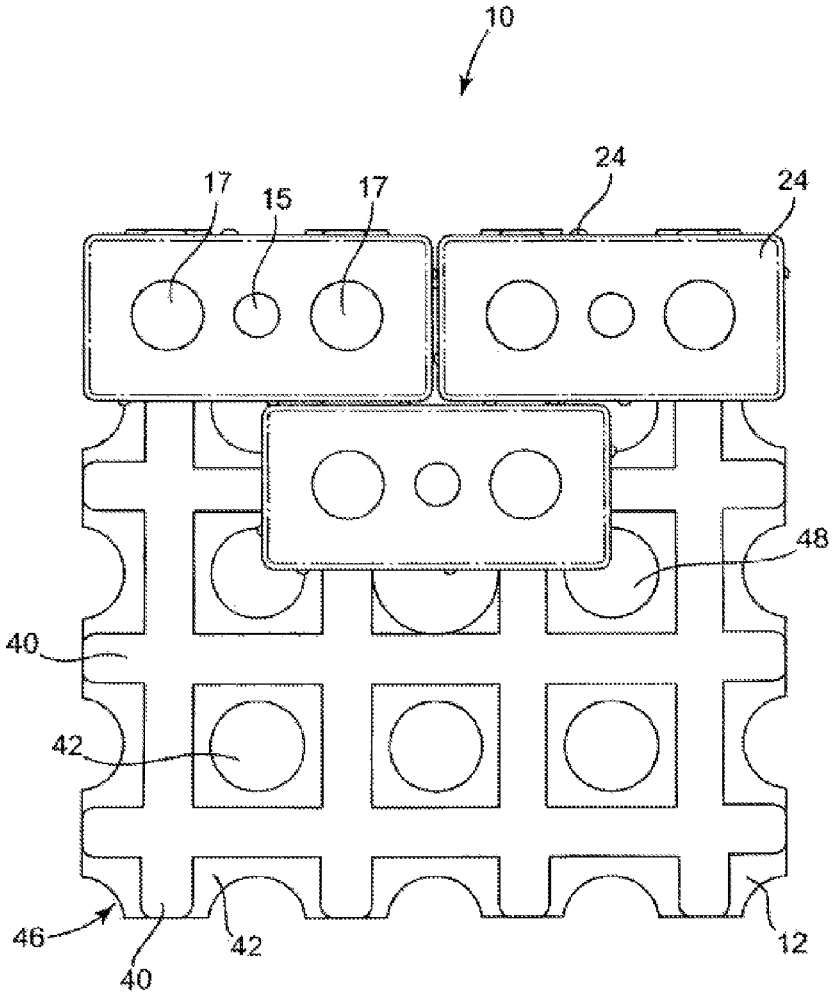
FIG. 10*b* is top view of a plurality of substrates with paver pieces coupled thereto in accordance with the embodiment of FIG. 10*a*.
Figure 10C:
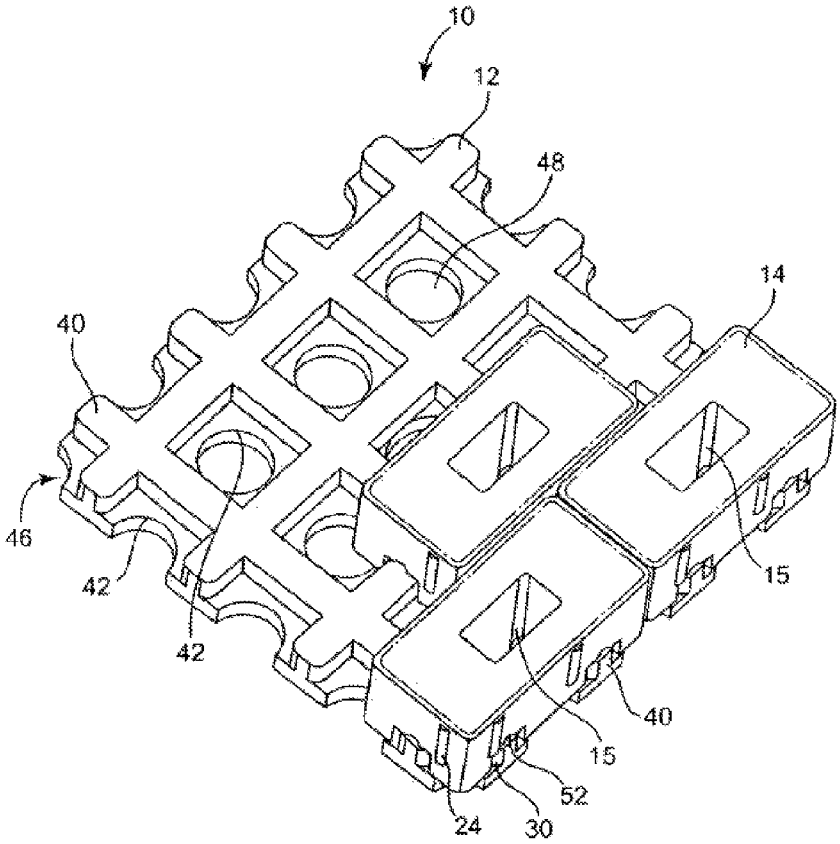
FIG. 10*c* is a pictorial view of a substrate with paver pieces of FIG. 7 coupled thereto in accordance with one embodiment.
Figure 10D:
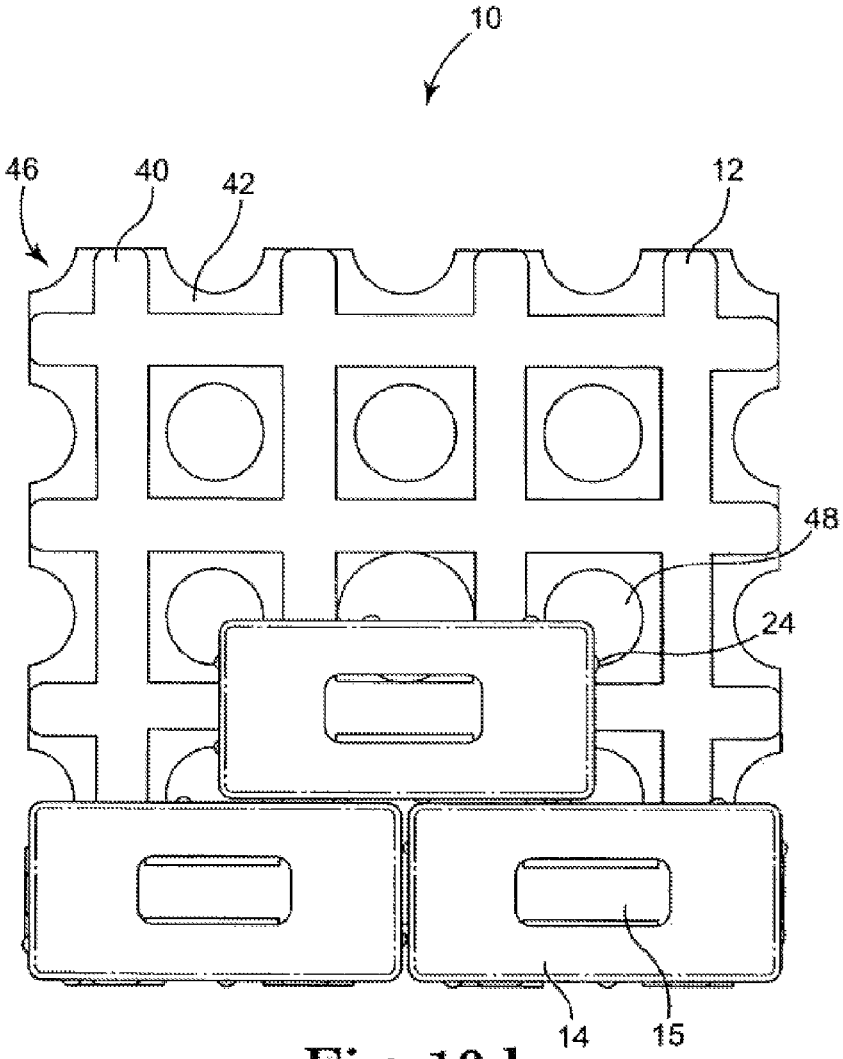
FIG. 10*d* is top view of a substrate with paver pieces coupled thereto in accordance with the embodiment of FIG. 10*a*.

FIGS. 10*a*, 10*b*, 10*c*, and 10*d* illustrate alternative embodiments to the embodiment of FIGS. 8*b* and 8*c*. FIGS. 10*a* and 10*b* illustrate the paver pieces of FIGS. 5 and 6 coupled to substrates having large drainage holes or apertures 48 therein. FIGS. 10*c* and 10*d* illustrate the paver pieces of FIG. 7 coupled to substrates having large drainage holes or apertures 48 therein. The drainage holes or apertures 48 aid in permeability of the paver system 10. In one example, these may be used in areas less likely to encounter foot traffic or areas requiring more drainage, such as the low corner of a larger paved area. In another example, the paver pieces may also be used in heavily trafficked areas where drainage is needed. Additionally, the apertures 15 of the paver pieces 14 may have varied configurations. FIGS. 10*c* and 10*d* illustrate an embodiment wherein the apertures 15 are configured as large rectangular openings.

Figure 11A:
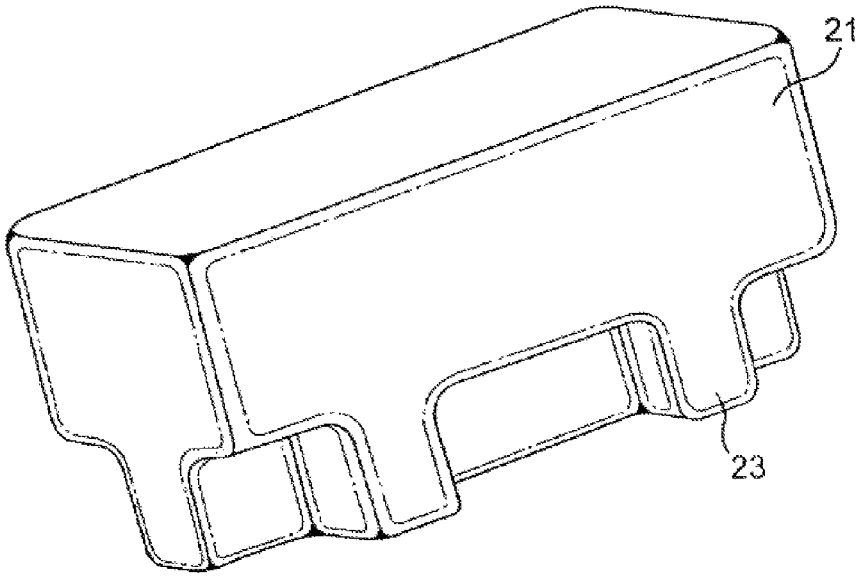
FIG. 11*a* is a side pictorial view of a paver piece in accordance with yet another embodiment.
Figure 11B:
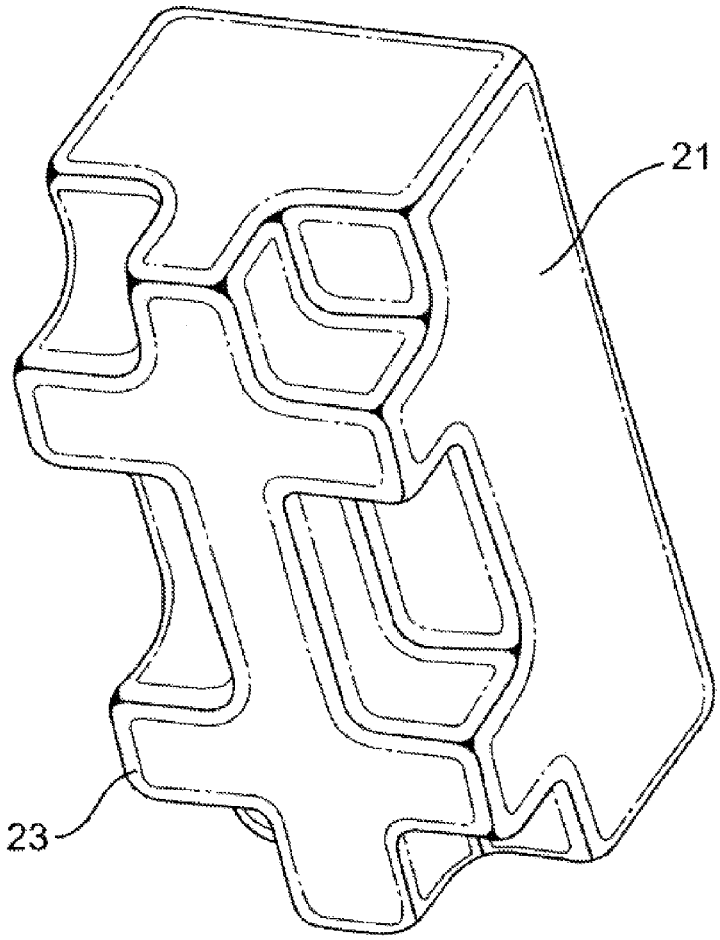
FIG. 11*b* is a bottom pictorial view of the paver piece of FIG. 11*a*.
Figure 12:
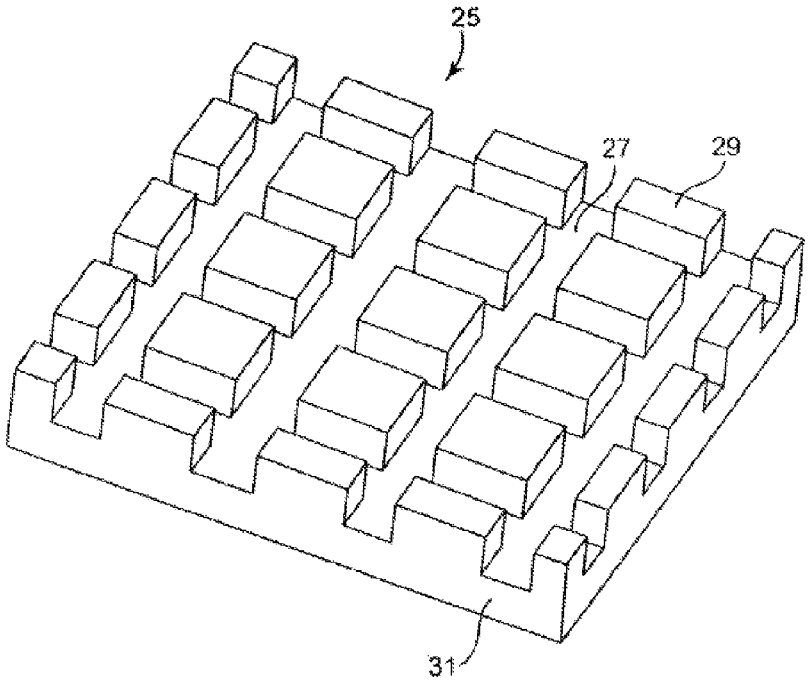
FIG. 12 is a top pictorial view of a substrate complementary with the paver piece of FIGS. 11*a* and 11*b* in accordance with one embodiment.
Figure 13:
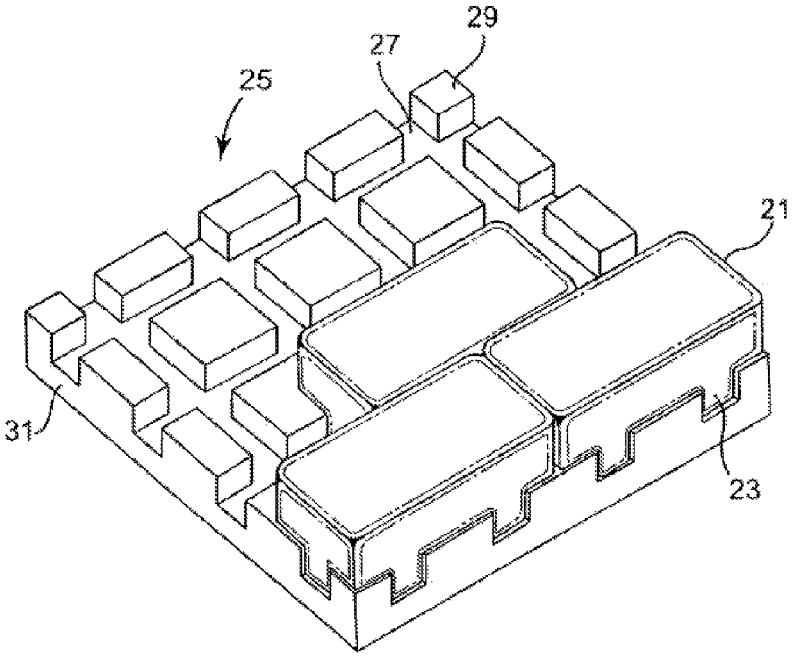
FIG. 13 is a top pictorial view of a substrate of FIG. 12 with paver pieces of FIGS. 11*a* and 11*b* coupled thereto.

FIGS. 11*a*-13 illustrate a further embodiment of coupled paver pieces and substrates. FIGS. 11*a* and 11*b* illustrate an alternative paver piece 21. FIG. 12 illustrates a complementary alternative substrate. FIG. 13 illustrates paver pieces as shown in FIGS. 11*a* and 11*b* coupled with a substrate as shown in FIG. 12. As seen most clearly in FIG. 11*b*, the paver piece 21 includes a cross coupling structure 23 on its bottom surface. In the embodiment shown, the cross coupling structure 23 protrudes from the paver piece 21 for receipt by a complementary recess pattern of the substrate 25. The substrate 25, shown in FIG. 12, is configured for coupling with one or more paver pieces 21. The substrates 21 include protrusions 29, coupling recesses 27 being formed by the protrusions 29. The recess 27 receive the cross coupling structure 23 of the paver pieces 21. As shown, the substrates 21 comprise a generally planar support 31 with the protrusions 29 provided thereupon. The planar support 31 and protrusions 29 may be integrally formed.

Figure 14:
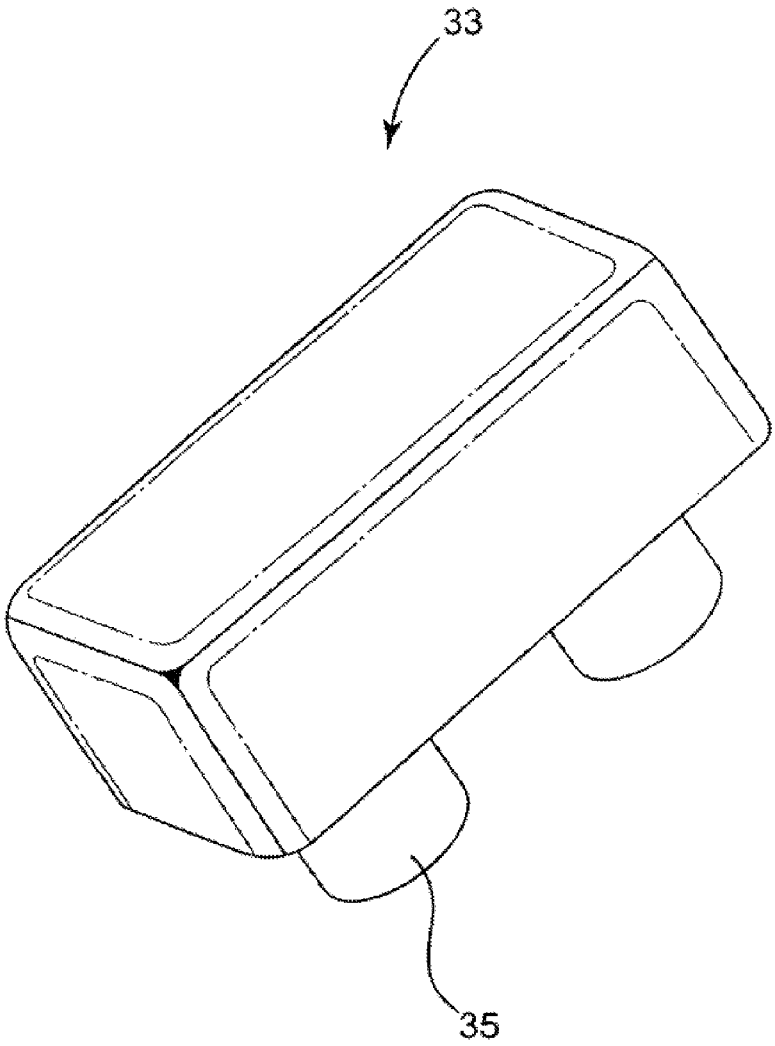
FIG. 14 is a side pictorial view of a paver piece in accordance with yet a further embodiment.
Figure 15:
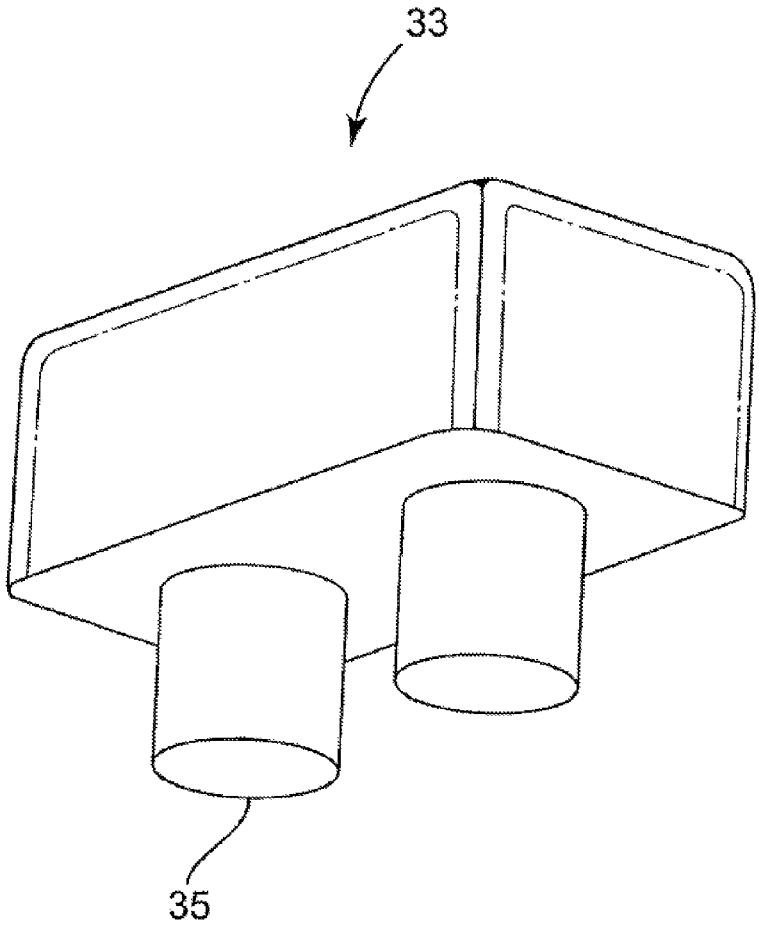
FIG. 15 is a bottom pictorial view of the paver piece of FIG. 15.
Figure 16:
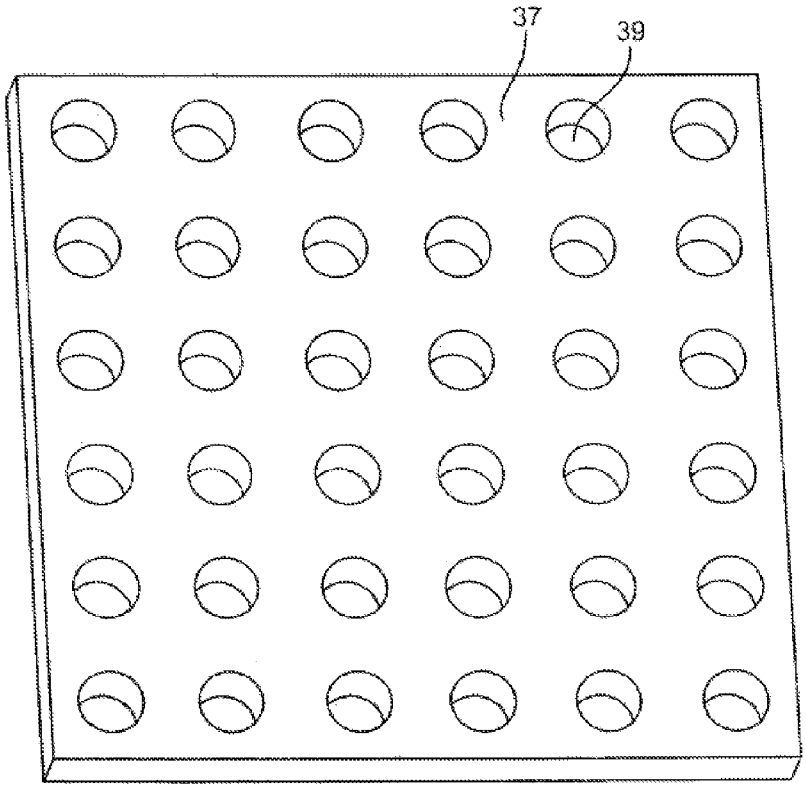
FIG. 16 is a top pictorial view of a substrate complementary with the paver piece of FIGS. 14 and 15.
Figure 17:
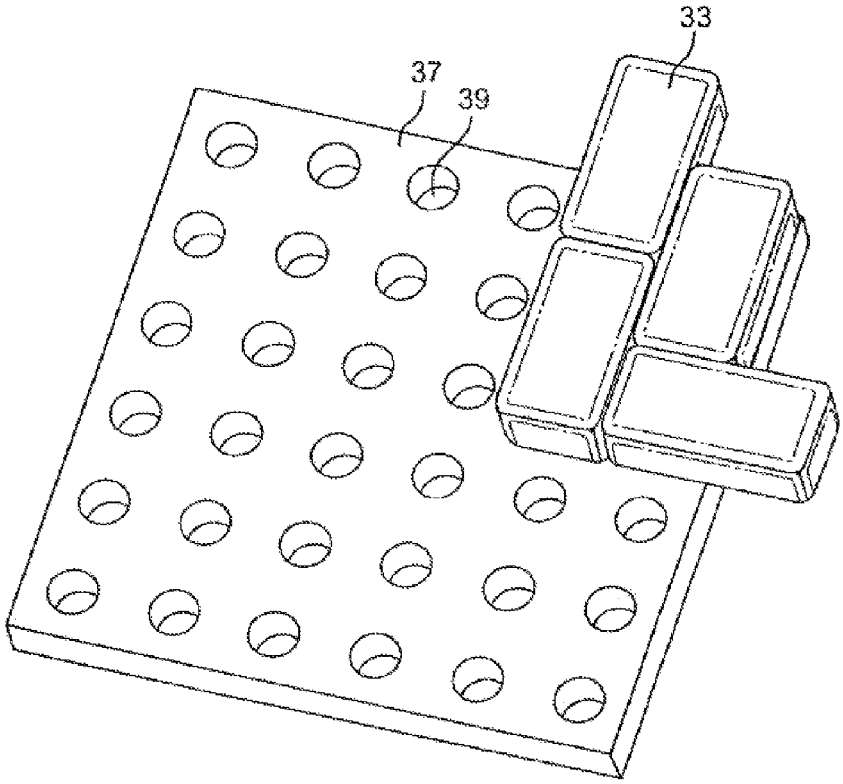
FIG. 17 is a top pictorial view of a substrate of FIG. 16 with paver pieces of FIGS. 14 and 15 coupled thereto.
Figure 18:
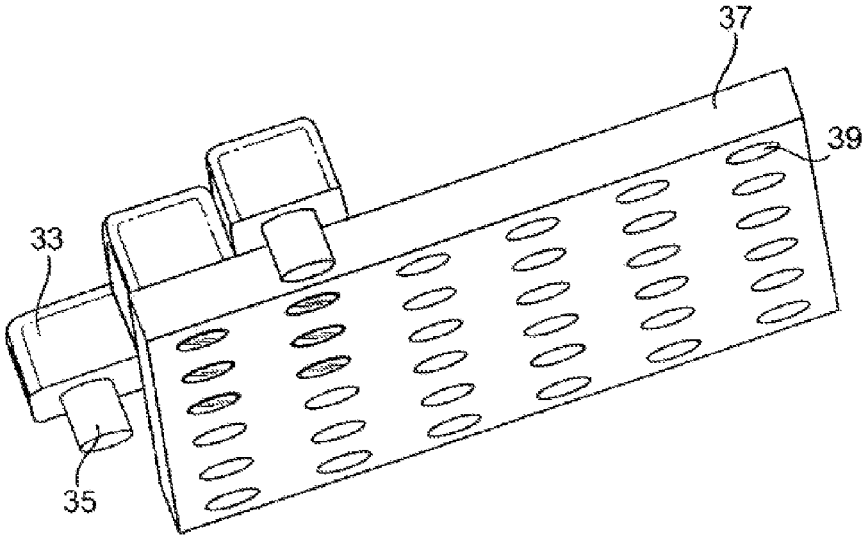
FIG. 18 is a bottom pictorial view of a substrate of FIG. 16 with paver pieces of FIGS. 14 and 15 coupled thereto.

FIGS. 14-18 illustrate another embodiment of coupled paver pieces and substrates. Any suitable shape or geometry of paver pieces and substrates including any variety of protrusions or recesses may be used so long as the paver pieces and substrates are sufficiently complementary to provide lateral stability. FIGS. 14 and 15 illustrate an alternative paver piece. FIG. 16 illustrates a complementary alternative substrate. FIGS. 17 and 18 illustrate paver pieces as shown in FIGS. 14 and 15 coupled with a substrate as shown in FIG. 16. As seen in FIGS. 14 and 15, the paver piece 33 includes protrusions 35 on its bottom surface. In the embodiment shown, the protrusions 35 are generally cylindrical. In alternative embodiments, the protrusions 35 may be any suitable shape for receipt by a recess of the substrate. The substrate 37, shown in FIG. 16, is configured for coupling with one or more paver pieces 33. The substrates 37 includes recesses 39 for receiving the protrusions 35 of the paver piece 33. As seen in FIGS. 17 and 18, a paver piece 33 can extend between one substrate 37 and an adjacent substrate (not shown) for providing lateral stability between substrates.

Figure 19:
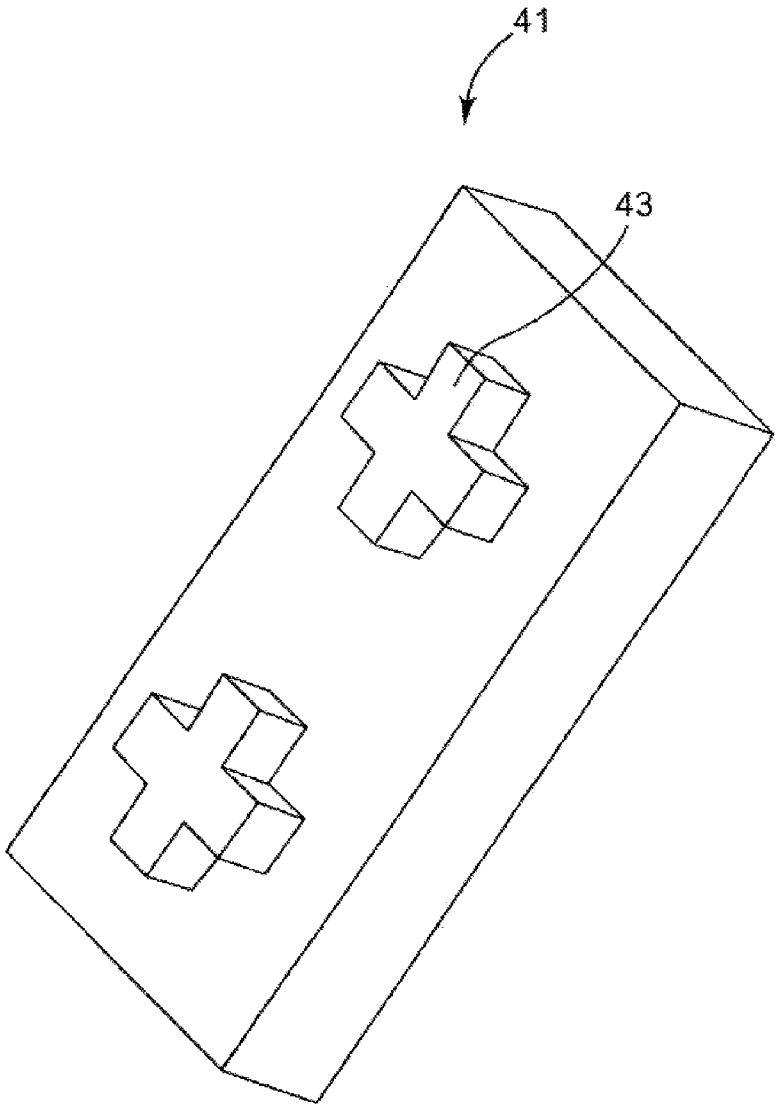
FIG. 19 is a bottom pictorial view of a paver piece in accordance with yet another embodiment.
Figure 20:
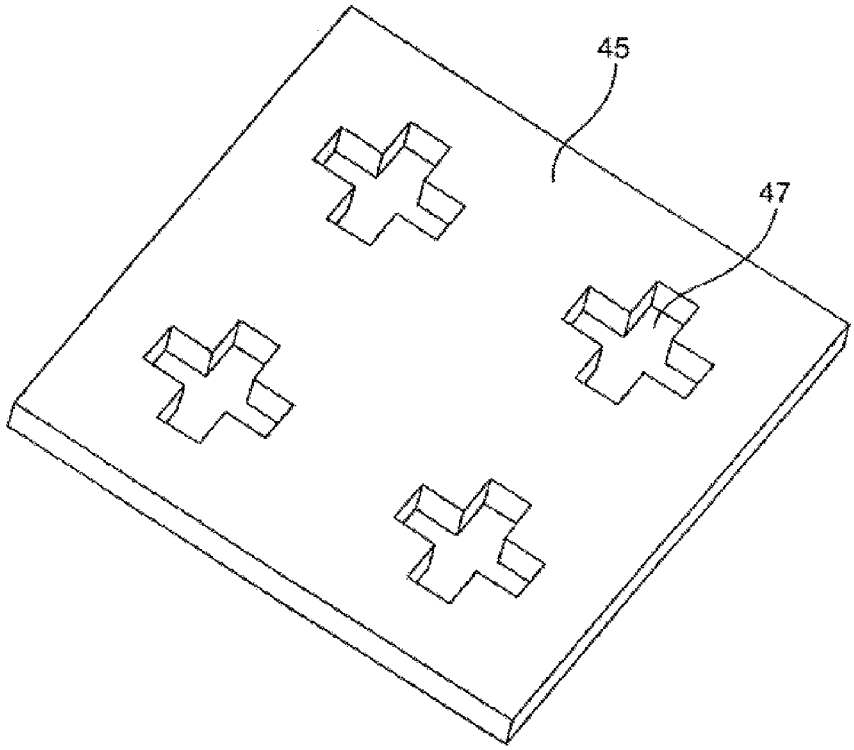
FIG. 20 is a top pictorial view of a substrate complementary with the paver piece of FIG. 19.

FIGS. 19 and 20 illustrate yet a further embodiment of complementary paver pieces and substrates. FIG. 19 illustrates an alternative paver piece. FIG. 20 illustrates a complementary alternative substrate. As seen in FIG. 19, the paver piece 41 includes cross shaped protrusions 43 on its bottom surface. The substrate 45, shown in FIG. 20, is configured for coupling with one or more paver pieces 41 and includes recesses 47 for receiving the protrusions 43 of the paver piece 41. Accordingly, the recesses 47 of the substrate 45 are cross shaped to receive the cross shaped protrusions 43 of the paver piece 41.

The spacing of the complementary features on the substrates may be varied to adjust the overall sizing of the paver system. Thus, using the embodiment of FIGS. 14-16 as an example, the area of ground to be covered by the substrates 37 may be measured, and the nearest whole number of paver pieces 33 to cover that area can be determined using simple equations. The substrates 37 may be designed with a corresponding number of complementary features or recesses 39 spaced evenly over the area of ground to be covered. Thus, when the paver pieces 33 are distributed over the substrates 37, the paver pieces 33 cover the surface area of the ground to be covered without requiring any modification of the substrates or paver pieces. Alternatively, as previously discussed, the polymeric material of the paver pieces and/or substrates may be easily cut using home tools or carpentry equipment. Thus, if a whole number of standard substrates and/or paver pieces does not evenly cover the surface area, the substrates and/or the paver pieces may be cut to fit the surface area.

Again, as would be appreciated by one skilled in the art, while specific embodiments of paver pieces and substrates are shown, any suitable complementary configuration of paver pieces and substrates may be used so long as the paver pieces and substrates are complementary and their interaction provides lateral stability via the substrate (e.g., lateral stability including at least some rotational and translational tolerances of paver pieces relative to substrates in some examples).

With specific reference to the embodiment of FIGS. 1-4 and 8*a*-10*d*, a preassembled paver system unit may be provided by placing a plurality of paver pieces 14 on a substrate 12. Preassembled units may be provided using the paver pieces and/or substrates of any of the embodiments herein disclosed. Once the paver pieces 14 are placed or pre-loaded on the substrates, the paver pieces are substantially prevented from moving laterally (not-withstanding some tolerances for expansion, compression and undulation of the paver system as discussed below) and the combined preassembled paver pieces and substrate may be placed as a unit in final position on a graded surface. The preassembled paver system unit is enabled because of the low weight and interlocking nature of the pieces. Such preassembled paver system unit increases speed of installation, particularly with large areas. To facilitate handling of preassembled units of larger size and/or weight, the substrate may be formed with lift apertures for receiving tongs of a conventional pallet lifter and/or fork lift. To achieve substrate interlocking, such pre-assembled units can be created with selected areas of the substrate not covered by a paver piece until the unit is placed. At that time one or more paver pieces spanning between adjacent substrates may be placed.

In particular embodiments, preassembled units with substrates may be provided with the paver pieces in a pre-configured decorative pattern. For example, if a paver system having paver pieces in a circular pattern is desired, the circular pattern of paver pieces may be achieved on a substrate in a preassembled unit prior to installation. In some embodiments, where a particularly intricate pattern is desired, the pattern may be input into a computer system and the computer system may calculate and output configuration for the substrate and/or the paver pieces. The output configuration may then be molded or extruded as described below. Because of the lightweight nature of the paver system, a preassembled unit, whether or not in a pattern, is relatively lightweight and easy to transport. Thus, a patterned paver system is much more easily designed and installed using the paver system of the present invention than conventional cementitious or clay systems wherein the design must be laid during installation and the pieces carefully maneuvered and/or modified to fit the design. It should be noted that the paver system may be provided in a decorative pattern in a non preassembled unit embodiment as well.

The paver system 10, comprising a plurality of substrates 12 and a plurality of paver pieces 14 enables easy alignment and distribution of load. More specifically, the paver pieces 14 are easily aligned on the substrates 12. Thus, during laying of the paver system 10, the substrates 12 are placed on the surface to be covered by the paver system 10. The paver pieces 14 are then placed over the substrates 12. After placement of the paver pieces 14, sand may be distributed over the paver system for infiltration between the paver pieces 14 in the areas created by the spacers 24. The sand provides sand-locking.

Figure 21A:
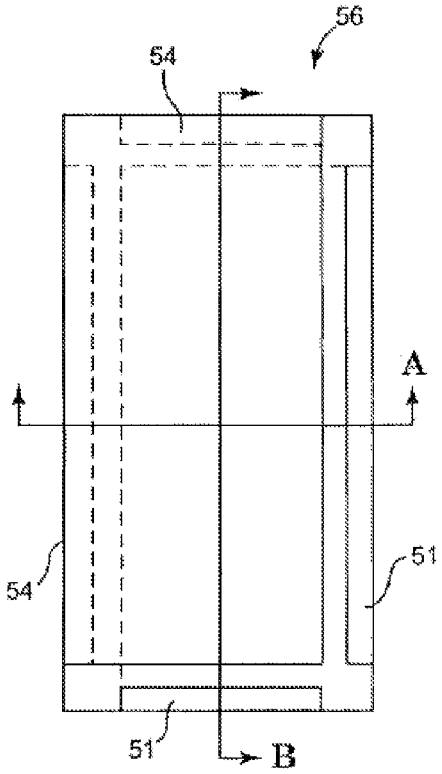
FIG. 21*a* is a top view of a self-substrate paver piece in accordance with one embodiment.
Figure 21B:
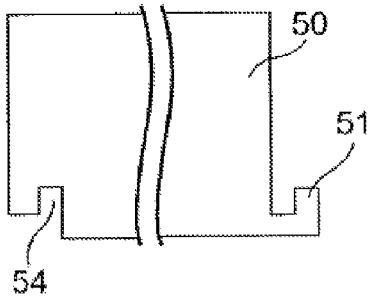
FIG. 21*b* is a side cross-sectional view (broken) of the self-substrate paver piece of FIG. 21*a* taken along sectional line A.
Figure 22:
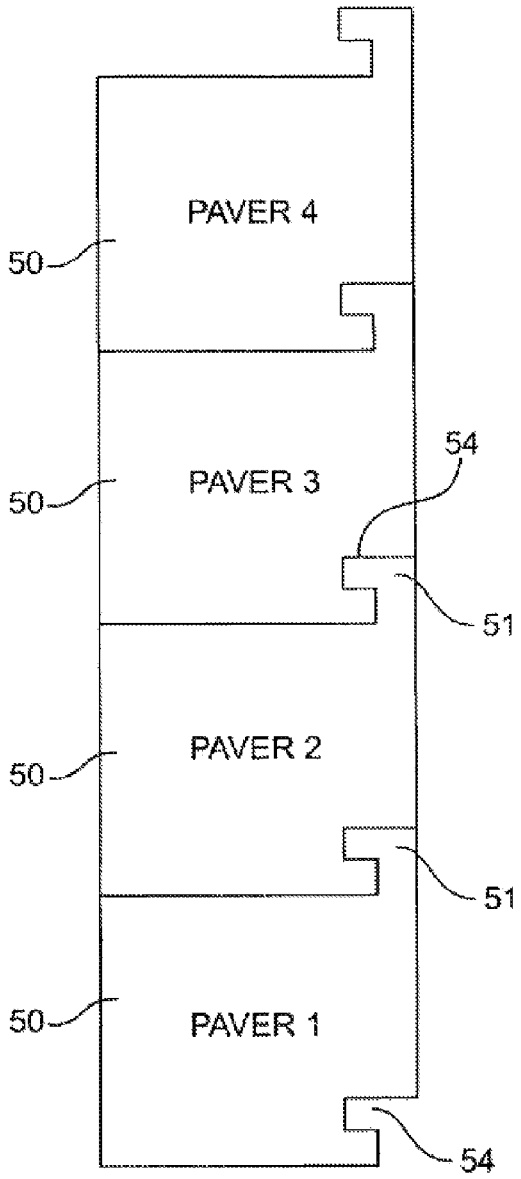
FIG. 22 is a simplified side view of a plurality of interlocked self-substrate paver pieces of FIGS. 21*a, b*.

As discussed above, the substrate, whether separate from or integral to the paver pieces, provides a positive locking system that prevents pavers from moving laterally (not-withstanding some tolerances for compressions, expansion and undulation or curving of the paver system as described below), provides a means to transfer and install multiple paver blocks at one time, and provides a means to disperse compression loads applied to the paver pieces over a wide area. FIGS. 21*a*-22 illustrate an embodiment wherein the substrate is integral with the paver pieces. Thus, the paver pieces are mating and interlocking with one another and thus comprise self-substrates.

FIG. 21*a* is a top view of a paver piece 50. FIG. 21*b* is a side-cross-sectional (broken) view of the self-interlocking paver piece 50 along either line A or line B of FIG. 21*a*. FIG. 22 is a side view of several interlocked paver pieces 50. As shown, each paver piece includes an extending lip 51 and groove 54. The lip 51 and groove 54 are correspondingly shaped and sized such that the lip and groove mate. As seen most clearly, a lip 51 is provided on a two perpendicular sides of the paver piece 50 and a groove 54 is provided on the remaining two perpendicular sides of the paver piece 50. Thus, the paver pieces 50 interlock with one another in two directions.

Figure 23A:
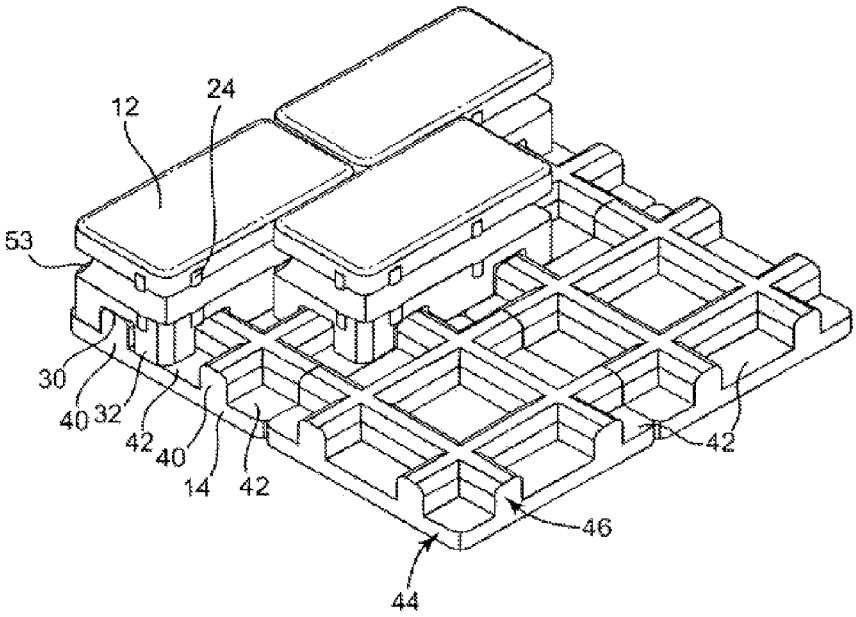
FIG. 23*a* is a top pictorial view of a paver system for receiving a heating element in accordance with one embodiment.
Figure 23B:
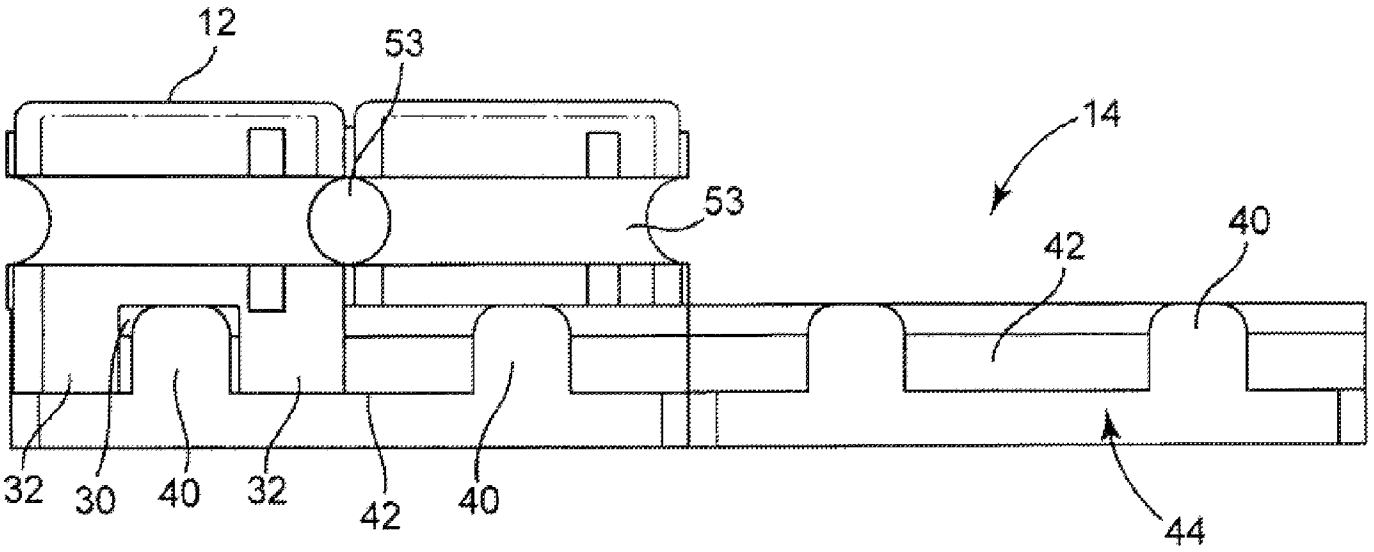
FIG. 23*b* is a side pictorial view of the paver system of FIG. 23*a*.

As mentioned with reference to FIG. 4, the paver system may include heat delivery elements. Thus, the paver system may be installed with a heating system provided therein. In previous paver systems, the heat delivery element typically is buried in sand beneath the pavers. FIGS. 23*a* and 23*b* illustrate an embodiment wherein conduit spaces are provided along the sides of the paver pieces for receiving a heat delivery element. In FIGS. 23*a* and 23*b*, the heating system may comprise a water or antifreeze plumbing system that may be provided with the paver system, for example, via tubes fit in the channel 53 defined between adjacent paver pieces 12. The plumbing tube may be a flexible plastic tube. The heat delivery element, for example, a plumbing tube, may also be provided in a channel 52 between the paver piece 14 and the substrate 12, as shown in FIG. 4. In the embodiment shown, the channels 52 are provided with the recesses 30 on the bottom surface 18 of the paver piece 14. Thus, the recesses 30 for receiving protrusions from the substrate 12 further comprise channels 52 for receiving a heat delivery element.

Figure 24A:
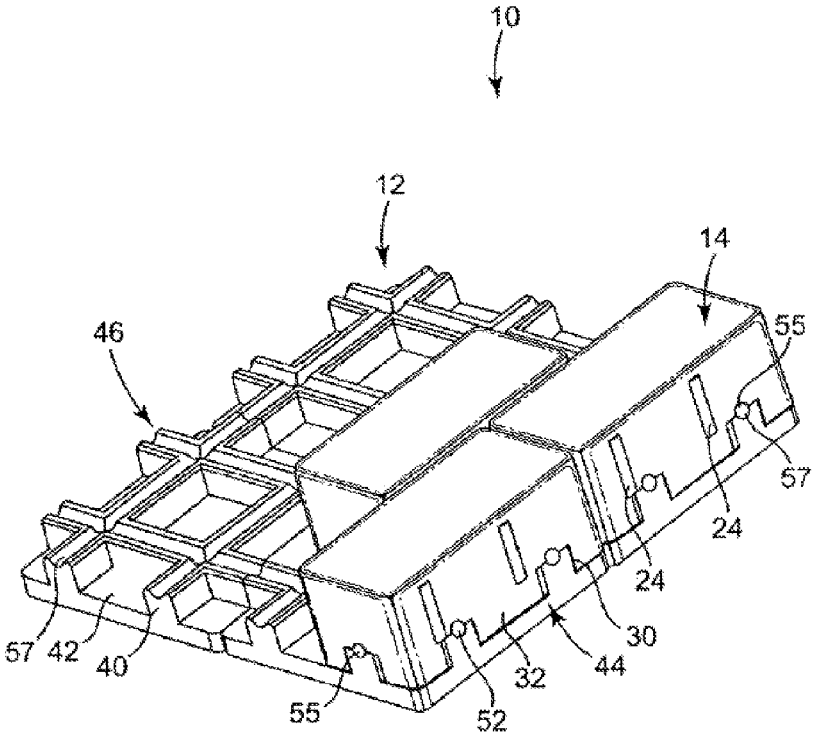
FIG. 24*a* is a top pictorial view of a paver system for receiving a heating element in accordance with one embodiment.
Figure 24B:
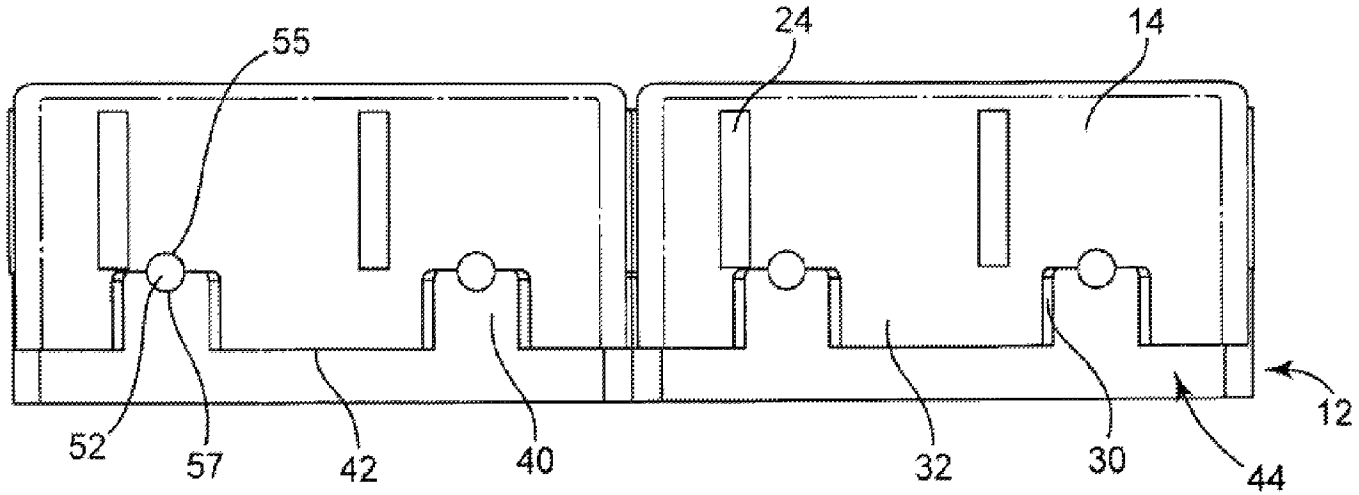
FIG. 24*b* is a side pictorial view of the paver system of FIG. 22*a*.
Figure 25A:
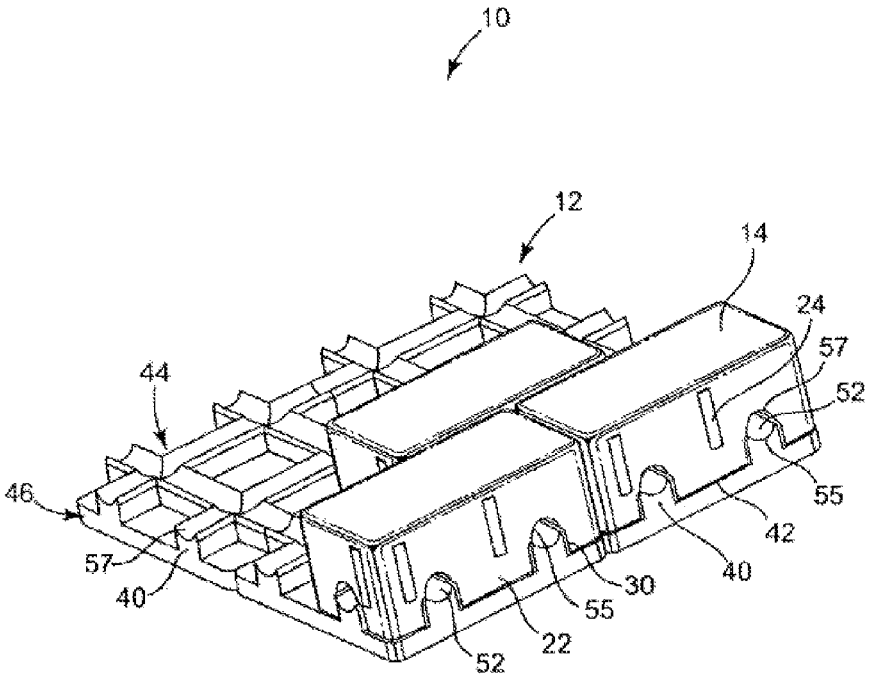
FIG. 25*a* is a top pictorial view of a paver system for receiving a heating element in accordance with one embodiment.
Figure 25B:
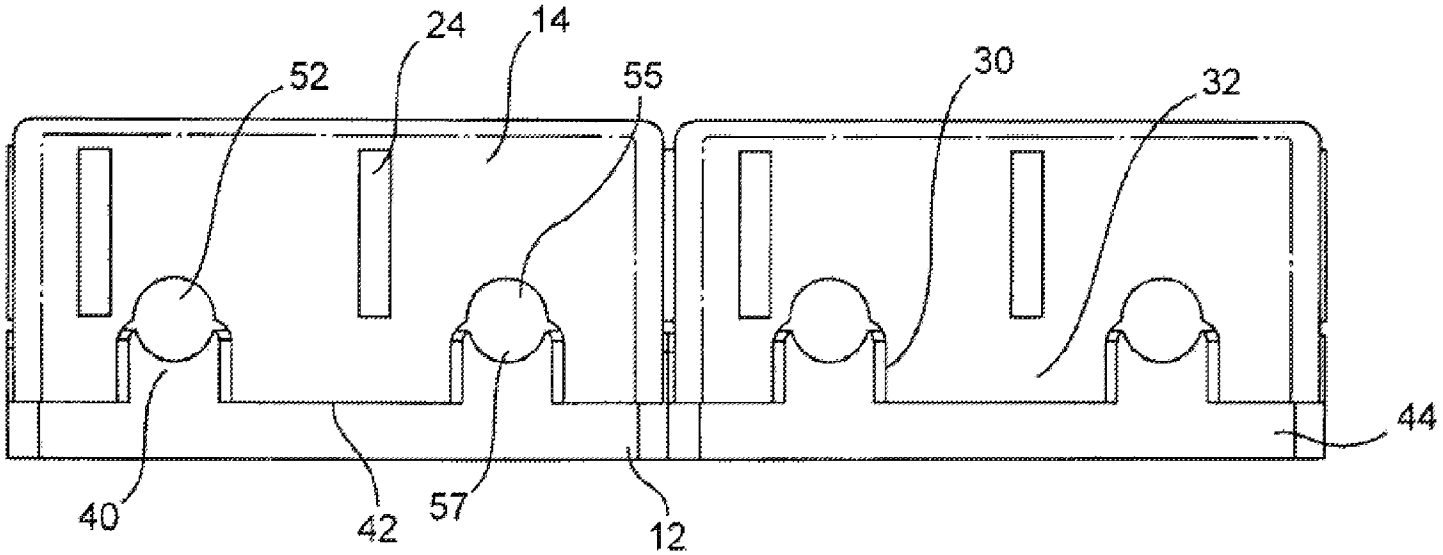
FIG. 25*b* is a side pictorial view of the paver system of FIG. 25*a*.

In alternative embodiments, the heat delivery element may be an electrical resistance element such as a heating cable. Generally, a heating system using plumbing utilizes larger channels 52 while a heating system using electrical resistance elements utilizes smaller channels 52. Thus, as shown in FIGS. 24*a* and 24*b*, relatively small channels 52 are provided between the substrate and the paver pieces for receiving an electrical resistance element such as an electrical cord. In the embodiments shown, the channels 52 are formed by a conduit recess 55 in the coupling recess 30 of the paver piece 14 and a conduit recess 57 in the coupling protrusion 40 of the substrate 12. In contrast, as shown in FIGS. 25*a* and 25*b*, relatively large channels 52 are provided between the substrate and the paver pieces for receiving a plumbing tube.

By providing the heat delivery element directly within the paver system 10, the heated system is more efficient, using less energy than conventional cementitious or clay paving systems. Further, by providing the heat delivery element proximate the surface of the paver system, the heat delivery element may be used to melt ice or snow on the surface of the paver system.

In alternative embodiments, the heat delivery element may be provided within a paver piece 14, between the paver pieces 14, within a substrate 12, between the substrates 12, or in other suitable position within the paver system 10. Forming of the conduits for receiving heat delivery elements that have sufficient strength to resist collapse when the paver pieces are loaded is facilitated by the composite polymeric material The plumbing system may be filled with any of a variety of coolant options (e.g., water, glycol, etc.). The system provides a means to heat and/or cool the paver-substrate system, thus providing climate control of enclosed areas and surface temperature control of exterior areas. Common uses for this type of heating application include walkways and driveways in northern regions in which an end-user would like to thaw snow or ice accumulation without the use of non-environmentally friendly chemicals (e.g., chlorine, salt) or labor intensive manual removal methods (i.e., shoveling, plowing, etc.). Providing the heat delivery element proximate the surface of the paver system facilitates using the heating element to melt ice or snow on the surface of the paver system.

During installation of the paver system, as the paver system is laid, the heat delivery element may be threaded through the conduits and channels. Alternatively, the heat delivery elements may be placed through the conduits or channels in any suitable manner.

In alternative embodiments, a lighting system may be provided within the channels of FIG. 23*a*, 23*b*, 24*a*, 24*b*, 25*a*, or 25*b*. Thus, the paver system may be installed with a lighting system provided therein. As described previously, conduits may be provided within the paver pieces. A lighting element such as a rope light may be distributed through the conduits. In one embodiment, rope lights are provided in a channel 52 between the paver piece 14 and the substrate 12, as shown in FIG. 4, and one or more paver pieces have openings (such as for drainage, as discussed above) or translucent portions to permit the light to be viewed. The channels 52 may provided with the recesses 30 on the bottom surface 18 of the paver piece 14. Thus, the recesses 30 for receiving protrusions from the substrate 12 further comprise channels 52 for receiving the lighting element. Electricity may be provided to the lighting system in any suitable manner. In some embodiments, the paver pieces may comprise a translucent polymeric material and/or may comprise a fluorescent or glow-in-the-dark polymeric material. In a fluorescent embodiment, the paver piece acts as a light sink for the sun, providing light during the hours of darkness.

Figure 26:
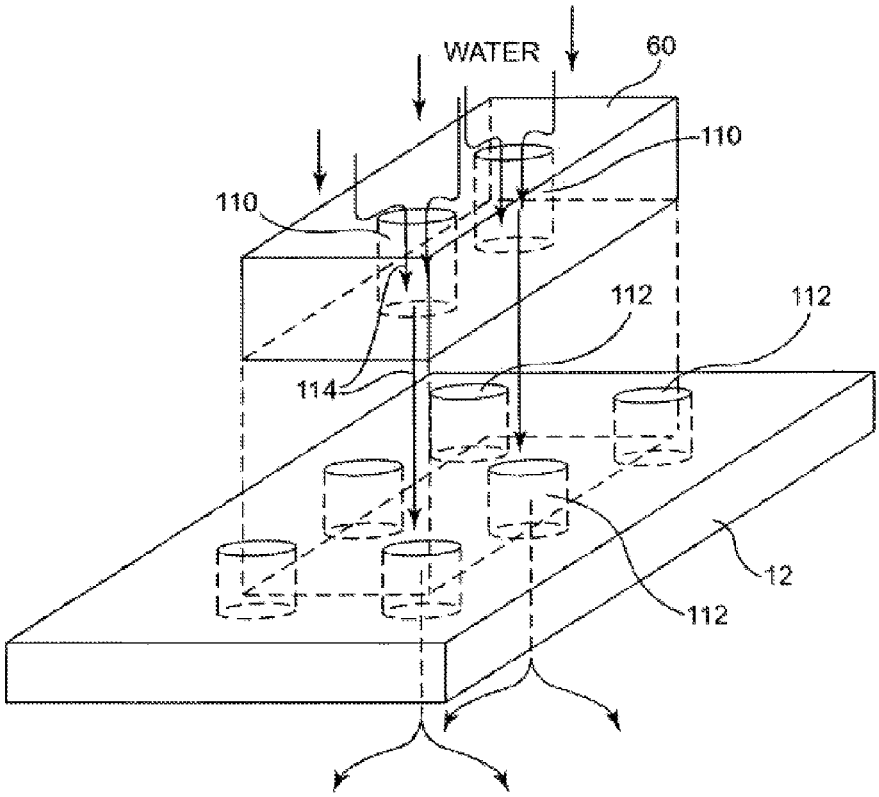
FIG. 26 is an exploded perspective view of a permeable paver system in accordance with one embodiment.

The paver system may be configured with drainage features. A paver system with drainage features is shown in FIG. 26. For simplicity, complementary interlocking features of the paver piece 60 and the substrate 12 are not shown. A paving system 10 using drainage paver pieces 60 with drain apertures 110 and a substrate 12 with drain apertures 112 provides surface-to-ground drainage paths 114 and is a permeable system and meets run-off requirements. Preferably the drainage paths 114 through the paver pieces 14 and substrate 12 form a tortuous path that affords adequate flow but at a low velocity. The system provides a means for water penetration, thus reducing and/or eliminating the need for costly and many times non-environmentally friendly run-off paths and drainage systems that are traditionally used with non-porous concrete and asphalt systems. In the embodiment of FIG. 5-7, the paver piece 14*a*, 14*b* includes one or more drainage holes 15, 17, 19 according to expected drainage flow requirements. The holes 15, 17, 19 may vary in size and shape. In one embodiment, the holes are circular and vary in diameter from approximately 2 mm to approximately 3 cm. In certain embodiments, porous fill, such as gravel (not shown), may be provided within the holes. As discussed with reference to FIGS. 8*a*, 8*b*, 9*a*, and 9*b*, the substrates 12 may comprise apertures 48. The paver pieces and substrate holes provide drainage routes for water draining through the drainage paver pieces 60 of the paver system. Drainage can further be provided using larger gaps provided by the spacers 24 of the paver pieces 14 and/or open grid substrates 12 between paver pieces (see FIGS. 9*a* and 9*b*).

Polymeric paver pieces as provided herein are easily and precisely formable, lightweight, and durable. They provide load bearing compressive strength. Further, the polymeric paver pieces may be easily cut or configured using standard home tooling or home carpentry equipment such as wood saws, table saws, etc. The surface of polymeric pieces formed via injection molding may be slightly rough and, thus, resistant to slippage.

In one embodiment, the paver system comprises paver pieces and substrates comprised of a polymeric material. The polymeric material may comprise rubber and plastic. The rubber may be vulcanized rubber from recycled tires. Recycled car tires are available in a crumb form having varying sizes. Suitable sizes for use with the present invention include 4 to 10 mesh. The plastic may be a recycled plastic. In various embodiments, the plastic comprises recycled high density polyethylene (HDPE) or recycled polypropylene. Generally, the plastic acts as a binder and forms a matrix for the rubber. In one embodiment, the polymeric material comprises approximately 60 to 80% vulcanized rubber, 20 to 40% plastic, and 0 to 7% additive (described below). In other embodiments, the polymeric material is a composite containing from 50% to 99% by weight recycled rubber and from 1% to 50% plastic.

The paver pieces and/or substrates may be formed via injection molding, as is known in the art. In alternative embodiments, other ways of forming the paver pieces and/or substrates may be used including, but not limited to, extrusion, stamping, forging, casting and the like. With specific reference to injection molding, stated briefly, a mold is provided having an internal shape corresponding with the desired shape of the paver piece or the substrate. Generally the mold comprises first and second halves. The mold is clamped to an injection molding machine under pressure for the injection and cooling process. Pelletized resins of rubber and plastic (e.g. HDPE) are fed into the injection molding machine and heated to a melting point. Additives may be fed into the machine at or around the time the pelletized resins are fed into the machine. The melted resin (with additives if used) is injected into the mold. Injection may be via, for example, a screw or ramming device. A dwelling phase follows injection. During the dwelling phase, the molten resins are contained within the mold and pressure is applied to all of the cavities within the mold. Pressure may be applied via, for example, hydraulic or mechanical means. After the molten material cools, the mold is opened by separating the two halves of the mold and the molded material is removed. Removal may be done by ejecting the molded material from the mold with ejecting pins.

Using, for example, injection molding, holes may be formed in the substrate or paver pieces to provide for various features as described above.

As stated previously, additives may be added to the process with the palletized resin. Additives may include colorants with UV stabilizers, fluorescent additives, flame retardants, agents to improve coupling strength between the recycled rubber and the plastic, talc, glass, metal, minerals, etc. Thus, for example, the rubber and plastic (or, in some embodiments, only rubber or only plastic) material may be mixed with colorants to provide a wide array of end product colors that resemble brick, stone, concrete, asphalt, or other decorative hues. In another embodiment, the rubber and plastic material may be mixed with UV stabilizers that prevent the decay and visual degradation of the product from its original manufactured state. In another embodiment, the rubber and plastic material is mixed and/or replaced with one or more fluorescent materials and/or phosphorescent pigments to create pavers that act as a light-sink. Here the polymeric composite may contain 1% to 10% by weight fluorescent or phosphorescent materials, and may contain only plastic or a plastic rubber blend. The system provides a solar powered, lit (i.e., glow-in-the dark) walkway system that costs substantially less to install, maintain, and operate than traditional electrically powered lighting systems. While specific reference is made to a rubber and plastic composite polymeric material, such reference is for the purposes of description only. As may be appreciated by one skilled in the art, other lightweight, precisely formable polymeric materials may be used.

Thus, additives to the polymeric material may include, for example, colorants, UV stabilizers, and glow-in-the-dark agents such as a phosphorescent plastics. Generally, additives are added to the injection molding process for the paver pieces. However, coloration and protection against sunlight are less of a concern for the substrates and may not be used during injection molding of the substrates.

In alternative embodiments, the paver pieces and/or substrate may be formed via compression molding, extrusion, or other suitable technique for polymer matrix material.

Figure 27A:
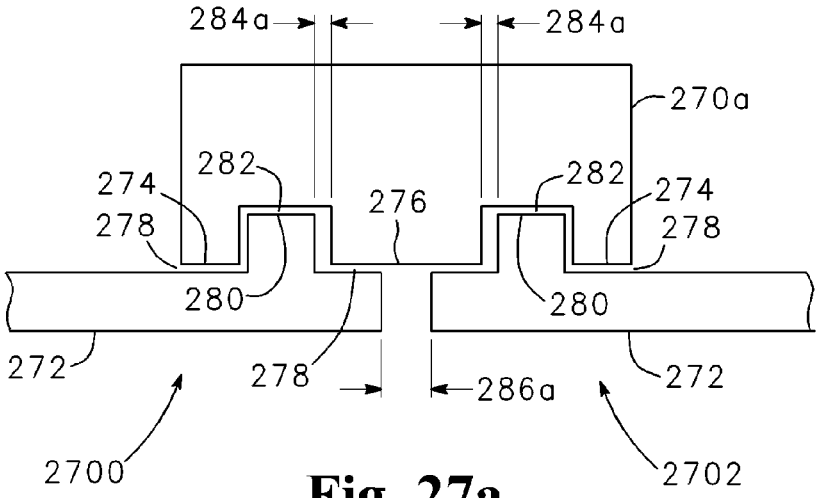
FIG. 27*a* is a side view of one example of a paver piece and grid substrates, the paver piece and grid substrates including a first tolerance between protrusions and recesses.
Figure 27B:
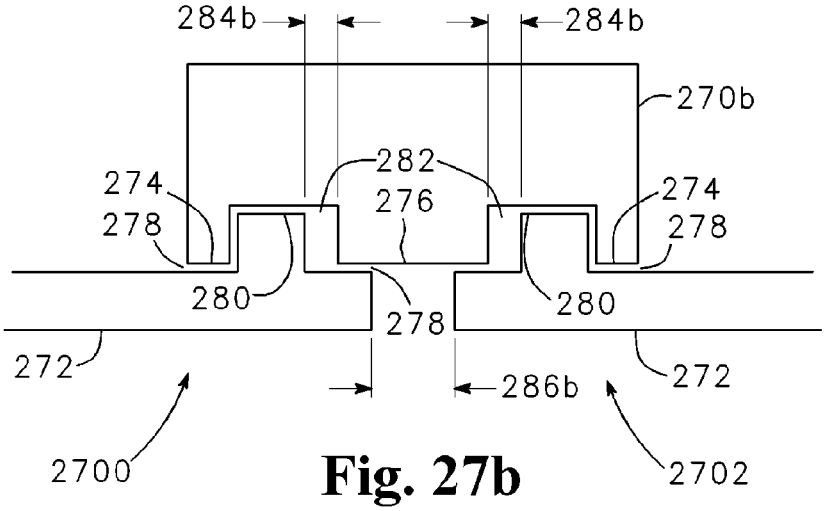
FIG. 27*b* is a side view of another example of a paver piece and grid substrates, the paver piece and grid substrates including a second larger tolerance between protrusions and recesses.
Figure 27C:
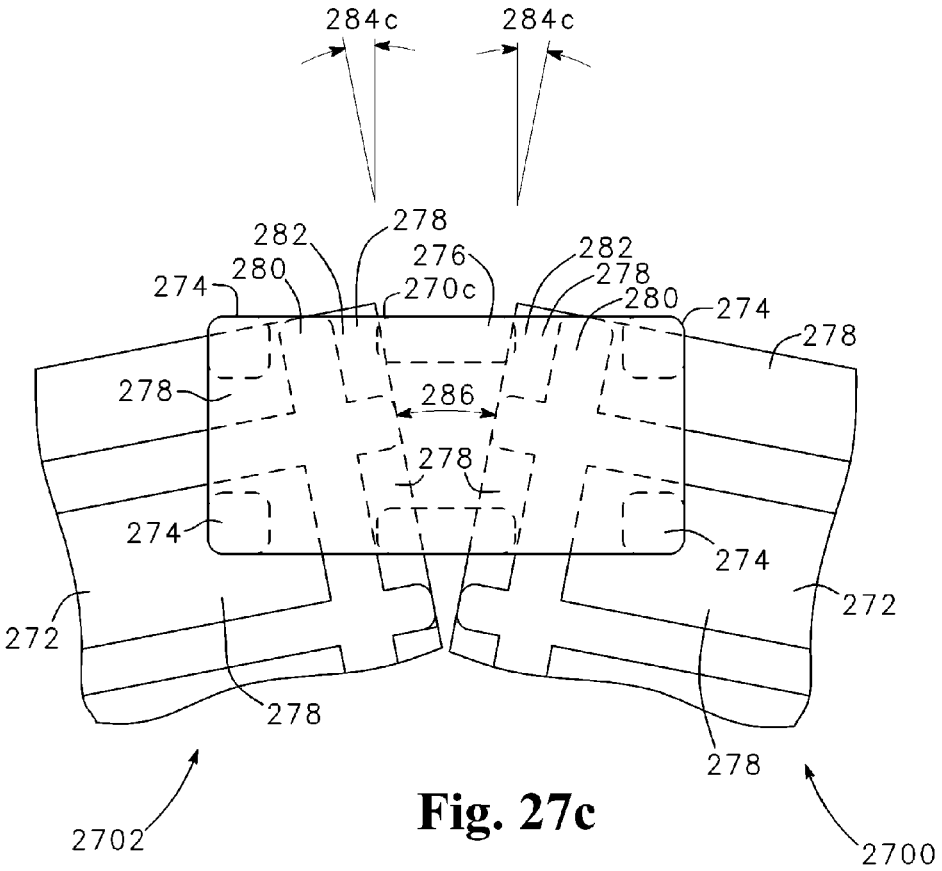
FIG. 27*c* is a top view of yet another example of a paver piece and grid substrates, the paver piece and grid substrates including a rotational tolerance between protrusions and recesses.

FIGS. 27*a*-27*c* show further examples of paver pieces 270*a, b, c*. Paver pieces 270*a, b, c* are similar to the paver pieces previously discussed, and to the extent applicable, the previous description applies hereon. Paver pieces 270*a, b, c* are shown coupled with substrates 272, such as substrate grids shown in FIGS. 8*a*-10*d*. In one example, the paver pieces 270*a, b, c* include paver protrusions 274, 276 sized and shaped for reception within substrate recesses 278. Similarly, the substrates 272 include substrate protrusions 280 sized and shaped for reception in paver recesses 282. As previously described, the paver pieces 270*a, b, c* are fitted with the substrates 272 to provide a paver system 2700 of interlocked paver pieces and substrates. The paver system 2700 extends over a specified area and provides a relatively flat surface.

As shown in FIGS. 27*a*-*c*, the paver pieces 270*a, b, c* and the substrates 272 include tolerances to allow some lateral movement (such as sliding) between the paver pieces 270*a, b, c* and the substrates 272. As further described below, these tolerances allow the paver pieces 270*a, b, c* and substrates 272, when assembled, to form an articulated paver linkage 2702 capable of expansion, compression and curving (e.g., undulation of the linkage into a curved configuration). The paver linkage 2702 includes movable joints at the interfaces between the paver pieces 270*a, b, c,* and substrates 272.

Referring now to FIG. 27*a* the tolerance 284*a* between the substrate protrusions 280 and the paver piece protrusions 274, 276 allows for movement of the paver pieces 270*a*, 270*b* relative to the substrates 272. As shown, the articulated paver linkage is expandable and compressible to fit within specified areas. In the example shown in FIG. 27*a*, the tolerance 284*a* between the protrusions 280 and 274, 276 provides a tolerance between substrates of 286*a*. In one example, the relationship between the tolerances 284*a* and 286*a* may be expressed as:

$$2 \bullet 284a = 286a$$

That is to say, that the tolerance between the protrusions 280, 274, 276 is doubled to arrive at the tolerance 286*a* between substrates 272. As the tolerances between the protrusions is increased the substrates 272 are able to more easily move relative to each other, and similarly adjacent paver pieces 270*a* are able to more easily move relative to each other.

As shown in FIG. 27*b*, the tolerances 284*b* between protrusions 280, 274, 276 are greater and the tolerance 286*b* between substrates 272 is accordingly larger. The articulated paver linkage 2702 of FIG. 27*b* therefore has increased expandability relative to the linkage shown in FIG. 27*a*. The articulated paver linkage 2702 of FIG. 27*b* is thereby able to fit within larger specified areas than the linkage shown in FIG. 27*a* (e.g., the linkage is able to fully span larger specified areas). The tolerances 284*a, b,* 286*a, b* are determined during manufacturing by adjustment of the size of the protrustions 274, 276, 280 (FIGS. 27*a*, *b*). As the protrusion sizes are changed, the tolerances correspondingly change. Similarly as the size of the paver pieces 270*a, b* increase more space is made available to adjust the size of the protrusions and correspondingly adjust the tolerances 284*a, b,* 286*a, b.* For example, the recesses 282 of the paver pieces 270*a, b* are made larger while the protrusions 274, 276, 280 remain the same size to increase the tolerances and facilitate additional range of movement of the paver pieces 270*a, b* and substrates 272. The paver system 2700 is therefore constructed according to the relative tolerances needed. Where it is desirable to have a tightly packed paver system with a small amount of articulation for fitting within a specified area, the tolerances 284*a, b,* 286*a, b* are relatively small and the paver pieces 270*a, b* and substrates 272 are compressible and expandable to a correspondingly small degree. Where increased flexibility is desired the tolerances 284*a, b,* 286*a, b* are relatively large and the paver pieces 270*a, b* and substrates 272 are compressible and expandable to a correspondingly larger degree.

Referring now to FIG. 27*c*, paver piece 270*c* is shown in an angled orientation relative to the substrates 272. When the paver system 2700 is installed in the manner shown, the paver pieces 270*c* and substrates 272 are able to articulate and thereby curve to assume a non-linear orientation for a decorative appearance or to fit within a specified non-linear space. As shown in FIGS. 27*a, b,* the tolerances 284*a, b,* 286*a, b* allow the articulated paver linkage 2702 to expand or contract during installation to fit within specified areas. As shown in FIG. 27*c*, the tolerances 284*a, b,* 286*a, b* also allow the articulated paver linkage 2702 to curve with angular tolerances 284*c,* 286*c*. In a similar manner to the tolerances 284*a, b*, 286*a, b* shown in FIGS. 27*a, b,* the tolerances 284*c,* 286*c* change according to the size of the protrusions 274, 276, 280 and the size of the recesses 278, 282. For example, as the protrusions 274, 276, 280 increase or decrease in size the tolerances 284*c,* 286*c* conversely decrease or increase, respectively. In another example, as the recesses 278, 282 increase or decrease in size the tolerances 284*c,* 286*c* accordingly increase or decrease, respectively. The angular tolerances 284*c,* 286*c* are also a function of the width and length of the paver pieces 270*c* as described further below.

Figure 28:
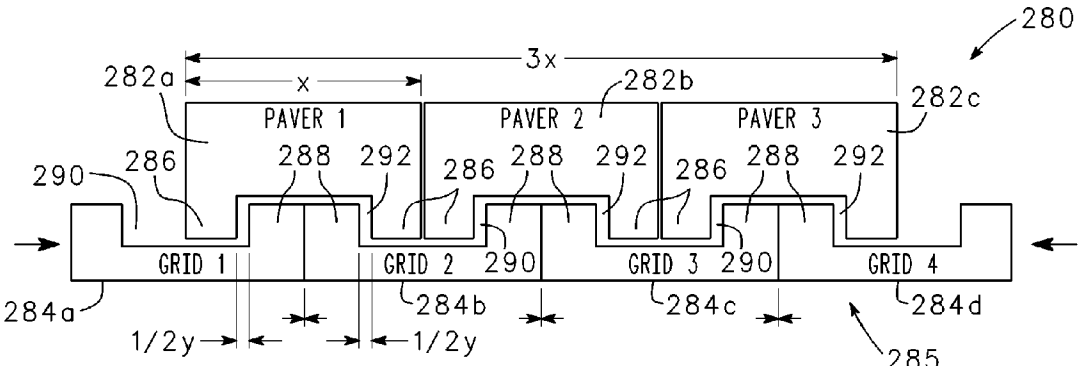
FIG. 28 is a side view of one example of a paver system including an articulated paver linkage in a compressed condition and fit within a specified area.
Figure 29:
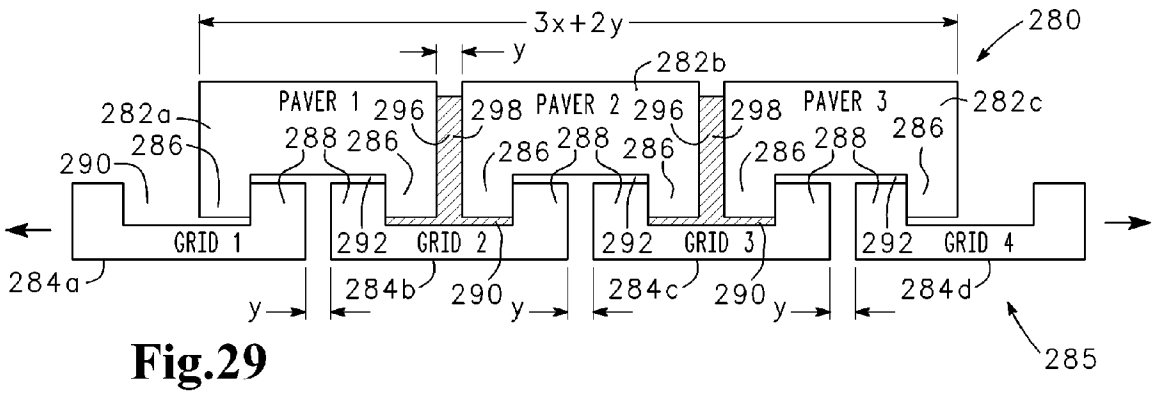
FIG. 29 is a side view of another example of a paver system including an articulated paver linkage in an expanded condition and fit within a specified area.

One example of a paver system 280 is shown in FIGS. 28 and 29. As previously described in other examples, the paver system 280 includes a plurality of paver pieces 282*a, b, c* and substrates 284*a, b, c, d* interlocked into an articulated paver linkage 285. The paver pieces 282*a, b, c* include paver protrusions 286, and the substrates 284*a, b, c, d* include substrate protrusions 288. The protrusions 286, 288 are received within corresponding substrate recesses 290 and paver recesses 292. Optionally, the paver system includes only paver pieces that are interfit in a manner as shown in FIGS. 21*a, b* and 22, where the paver pieces provide the function of the paving surface as well as the substrate. Where sufficient tolerances are provided, the paver pieces in such a consolidated configuration are capable of expansion, contraction and undulation as described herein for paver systems including paver pieces and separate substrates.

As shown in FIG. 28, the paver pieces 282*a, b, c* and substrates 284*a, b, c, d* of the articulated paver linkage 285 are arranged in a compressed state so the linkage 285 is as compact as possible. For instance, the paver pieces 282*a, b, c* have a composite length of 3×, where x is the length of one of the paver pieces, as shown in FIG. 28. While the articulated paver linkage 285 is compressed, the paver system 280 may be fit within smaller specified areas that would otherwise be unable to easily receive other unlinked pavers without substantial additional labor (e.g., pavers on a bed of sand for example). For instance, the compressed paver system 282 is fit between the specified borders of a sidewalk bed, patio bed and the like. Tolerances 294 are shown between the paver protrusions 286 and the substrate protrusions 288. As discussed above, the tolerances 294 allow for the articulated paver linkage 285 to compress, expand and undulate (e.g., assume curved configurations). In FIG. 28, the paver linkage 285 is in a compressed state, and the tolerances 294 are shown as the quantity ½y. The tolerances are found on either side of the substrate protrusions 288, and allow the substrates 284*a, b, c, d* and paver pieces 282*a, b, c* to form gaps 296 therebetween having lengths of approximately the quantity y, as shown in FIG. 29. The tolerances 294 are adjustable (e.g., by increasing or decreasing the size of recesses and protrusions) to achieve a desired flexibility of the articulated paver linkage 285.

As shown in FIG. 29, the paver system 280 is in an expanded state. The paver system 280 is expanded where the installed paver pieces may not exactly fill a specified area as desired by the installer. The articulated paver linkage 285 has been pulled, for instance at substrate 284*a* or 284*d*. The pulling forces have been transmitted along the linkage 285 to each of the paver pieces 282*a, b, c* and the remaining substrates. In another example, one of the paver pieces 282*a, b, c* is pulled to expand the linkage. As the linkage 285 is pulled the substrate protrusions 292 engage with the paver protrusions 286 to transmit the pulling forces along the entire linkage 285.

Because the tolerances 294 of the paver system 280 shown in FIGS. 28 and 29 are substantially similar throughout the paver system, when the linkage 285 is expanded gaps 296 between paver pieces 282*a, b, c* are substantially the same size. Having gaps 296 nearly the same size through operation of the linkage 285 provides a consistency and aesthetic appeal in installation that is hard to achieve without difficult and time-consuming labor with previous pavers. That is to say, an installer can pull on one end of the paver system 280 and the articulated paver linkage 285 ensures the paver pieces 282*a, b, c* are equidistantly spaced from each other throughout the paver system. Further, expanding the paver system 100 within a specified area allows the paver system to fill the entire specified area without laboriously having to move individual pavers (e.g., retapping) or cut pavers to fit within additional space.

As shown in FIG. 29, the gaps 296 have a length of the quantity y which is a function of the tolerances 294 (½y described in FIG. 28 above). The example paver system 280 shown in FIG. 29 has an expanded length of 3×+2y as opposed to the length 3× in the compressed state shown in FIG. 28. In this way, the paver system 280 is movable between the compressed and expanded states to have a length anywhere between 3× and 3×+2y. Adjustments are made to the paver system 280 by alternately pushing and pulling on portions of the articulated paver linkage 285 (e.g., the paver pieces 282*a, b, c* and the substrates 284*a, b, c, d*) to achieve a desired fit within a specified area. One or more of the paver pieces 282*a, b, c,* and substrates 284*a, b, c, d* is pulled or pushed and the pulling or pushing force is transmitted along the linkage to the intervening links, in other words, one or more of the paver pieces 282*a, b, c,* and substrates 284*a, b, c, d* are correspondingly moved according to the forces applied to adjacent paver pieces and substrates. Each of the paver pieces 282*a, b, c,* and substrates 284*a, b, c, d* acts in a way like the links of a chain, transmitting forces along the length of the articulated paver linkage 285 and also allowing some degree of lateral movement of the pieces and substrates.

Once the paver system 100 is oriented as desired, the gaps 296 are filled with a filling material 298, such as sand. Filling the gaps 296 holds the paver pieces 282*a, b, c* on the substrates 284*a, b, c, d* in the expanded position and locks them in place.

As previously discussed, tolerances may be increased to change the flexibility of the system. For example, in FIGS. 28 and 29, as the tolerances 294 are increased the gaps 296 between the paver pieces 282*a, b, c* in the expanded condition are also increased. Similarly, the gaps 296 remain substantially equidistant between paver pieces 282*a, b, c* as the tolerances 294 remain substantially the same between the paver pieces and the substrates 284*a, b, c, d*. In another example, various paver pieces or substrates are available having a variety of configurations, and when installed the paver pieces and substrates have a variety of tolerances therebetween. An installer may then choose various paver pieces and substrates to achieve a desired tolerance of the paver system.

Figure 30:
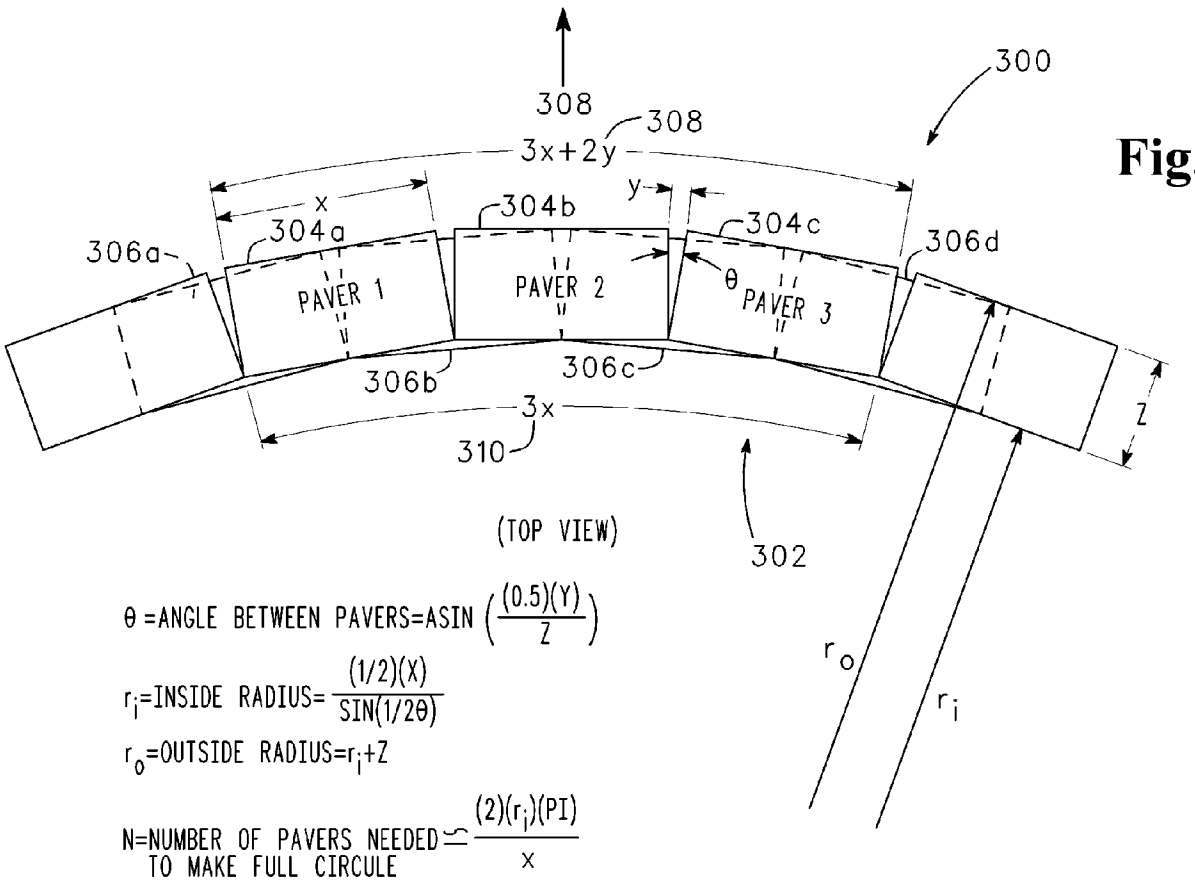
FIG. 30 is a top view of yet another example of a paver system including an articulated paver linkage in an undulated condition within a specified non-linear area.

FIG. 30 shows another example of a paver system 300 in the form of an articulated paver linkage 302 having interlocked paver pieces 304*a, b, c* and substrates 306*a, b, c, d*. The paver pieces and substrates are interlocked with tolerances as previously discussed above. As shown in FIG. 30, the articulated paver linkage 302 is in an undulated (e.g., curved) state, for example, where the linkage has been aligned with a non-linear portion of a specified area, such as a curved sidewalk bed, patio and the like. The tolerances between the paver pieces 304*a, b, c* and substrates 306*a, b, c, d* allow the linkage 302 to assume a linear compressed state having a length of 3×, expanded state having a length of 3×+2y or any length therebetween. Similarly to the paver piece 270*c* and substrates 272 of FIG. 27*c*, the paver pieces 304*a, b, c* and substrates 306*a, b, c, d* of FIG. 30 are able to rotate relative to adjacent pieces and substrates with the tolerances discussed above. In one example, the paver system 300 is assembled in a linear manner and subsequently deflected outward (i.e., along arrow 308) into an undulated orientation. In another example, the undulated orientation includes at least one curve that aligns with a non-linear portion of a specified area. For instance, the specified area includes a non-linear border and the articulated paver linkage 302 is pushed into engagement with the non-linear border and thereby assumes a corresponding orientation to the non-linear border. In yet another example, the paver system 300 includes multiple undulations (e.g., curves) that provide a decorative wave-like appearance. In still another example, the paver system 300 is wrapped around with circular or semi-circular orientation, such as for a patio.

Referring again to FIG. 30, the articulated paver linkage 302 is undulated into the orientation shown, where an outer perimeter 308 of the linkage has a length of 3×+2y, and the inner perimeter 310 has a length of 3×, where x is the length of a paver, and y is the gap available between the paver pieces 304*a, b, c* in the expanded condition. As discussed above, it may be desirable to form the paver linkage 302 into a circular or semi-circular configuration. By measuring or determining the angle θ between the paver pieces 304*a, b, c* the number of paver pieces needed to form a full or partial circle is determined with the equations provided below:

$$\theta = a\sin\left(\frac{1/2 \cdot y}{z}\right)$$

-continued $$r_i = \frac{(1/2)\cdot x}{\sin(\theta/2)}$$

$$r_o = r_i + z$$

$$N \approx \frac{2\pi \cdot r_i}{x}$$

Where z is the width of the paver pieces 304*a, b, c;* $r_i$ and $r_O$ are the inner and outer radii of the arcuately oriented paver linkage 302; and N is the approximate number of paver pieces needed.

Figure 31:
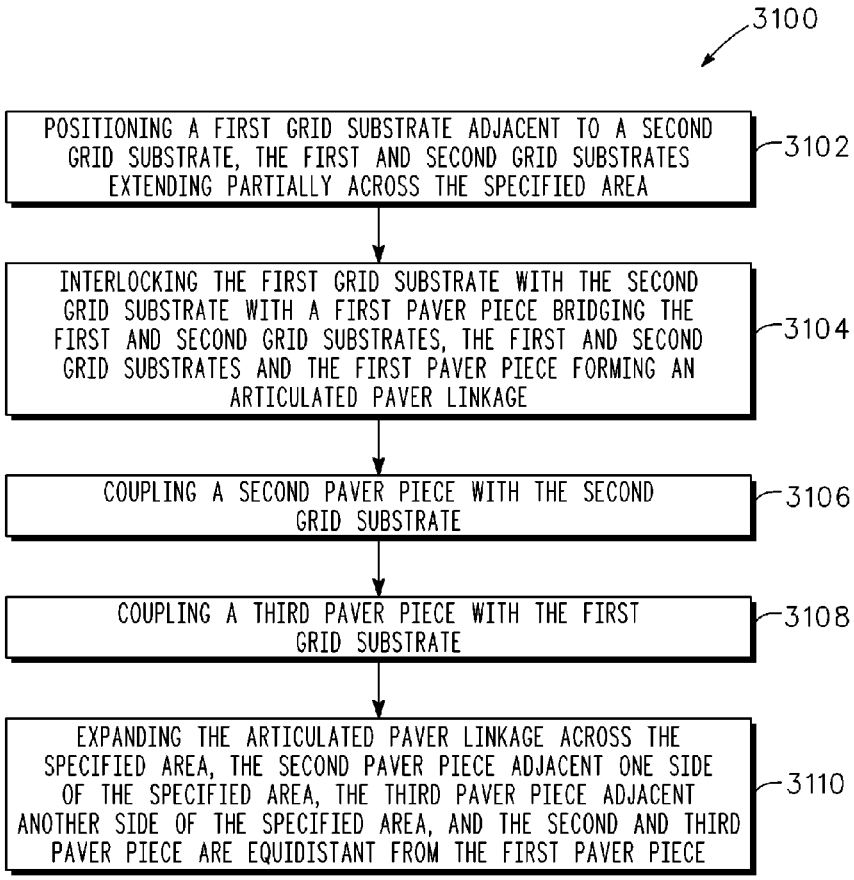
FIG. 31 is a block diagram showing one example of a method of installing a paver system in an expanded condition to fit within a specified area.

A method 3100 for installing a paver system (e.g., paver systems shown in FIGS. 1-30) within a specified area is shown in FIG. 31. Reference is made to example elements previously described in FIGS. 1-30 with regard to method 3100, and these Figures and elements therein are included in the discussion of the method. For convenience only elements from FIGS. 28 and 29 will be discussed with specific element numbers. At 3102, a first grid substrate 284*a, b, c, d* is positioned adjacent to a second grid substrate 284*a, b, c, d* (one of the other substrates), the first and second grid substrates extending partially across the specified area (e.g., a sidewalk bed, road bed, patio bed and the like). At 3104, the first grid substrate 284*a, b, c, d* is interlocked with the second grid substrate 284*a, b, c, d* by a first paver piece 282*a, b, c* bridging the first and second grid substrates. For example, a first paver portion (e.g., protrusion 286) of the first paver piece is received by the first grid substrate (e.g., recess 290) with a first moving tolerance (e.g. 294) between the first paver portion and the first grid substrate. A second paver portion (e.g., protrusion 286 at another end of the paver piece) of the first paver piece 282*a, b, c* is received by the second grid substrate 284*a, b, c, d* with a second moving tolerance 294 between the second paver portion and the second grid substrate, the first and second grid substrates 284*a, b, c, d* and the first paver piece 282*a, b, c* forming an articulated paver linkage 285. At 3106 a second paver piece (e.g., another of paver pieces 282*a, b, c*) is coupled with the second grid substrate (e.g. another one of substrates 284*a, b, c, d*). At 3108 a third paver piece (e.g., one of 282*a, b, c*) is coupled with the first grid substrate (e.g. one of 284*a, b, c, d*). In other examples, a plurality of additional paver pieces and substrates are coupled together to form a complete paving surface and are acted upon in substantially the same way as discussed for method 3100.

At 3110 the articulated paver linkage 285 is expanded across the specified area to substantially reach across the specified area (e.g., where the paver system 280 is too short to do so in a compressed state). In one example, where there is a gap between one of the paver pieces 282*a, b, c* at the ends of the paver linkage 285 and the border of a specified area, expanding the linkage fills the gap and allows the paver system 280 to conveniently cover the entire specified area. As previously described, pulling on one of the paver pieces 282*a, b, c* or one of the grid substrates 284*a, b, c, d* transmits pulling forces along the linkage 285 between the paver pieces and the grid substrates to expand the paver system in a single motion across the specified area. Because of the interrelation between the paver pieces 282*a, b, c* and the grid substrates 284*a, b, c, d* the gaps 296 between the paver pieces 282*a, b, c* are substantially the same when the tolerances 294 are substantially the same thereby creating a consistent aesthetic paving surface. That is to say the second paver piece is adjacent one side of the specified area, the third paver piece is adjacent another side of the specified area, and the second and third paver pieces are equidistant from the first paver piece where the first moving tolerance 294 is substantially identical to the second moving tolerance 294.

Several options for the method 3100 follow. In one example, coupling the second paver piece (e.g. 282*a*) and coupling the third paver piece (e.g. 282*c*) further comprises coupling at least a fourth paver piece with the second grid substrate (e.g. 284*d*) and coupling a fifth paver piece with the first grid substrate (e.g., 284*a*), at least some of the first through fifth paver pieces arranged on the first and second grid substrates in a decorative pattern (see for example, FIG. 8*c*). In another example, inserting the first protrusion 286 of the first paver piece within the first recess 290 of the first grid substrate includes inserting the first protrusion within the first recess, the first recess larger than the first protrusion by the first moving tolerance 294, the first protrusion slidable within the first recess.

In another example, expanding the articulated paver linkage 285 includes pulling on the second paver piece (e.g., 282*a*), transmitting pulling forces from the second paver piece to the second grid substrate (e.g., 284*b*), transmitting pulling forces from the second grid substrate to the first paver piece (e.g., 282*b*), and transmitting pulling forces from the first paver piece to the first grid substrate (e.g., 284*c*). Optionally, one of the grid substrates 284*a, b, c, d* is pulled and the pulling force is transmitted along the paver linkage 285 in a similar manner.

In yet another example, the method 3100 includes filling the gaps 296 with a material (e.g. material 298, such as sand, grout and the like) and locking the first, second and third paver pieces 282*a, b, c,* relative to each other and the first and second grid substrates 284*a, b, c, d.*

In still another example, the method 3100 includes positioning a third grid substrate 3502C adjacent the first grid substrate 3502*a*, the first and third grid substrates extending partially across a specified width of the specified area. The method 3100 further includes in another example interlocking the first grid substrate 3502*a* with the third grid substrate 3502*c* with a fourth paver piece 3504*b* bridging the first and third grid substrates, the first and third grid substrates and the fourth paver piece forming an articulated paver linkage second portion 3508*b,* the first and second grid substrates 3502*a, b* and the first paver piece 3504*a* forming an articulated paver linkage first portion 3508*a*. The articulated paver linkage second portion 3508*b* is then expanded across the specified width to fit the specified width. Optionally, the articulated paver linkage second portion 3508*b* is selectively compressed or expanded to fit within the specified width.

Figure 32:
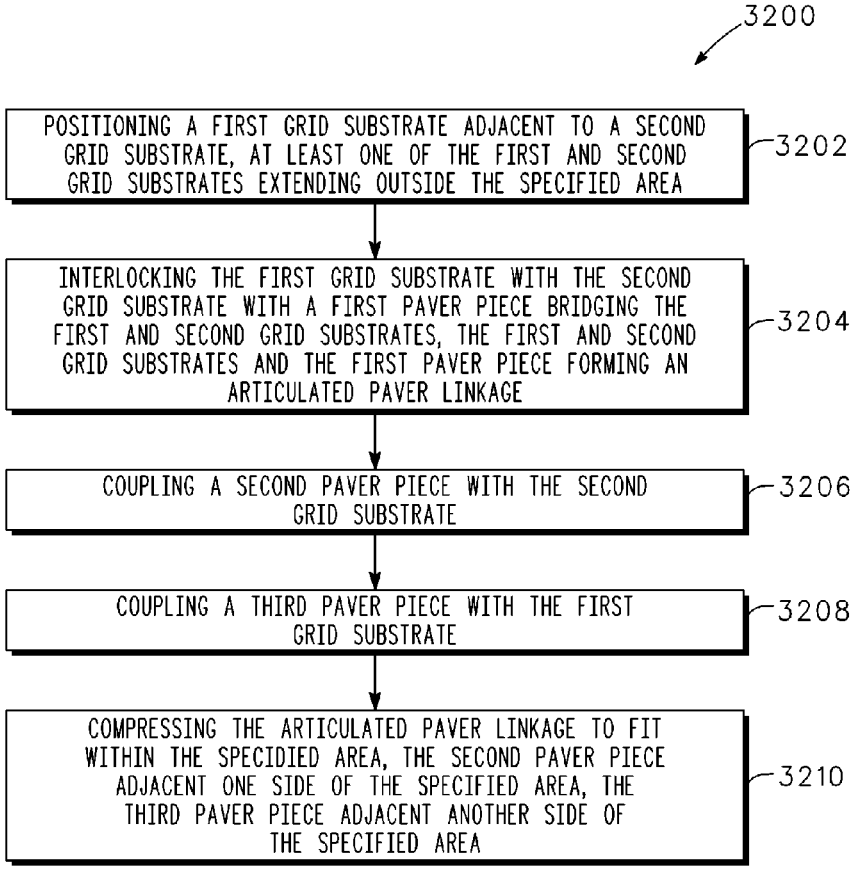
FIG. 32 is a block diagram showing one example of a method of installing a paver system in a compressed condition to fit within a specified area.

Referring now to FIG. 32, a method 3200 is shown for installing a paver system (e.g., paver systems shown in FIGS. 1-30) within a specified area. As with the description for method 3100, reference is made to example elements previously described in FIGS. 1-30, and these Figures and elements therein are included in the discussion of the method 3200. For convenience only elements from FIGS. 28 and 29 will be discussed with specific element numbers. At 3202 a first grid substrate (e.g. 284*b*) is positioned adjacent to a second grid substrate (e.g., 284*c*), at least one of the first and second grid substrates extending outside the specified area. At 3204, the first grid substrate 284*b* is interlocked with the second grid substrate 284*c* with a first paver piece (e.g., 282*b*) bridging the first and second grid substrates. A first paver portion, such as protrusion 286 of the first paver piece 282*b* is received by the first grid substrate 284*b* with a first moving tolerance between the first paver portion and the first grid substrate, for instance tolerance 294. A second paver portion, such as protrusion 286, at another portion of the first paver piece 282*b* is received by the second grid substrate 284*c* with a second moving tolerance 294 between the second paver portion and the second grid substrate. When interlocked, the first and second grid substrates 284*b, c* and the first paver piece 282*b* form an articulated paver linkage 285. As shown in FIGS. 28 and 29, multiple paver pieces 282*a, b, c* and substrates 284*a, b, c, d* are used to form the paver linkage 285. As previously discussed, additional pieces and substrates are used to form a full paving surface as part of the articulated paver linkage 285. At 3206, a second paver piece 282*c* is coupled with the second grid substrate 284*c*. At 3208, a third paver piece 282*a* is coupled with the first grid substrate 284*b*.

At 3210, the articulated paver linkage 285 is compressed to fit within the specified area (e.g., where the paver system 280, in an expanded state, is too long to fit within a specified length of a specified area). For example, the paver system 280 is compressed from the expanded configuration shown in FIG. 29 to the compressed configuration shown in FIG. 28. In one example, the second paver piece 282*c* is adjacent one side of the specified area, the third paver piece 282*a* is adjacent another side of the specified area and thereby fit within the specified area. Optionally, where gaps 296 remain between the paver pieces 282*a, b, c,* the second and third paver pieces 282*c, a* are equidistant from the first paver piece 292*b* where the first moving tolerance 294 is substantially identical to the second moving tolerance 294. In another example, some slight positional adjustment between the paver pieces is necessary to form the equidistant gaps.

Several options for the method 3200 follow. In one example, coupling the second paver piece and coupling the third paver piece includes coupling at least a fourth paver piece with the second grid substrate and coupling a fifth paver piece with the first grid substrate, at least some of the first through fifth paver pieces arranged on the first and second grid substrates in a decorative pattern (see for example FIG. 8*c*). In another example, interlocking the first grid substrate 284*b* with the second grid substrate 284*c* includes inserting a first protrusion (e.g., 286, 288) of at least one of the first paver piece 282*b* and the first grid substrate 284*b* within a first recess (e.g., 290, 292) of the other of at least one of the first grid substrate and the first paver piece and inserting a second protrusion (e.g., 286, 288) of at least one of the first paver piece and the second grid substrate 284*c* within a second recess (e.g., 290, 292) of the other of the at least one of the first paver piece and the second grid substrate. Optionally, inserting the first protrusion within the first recess includes inserting the first protrusion within the first recess, the first recess larger than the first protrusion by the first moving tolerance 294, the first protrusion slidable within the first recess.

In another example, the method 3200 further includes pushing on the second paver piece 282*c*, transmitting pushing forces from the second paver piece to at least one of the second grid substrate 284*c* or the first paver piece 282*b*, transmitting pushing forces from the second grid substrate to at least one of the first paver piece 282*b* and the first grid substrate 284*b*, and transmitting pushing forces from the first paver piece to the first grid substrate 284*b*. Optionally, the pushing forces are transmitted between adjacent paver pieces to the grid substrates as the paver pieces slide over the grid substrates. In another option, one of the grid substrates 284*a, b, c, d* is pulled and the pulling force is transmitted along the paver linkage 285 in a similar manner.

In yet another example, the method 3200 further includes minimizing gaps 296 between the first and second paver pieces (e.g., 282*b, c*) and the first and third paver pieces (e.g., 282*b, a*), and the gaps have substantially similar sizes where the first moving tolerance 294 is substantially identical to the second moving tolerance 294. Optionally, the method 3200 further includes filling the gaps 296 with a filling material 298 (such as sand, grout and the like) and locking the first, second and third paver pieces relative to each other and the first and second grid substrates.

In still another example, the method 3200 includes compressing the articulated paver linkage 3606 to a compressed length corresponding to a specified area length, the articulated paver linkage having an expanded length greater than the specified area length. In another example, the method 3200 includes compressing the articulated paver linkage 3606 to a compressed width corresponding to a specified area width 3614*b*, the articulated paver linkage having an expanded width greater than the specified area width. Optionally, the method 3200 includes aligning the articulated paver linkage 3816 with a vertical non-linear portion of the specified area 3814,3815, the articulated paver linkage assuming a substantially identical vertical geometry to the vertical non-linear portion with the first, second and third paver pieces (e.g., 3802*a, b, c, d*) aligned along the non-linear portion. In yet another example, the method 3200 includes vertically undulating the articulated paver linkage 3816 along the vertical non-linear portion 3814, 3815, the articulated paver linkage vertically undulated into substantial alignment with the non-linear portion.

Figure 33:
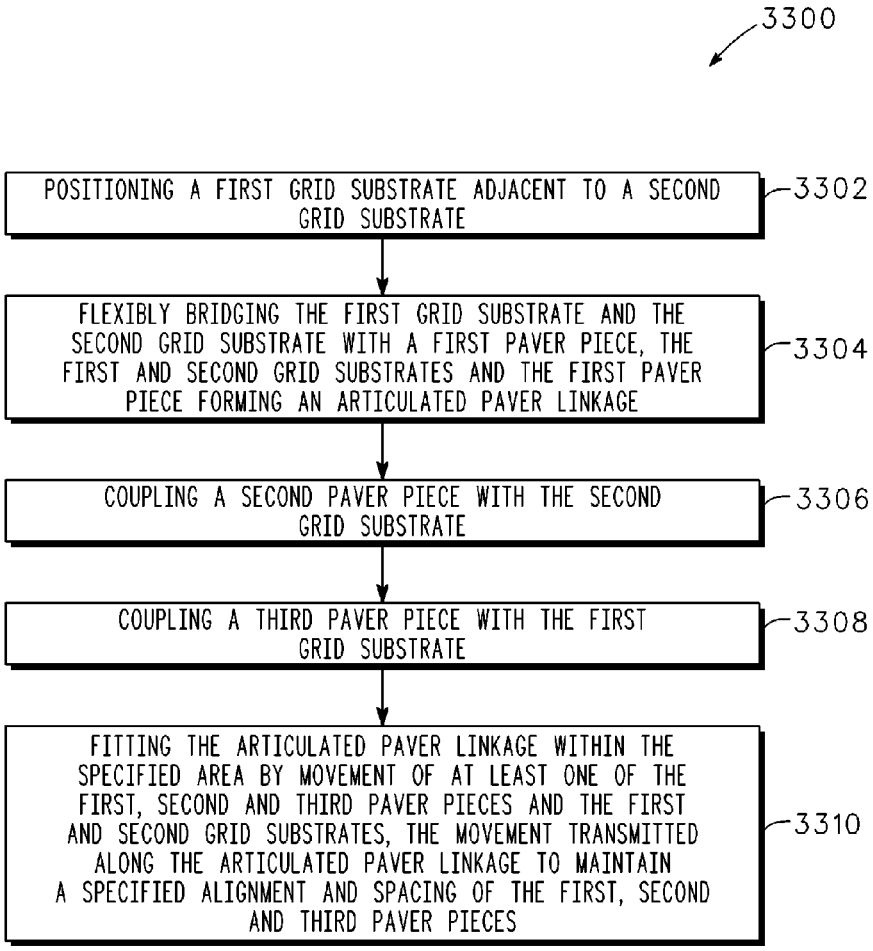
FIG. 33 is a block diagram showing one example of a method of installing a paver system within a specified area.

Referring now to FIG. 33, another example of a method 3300 for installing a paver system (such as the paver systems disclosed in FIGS. 1-30) is shown. As with the description for previous methods, reference is made to example elements previously described in FIGS. 1-30, and these Figures and elements therein are included in the discussion of the method 3300. For convenience only elements from FIGS. 28 and 29 will be discussed with specific element numbers. At 3302 a first grid substrate (e.g., 284*b*) is positioned adjacent to a second grid substrate (e.g., 284*c*). At 3304 the first grid substrate and the second grid substrate are flexibly bridged with a first paver piece 282*b*. In one example, a first paver portion 286 of the first paver piece 282*b* is movably coupled with the first grid substrate 284*b* at a first paver joint (e.g., the movable interface between the paver piece and the substrate), and a second paver portion, such as 286 at another portion of the first paver piece is movably coupled with the second grid substrate 284*c* at a second paver joint (e.g., another similar interface), the first and second grid substrates and the first paver piece forming an articulated paver linkage 285. At 3306, a second paver piece 282*c* is coupled with the second grid substrate 284*c*. At 3308 a third paver piece 282*a* is coupled with the with the first grid substrate 284*b*. Optionally, a plurality of paver pieces and grid substrates are used to form the paver system 280 and articulated paver linkage 285.

At 3310, the articulated paver linkage 285 is fit within the specified area by movement of at least one of the first, second and third paver pieces (e.g., 282*a, b, c*) and the first and second grid substrates (e.g., 284*b, c*). The movement is transmitted along the articulated paver linkage 285 to maintain a specified alignment and spacing of the first, second and third paver pieces. For instance, the tolerances 294 between interlocking portions (e.g., protrusions) of the paver pieces 282*a, b, c* and the grid substrates 284*b, c,* are used to maintain the specified alignment and spacing of the paver pieces.

Several options for the method 3300 follow. In one example, coupling the second paver piece and coupling the third paver piece further comprises coupling at least a fourth paver piece with the second grid substrate and coupling a fifth paver piece with the first grid substrate, at least some of the first through fifth paver pieces arranged on the first and second grid substrates in a decorative pattern. For instance, see FIG. 8*c*. In another example, fitting the articulated paver linkage 285 within the specified area includes positioning the second paver piece 282*c* adjacent one side of the specified area, and positioning the third paver piece 282*a* adjacent another side of the specified area, and positioning of the second and third paver pieces transmits movement along the articulated paver linkage 285 and spaces the first paver piece 282*b* equidistantly from the second and third paver pieces 282*c, a*.

In another example, flexibly bridging the first grid substrate 284*b* and the second grid substrate 284*c* includes rotatably and slidably coupling the first and second grid substrates and the first paver piece 282*b* at the first and second paver joints. See, for example, FIGS. 27*a, b, c* and 28-30 where interfaces between the paver pieces and grid substrates are shown including, for instance, the interfitting of protrusions in recesses to form movable joints. In yet another example, fitting the articulated paver linkage 285 within the specified area includes at least one of rotating and sliding the first paver portion (e.g., protrusion 286) and the second paver portion (e.g., protrusion 286) at the first paver joint and the second paver joint relative to the first and second grid substrates 284*b, c* (see FIGS. 27*c* and 30). In still another example, fitting the articulated paver linkage 285 within the specified area includes expanding the articulated paver linkage at the first and second paver joints with sliding movement between the first paver piece and the first and second grid substrates (see FIGS. 27*a, b,* 28 and 29). In one option, fitting the articulated paver linkage 285 within the specified area includes compressing the articulated paver linkage at the first and second paver joints with sliding movement between the first paver piece 282*b* and the first and second grid substrates 284*b, c*. In another option, fitting the articulated paver linkage 285 within the specified area includes aligning the articulated paver linkage along a non-linear specified area by rotation of at least one of the first and second grid substrates 284*b*, relative to the first paver piece 282*b* at the first and second paver joints.

In yet another example, the method 3300 further includes positioning a third grid substrate 3502*c* adjacent the first grid substrate 3502*a*, the first and third grid substrates extending partially across a specified width of the specified area, a first and third grid orientation at least partially transverse (e.g., along arrow 3510*b*) to a first and second grid orientation (e.g., along arrow 3510*a*). The first grid substrate 3502*a* is interlocked with the third grid substrate 3502*c* with a fourth paver piece 3504*b* bridging the first and third grid substrates, the first and third grid substrates and the fourth paver piece forming an articulated paver linkage second portion 3508*b*, the first and second grid substrates 3502*a, b* and the first paver piece 3504*a* forming an articulated paver linkage first portion 3508*a*. The method 3300 includes, in another example, selectively fitting the articulated paver linkage first portion 3508*a* and the articulated paver linkage second portion 3508*b* across the specified area and the specified width. In still another example, selectively fitting the articulated paver linkage first portion 3508*a* and the articulated paver linkage second portion 3508*b* across the specified area and the specified width includes at least one of selectively expanding or compressing the articulated paver linkage first portion 3508*a* to fit within the specified area, and at least one of selectively expanding or compressing the articulated paver linkage second portion 3508*b* to fit within the specified width. Wherein selectively expanding or compressing the articulated paver linkage second portion 3508*b* is in a second dimension (e.g., 3510*b*) at least partially transverse to expansion or compression of the articulated paver linkage first portion 3508*a* (e.g., along 3510*a*). Optionally, selectively fitting the articulated paver linkage first portion 3508*a* and the articulated paver linkage second portion 3508*b* across the specified area and the specified width includes selectively fitting the articulated paver linkage first portion and the articulated paver linkage second portion across a specified area with non-parallel opposed borders, such as sides 3614*a, b* and 3616*a, b* shown in FIG. 37.

Figure 34:
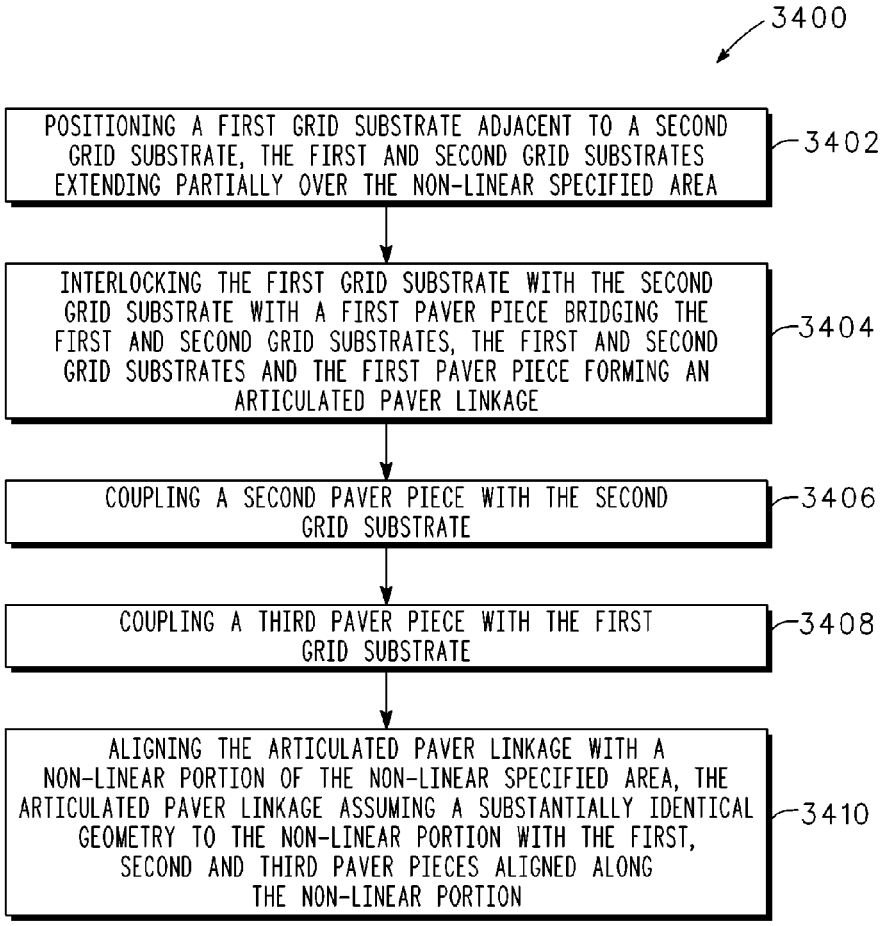
FIG. 34 is a block diagram showing one example of a method of installing a paver system in an undulated condition to within a specified non-linear area.

A method 3400 for installing a paver system (such as the paver systems shown in FIGS. 1-30) within a non-linear specified area is shown in FIG. 34. As with the description for previous methods, reference is made to example elements previously described in FIGS. 1-30, and these Figures and elements therein are included in the discussion of the method 3400. For convenience only elements from FIGS. 28-30 will be discussed with specific element numbers. At 3402 a first grid substrate 284*b* is positioned adjacent to a second grid substrate 284*c*, the first and second grid substrates extend at least partially over the non-linear specified area (e.g., a curved sidewalk bed, patio bed, road bed and the like). At 3404 the first grid substrate 284*b* is interlocked with the second grid substrate 284*c* with a first paver piece 282*b* bridging the first and second grid substrates. A first paver portion (e.g., protrusion 286) of the first paver piece 282*b* is movably received by the first grid substrate (e.g., recess 290), and a second paver portion (e.g., another protrusion 286) of the first paver piece is movably received by the second grid substrate 284*c*. The first and second grid substrates and the first paver piece thereby form an articulated paver linkage 285. At 3406 a second paver piece 282*c* is coupled with the second grid substrate 284*c*. At 3408 a third paver 282*a* piece is coupled with the first grid substrate 284*a*.

At 3408 the articulated paver linkage 285 is aligned with a non-linear portion of the non-linear specified area (including, but not limited to a non-linear border of a sidewalk bed, patio or road, or a desired decorative curve of a pattern of paver pieces). The articulated paver linkage 285 assumes a substantially identical geometry to the non-linear portion with the first, second and third paver pieces 282*a, b, c* aligned along the non-linear portion (see, for instance FIGS. 30 and 27*c*). In one example, the articulated paver linkage 285 is deflected from a linear orientation, such as that shown in FIGS. 28 and 29, into the curved orientation shown in FIG. 30 to align the linkage with the non-linear portion of the specified area.

Several options for the method 3400 follow. In one example, interlocking the first grid substrate 284*b* with the second grid substrate 284*c* with the first paver piece 282*b* includes movably receiving the first paver portion of the first paver piece with the first grid substrate with a first moving tolerance 296 between the first paver portion and the first grid substrate, such as protrusions 286 and protrusions 288. The second paver portion of the first paver piece is movably received within the second grid substrate with a second moving tolerance 296 between the first paver portion and the first grid substrate.

In another example, aligning the articulated paver linkage 285 with the non-linear portion of the non-linear specified area includes assuming a substantially identical geometry to the non-linear portion with the first, second and third paver pieces 282*a, b, c* aligned along the non-linear portion, and the second and third paver pieces 282*c*, a are substantially equidistant from the first paver piece 282*b* where the first and second moving tolerances 296 are substantially identical. Optionally, aligning the articulated paver linkage 285 with the non-linear portion of the non-linear specified area includes undulating the articulated paver linkage 285 along the non-linear portion, the articulated paver linkage undulated into substantial alignment with the non-linear portion.

In still another example, interlocking the first grid substrate 284*b* with the second grid substrate 284*c* includes inserting a first protrusion 286 of the first paver piece 282*b* within a first recess 290 of the first grid substrate 284*b* and inserting a second protrusion 286 of the first paver piece within a second recess 290 of the second grid substrate 284*c*. Optionally, at least one of the first and second recesses 290 is larger than one or both of the first and second protrusions 286. The recesses 290, in one example, are larger by an amount substantially equivalent to the tolerance 294, and the protrusions 286 are thereby rotatable and slidable within the recesses 290.

In yet another example, aligning the articulated paver linkage 3606 with the non-linear portion of the non-linear specified area includes vertically undulating the articulated paver linkage 3606 along the non-linear portion 3814, 3815, the articulated paver linkage vertically undulated into substantial alignment with the non-linear portion.

Figure 35:
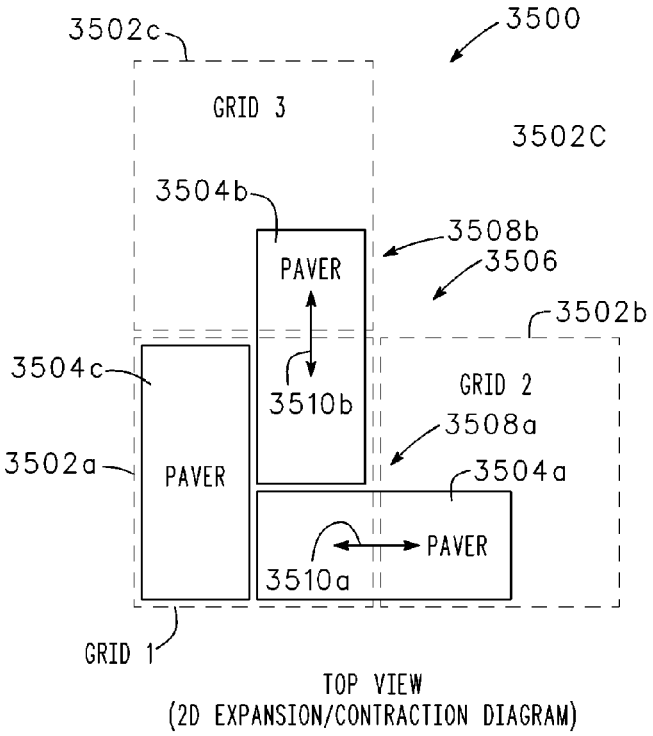
FIG. 35 is a top view of still another example of a paver system showing an articulated paver linkage with first and second portions, the first portion extending at least partially transversely relative to the second portion.

Another example of a paver system 3500 is shown in FIG. 35. Paver system 3500 includes at least first, second, and third substrates 3502*a, b, c*. A first paver piece 3504*a* bridges across grid substrates 3502*a, b*. As previously described in other examples, the paver piece 3504*a* and substrate 3502*a* and 3502*b* are movable relative to each other. For instance, grid substrate 3502*b* is movable relative to grid substrate 3502*a* according to the tolerances between the paver piece 3504*a* and the grid substrates 3502*a, b*. A second paver piece 3504*b* is coupled between grid substrate 3502*a* and 3502*c*. Grid substrate 3502*a, c* and paver piece 3504*b* are moveable relative to each other according to the tolerances between the grid substrate 3502*a, c* and the paver piece 3504*b*. As shown in FIG. 35 by the arrows 3510*a, b* over the paver piece 3504*a, b*, the grid substrates 3502*a, b, c* and paver pieces 3504*a, b* are movable according to how the paver pieces 3504*a, b* are bridged between the grid substrates 3502*a, b, c* (further described below).

Referring again to FIG. 35, a third paver piece 3504*c* is shown coupled with the grid substrate 3502*a*. As shown in FIG. 35, the paver piece 3504*c* is not bridged to cross the grid substrate 3502*a, b, c*. In another example, paver piece 3504*c* is bridged across at least one of the grid substrates 3502*a, b, c*. In still other examples, additional paver piece are bridged across a plurality of grid substrates including, but not limited to, grid substrates 3502*a, b, c*. For instance, a plurality of grid substrates positioned over a specified area to cover the entire specified area the grid substrates sized and shaped to receive multiple paver pieces sufficient to cover the grid substrates and thereby cover the specified area.

As previously shown in FIGS. 28 and 29, the paver pieces 282*a, b, c* and grid substrates 284*a, b, c, d* include projections 286, 288, and corresponding recesses 290, 292. The projections 286, 288, and recesses 290, 292 are sized and shaped to interfit and thereby form articulated paver linkages. As previously described, pushing and pulling forces are transmitted along these articulated paver linkages to expand, compress and undulate the articulated paver linkages according to the needs of the specified area. Tolerances, for instance, tolerances 294 (FIG. 28) allow movement between the paver piece 282*a, b, c* and grid substrates 284*a, b, c, d*. In a similar manner, at least the paver pieces 3504*a, b* and grid substrates 3502*a, b, c* have tolerances allowing movement of the grid substrates and paver pieces relative to each other.

The paver pieces 3504*a, b* and grid substrates 3502*a, b, c* form an articulated paver linkage 3506. As shown in FIG. 35, the articulated paver linkage 3506 includes a first linkage portion 3508*a* and a second linkage portion 3508*b*. The first linkage portion 3508*a* includes at least the grid substrates 3502*a, b* and the paver piece 3504*a*. The first linkage portion 3508*a* is thereby able to expand or contract in a first orientation (e.g., extending left to right across the page). The second linkage portion 3508*b* includes at least the grid substrates 3502*a, c* and the paver piece 3504*b*. The second linkage portion 3508*b* extends in a second orientation relative to the first orientation of the first linkage portion 3508*a*. The second linkage portion allows movement of the articulated paver linkage 3506 in compression and expansion (e.g., expansion or compression up or down relative to the page). In one example the first orientation of the first linkage portion 3508*a* is at least partially transverse to the orientation of the second paver linkage 3508*b*. For instance, expansion and compression of the first paver linkage 3508*a* occurs along an axis that is not parallel with an axis corresponding with compression or expansion movements of the second paver linkage 3508*b*. As shown in FIG. 35, expansion and compression along the arrows 3510*a* of the first linkage portion 3508*a* is substantially transverse to expansion and compression along the arrows 3510*b* of the second linkage portion 3508*b*. Optionally the bridge substrate 3502*a, b, c* and paver pieces 3510*a, b, c* are constructed with non-square orientations (e.g., diamond orientations, circular orientations, ovular orientations, triangular orientations and the like) that facilitate expansion and compression of the first and second linkage portions 3508*a, b* along transverse non-orthogonal orientations.

As previously described, the tolerances between the paver pieces and the grid substrates determine the amount of movement available between the paver pieces and the grid substrates and accordingly determine the amount of expansion and compression available to the articulated paver linkage 3506 including the first and second linkage portions 3508*a, b*. Optionally, the tolerances between the paver pieces forming the first linkage 3508*a*, such as the paver piece 3504*a* and the grid substrates 3502*a, b*, are adjusted to achieve a desired amount of expansion or compression. In a similar manner, the tolerances of at least the paver piece 3504*b* and grid substrate 3502*a, c* separately determine the amount of expansion and compression available to the second linkage portion 3508*b*. Tolerances between the paver pieces 3504*a, b* and the grid substrates 3502*a, b* and 3502*a, c* are thereby individually adjustable to achieve varied expansion and compression ranges in the first paver linkage 3508*a* relative to the second paver linkage 3508*b*. For example, where it's desirable for the first paver linkage 3508*a* to have greater expansion and compression than the second linkage portion 3508*b* the tolerances between the paver piece 3504*a* and grid substrates 3502*a, b* are made greater than the tolerances between the grid substrates 3502*a, c* and paver piece 3504*b*. Variability of the tolerances allows tuning of expansion and compression in the various orientations of the linkage portions 3508*a, b*.

Figure 36:
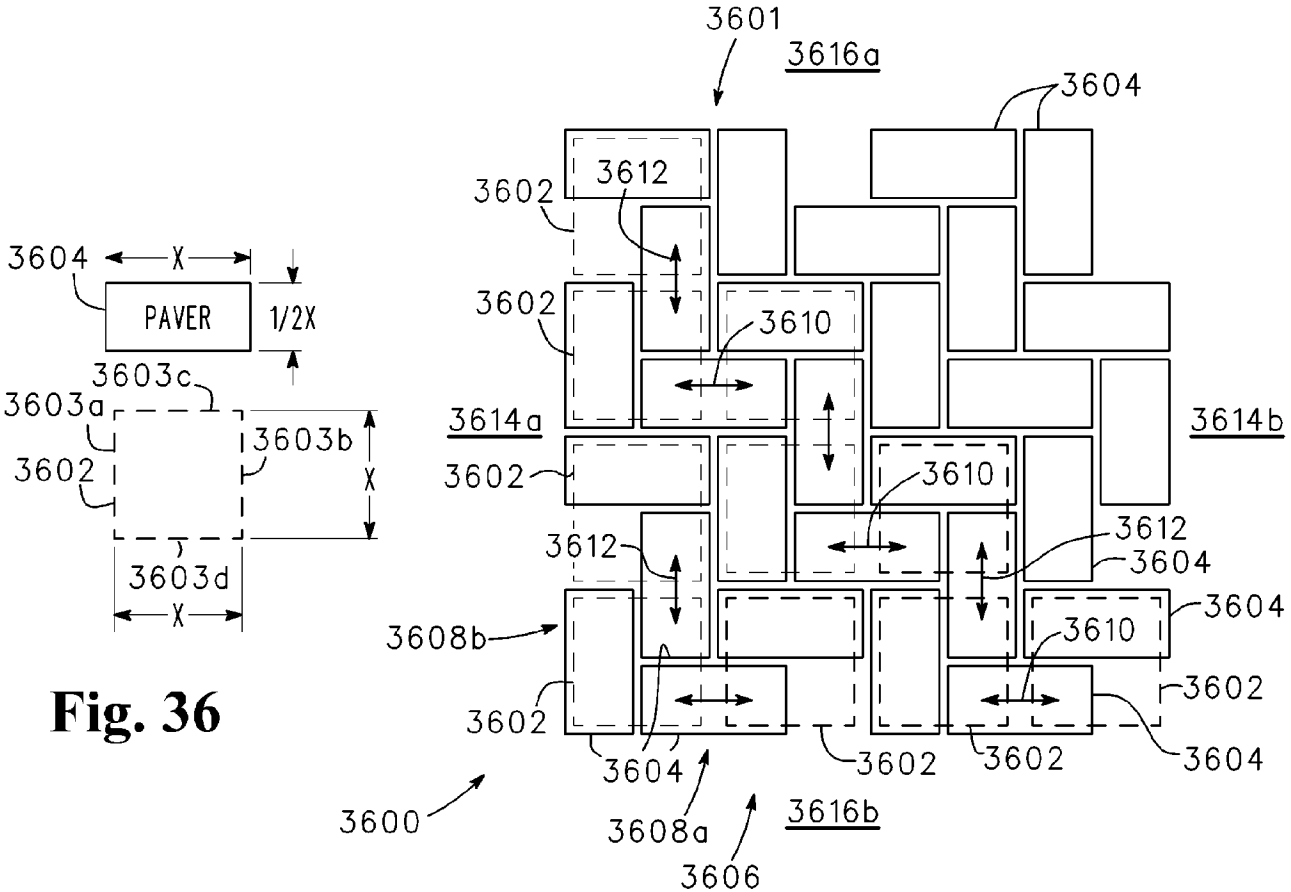
FIG. 36 is a top view of one example of a paver system including multiple grid substrates and paver pieces in a herringbone pattern.

Another example of a paver system 3600 is shown in FIG. 36. As shown the paver system 3600 includes multiple grid substrates 3602 arranged, for example, in a square pattern over a specified area 3601. A plurality of paver pieces 3604 are arranged over top of the grid substrates 3602. As previously described, the paver pieces 3604 interlock with the grid substrates 3602. For instance, projections extending from the paver pieces 3604 and grid substrates 3602 engage with recesses on the paver pieces 3604 and grid substrates 3602. Tolerances between these projections and recesses allow movement of the paver pieces 3604 and grid substrates 3602 relative to each other. In one example, the paver pieces 3604 are arranged in a decorative pattern over the grid substrates 3602. As shown in FIG. 36 for example, the paver pieces 3604 are arranged in a herringbone pattern on the grid substrates

3602. A variety of decorative patterns of the paver pieces 3604 are available including, but not limited to, linear patterns of the paver pieces, concentric rings of paver pieces, random orientations of the paver pieces, combinations of patterns and alike.

At least some of the paver pieces 3604 arranged on the grid substrates 3602 to form an articulated paver linkage 3606. As shown, the articulated paver linkage 3606 extends across the assembled paver pieces 3604 and grid substrates 3602. In the example shown in FIG. 36, the articulated paver linkage 3606 includes a first linkage portion 3608*a* and a second linkage portion 3608*b*. As previously described in FIG. 35, the first linkage portion 3608*a* has a first orientation relative to the second linkage portion 3608*b* (for instance at least a partially transverse orientation relative to the second linkage portion 3608*b*). Referring again to FIG. 36 the first linkage portion 3608*a* is expandable and compressible in at least an orientation corresponding to the arrows 3610. The second linkage portion 3608*b* is expandable and compressible in at least an orientation corresponding to the arrows 3612. In the example shown in FIG. 36, the first linkage portion 3608*a* of the paver system 3600 is thereby expandable and compressible in an orthogonal orientation relative to expansion and compression of the second linkage portion 3608*b*.

The articulated paver linkage 3606 shown in FIG. 36 extends throughout the paver system 3600. For instance, as shown in FIG. 36, the paver pieces 3604 are coupled across multiple grid substrates 3602. With the herringbone configuration shown paver pieces 3604 alternately couple grid substrates 3602 adjacent to a single grid substrate on the left and right side facing 3603*a, b* and top and bottom facing 3603*c, d*. Intermingling of the paver pieces 3604 in a variety of orientations to bridge the grid substrates 3602 correspondingly extends the first linkage portion 3608*a* and second linkage portion 3608 *b* of the articulated paver linkage 3606 across the paver system 3600 and thereby extends the articulated paver linkage 3606 across the specified area 3601. Expansion and compression of the articulated paver linkage 3606 is thereby similarly distributed across the entire paver system 3600. The articulated paver linkage 3606 is thereby expanded or compressed as needed to fit within the specified area 3601. The articulated paver linkage 3606 including the first linkage portion 3608*a* and second linkage portion 3608*b* facilitates two dimensional movement of the paver system 3600. For example, the paver system 3600 is expandable or compressible along an X-axis corresponding, for instance, with the arrows 3610 shown in FIG. 36. In another example the second paver linkage 3608*b* of the articulated paver linkage 3606 is moveable along a Y-axis, for instance, shown by the arrows 3612 in FIG. 36.

In one example, paver piece 3602 near a side 3614*b* of the paver system 3600 is pushed or pulled in alignment with the arrow 3610. Movement is translated to the remainder of the paver system 3600 through the articulated paver linkage 3606 (e.g. through the first linkage portion 3608*a*). Movement of at least a portion of the paver system 3600 transmitted through the paver system in one example allows the paver system to easily fill a gap or gaps at sides 3614*a, b* by expansion. In another example, because moment of a paver piece 3604 or paver pieces 3604 is transmitted throughout the paver linkage 3606 the entire paver system 3600 may be moved to the left or the right to fit within a smaller specified area 3601 by compression. In yet another example, and in a similar manner to movement of a paver piece at side 3614*a, b* movement of the paver system 3600 at side 3616*a* and 3616*b* transmits movement through the articulated paver linkage 3606, for instance, through the distributed second paver linkage 3608*b*. As previously described, this allows expansion and compression of the paver system 3600 along the second linkage portion 3608*b* to fill gaps or fit the paver system 3600 within a smaller specified area 3601. The articulated paver linkage 3606 thereby provides a distributed network including at least the first linkage portion 360*a* and second linkage portion 3608*b*. This network of linkage portions allows transmission of expansion and compression throughout the paver system 3600 and thereby easily allows fitting of the paver system 3600 within a specified area 3601. In still another example, the paver system 3600 including the articulated paver linkage 3606 is capable of rotational movement as previously described and shown in FIGS. 27*c* and 30 in combination with expansion and compression.

Figure 37:
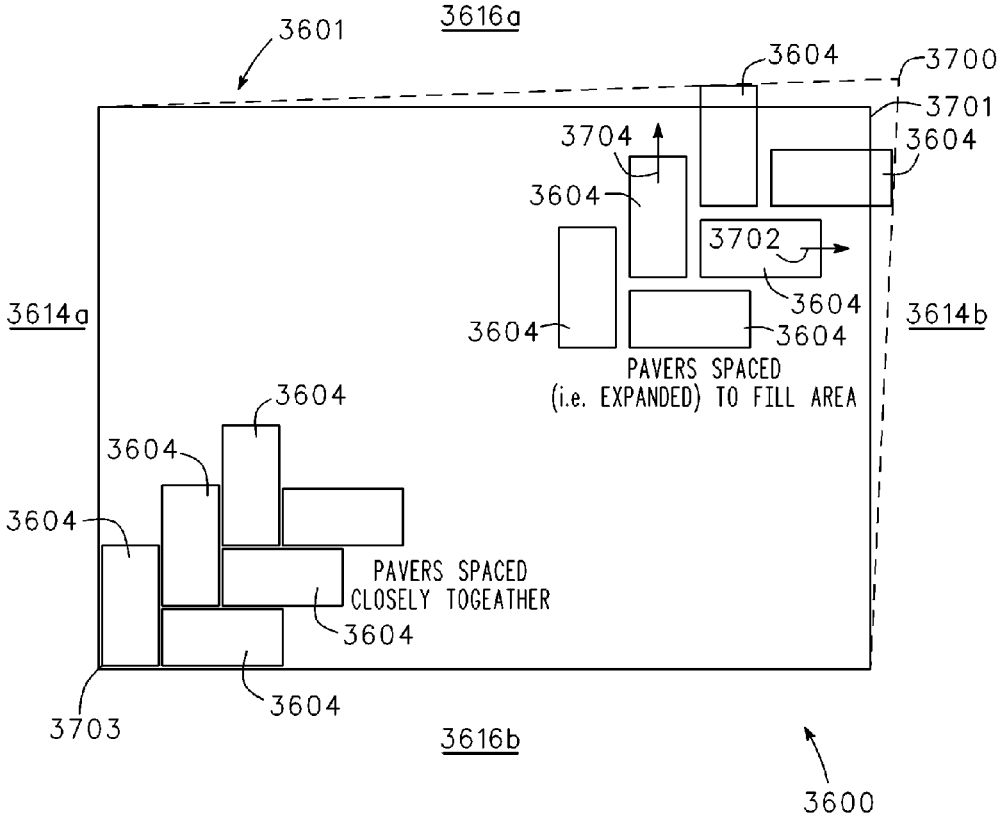
FIG. 37 is a top view of the paver system shown in FIG. 36 with the articulated paver linkage fit within a specified area having non-parallel borders.

Paver system 3600 is shown in FIG. 37 within the specified area 3601. As shown in FIG. 37, the specified area 3601 has non-parallel borders 3614*a, b* and 3616*a, b*. The specified area 3601 includes borders 3616*a* and 3614*b* meeting at a juncture 3700. Juncture 3700 is shown in FIG. 37 as the sides 3616*a* and 3614*b* coming to an intersection that does not include right angles (e.g., the specified area 3601 is thereby not a square area). As previously described, the articulated paver linkage 3606 of the paver system 3600 allows expansion and compression of the paver system 3600 horizontally for instance along the arrow 3702 and vertically along the arrow 3704. The two dimensional articulation of the paver linkage 3606 allows movement of portions of the paver system 3600 to be transmitted throughout the paver system thereby quickly and easily positioning the paver system within the specified area 3601 including positioning of the paver system at the juncture 3700.

In one example, the paver system 3600 is assembled in a substantially extensive grid pattern including intermingled paver pieces 3604 having at least one of a herringbone configuration, an alternating horizontal and vertical configuration, a concentric configuration, a horizontal configuration, a vertical configuration, a combination of horizontal paver pieces and vertical paver pieces and a like. As previously described, the paver pieces 3604 bridge the grid substrates 3602 (see FIG. 36). Bridging of the grid substrates 3602, for instance along arrows 3702 and 3704, allows transmission of movement of the paver pieces 3604 and grid substrates 3602 on those orientations 3702, 3704. As shown in FIG. 36, the paver pieces 3604 extend across grid substrates 3602 thereby forming first and second linkage portions 3608*a, b*. When the paver system 3600 is initially assembled in the area 3601 (FIG. 37), for instance with the paver system fit within the juncture 3701, at least one of the paver pieces 3604 or grid substrates 3602 (see FIG. 36) is moved toward the juncture 3700. Movement of at least one of the paver pieces 3604 and grid substrates 3602 toward the juncture 3700 transmits pulling forces throughout the paver linkage 3606. Because the paver pieces 3604 are interlocked with the grid substrate 3602 in a two dimensional fashion as previously described, movement of the grid substrates 3602 and paver pieces 3604 near the juncture 3701 towards the juncture 3700 is correspondingly transmitted throughout the paver system 3600. The paver system 3600 is thereby stretched across the area 3601 and easily positioned at the juncture 3700. The two dimensional articulation of the paver system 3600 through the first and second linkage portions 3608*a, b* fits the paver system 3600 within the specified area 3601 in a single step, for instance by pulling the paver system 3600 toward the juncture 3700. The paver system 3600 is thereby fit within a specified area 3601 having nonparallel borders including, for instance, sides 3616*a* and 3614*b*.

In yet another example where the paver system 3600 is assembled in an area having non parallel borders with a juncture inside the juncture 3701. The articulated paver linkage 3606 is compressed (e.g., pushed) toward a juncture, such as juncture 3703, to fit the paver system 3600 within the specified area. Optionally, where the paver system 3600 includes paver pieces 3604 extending in a single orientation, for instance along arrow 3702, 3704 individual articulated paver linkage 3606 are moved to fit the paver system 3600 within the specified area 3601. For instance the paver linkages 3606 are individually pulled and pushed to fit the paver linkages 3606 within a specified area.

As previously described the articulated paver linkage 3606 allows easy positioning of the paver system 3600 across a specified area. For instance, across a specified area 3601 having non parallel borders 3616*a*, 3614*b*. The articulated paver linkage 3606 in one example transmits movement along arrows 3702 and 3704 in a single step allowing easy positioning of the paver system 3600 to fill the specified area 3601 according to the needs of the user. Costly labor such as cutting individual paver pieces to fit within a specified area is avoided. Additionally equipment including saws, scoring tools, and the like are not needed to assemble the paver system 3600 to fit within the specified area 3601. Further, tedious and time consuming labor such as tapping the paver pieces 3604 to fit within the specified area 3601 is similarly avoided.

Referring now to FIG. 38*a*, another example of a paver system 3800 is shown. Paver system 3800 includes paver pieces 3802*a, b* coupled with the grid substrate 3804*a*. In the example shown in FIG. 38*a*, paver pieces 3802*a, b* are coupled with the grid substrate 3804*a* with protrusions 3806, 3808 positioned within recesses 3810, 3812. Moveable coupling between the paver pieces 3802*a, b* and the grid substrate 3804*a* forms an articulated paver linkage 3816 in a similar manner to the previously discussed articulated paver linkages.

As previously discussed, the tolerances between the engagement of the paver pieces 3802*a, b* with the grid substrate 3804*a* allows movement of the paver pieces 3802*a, b* relative to the grid substrate 3804*a*. The tolerances between the paver pieces and grid substrate allow the articulated paver linkage 3816 to have the compressible and expandable characteristics previously described. In another example, the tolerances between the paver pieces 3802*a, b* and the grid substrate 3804*a* allow rotation of at least one of the paver pieces 3802*a, b* and the grid substrate 3804*a* around an axis 3801 (the axis 3801 extends into and out of the page). The articulated paver linkage 3816 is thereby able to undulate vertically relative to the axis 3801 including, but not limited to, deflecting the articulated paver linkage 3816 upwardly and downwardly. As shown in FIG. 38*a*, the paver pieces 3802*a, b* are able to move with a radial tolerance 3818 shown with the character 0. The radial tolerance 0 is proportional to the tolerance allowing movement of the articulated paver linkages previously described including, but not limited to, tolerances 284*a, b, c* shown in FIGS. 27*a, b, c* and tolerances 294 shown in FIGS. 28 and 29. These previously described tolerances allow lateral movement such as rotation of the paver pieces and grid substrates as shown in FIG. 30 and translation of the paver pieces shown in FIGS. 28 and 29. Where these tolerances are increased the radial tolerance 3818 correspondingly increases.

Referring now to FIG. 38*b*, the paver system 3800 is shown with additional paver pieces 3802*c, d* and additional bridge substrates 3804*b, c, d, e*. Paver System 3800 is overlaid across a surface 3814 (e.g. soil, concrete, gravel, rocks and the like). Surface 3814 is shown with a convex geometry and the articulated paver linkage 3816 correspondingly has upper paver surface 3822 having a similar convex appearance. The radial tolerances 3818 between the paver pieces 3802*a, b, c, d* allow for undulation of the articulated paver linkage 3816 relative to the surface 3814. As shown in FIG. 38*b*, for example, the paver system 3800 is able to follow the geometry of the surface 3814 by assuming a complimentary geometry to that surface. The vertical undulation of the articulated paver linkage 3816, in another example, is performed in conjunction with translating the articulated paver linkage 3816 such as with expansion and compression shown in a single dimension in FIGS. 28 and 29, in two dimensions in FIGS. 35, 36 and 37 as well as rotational translation shown in FIG. 30. The paver system 3800 is thereby easily positionable within a specified area, including a specified area having a non planar or broken surface, such as the surface 3814.

Figure 38C:
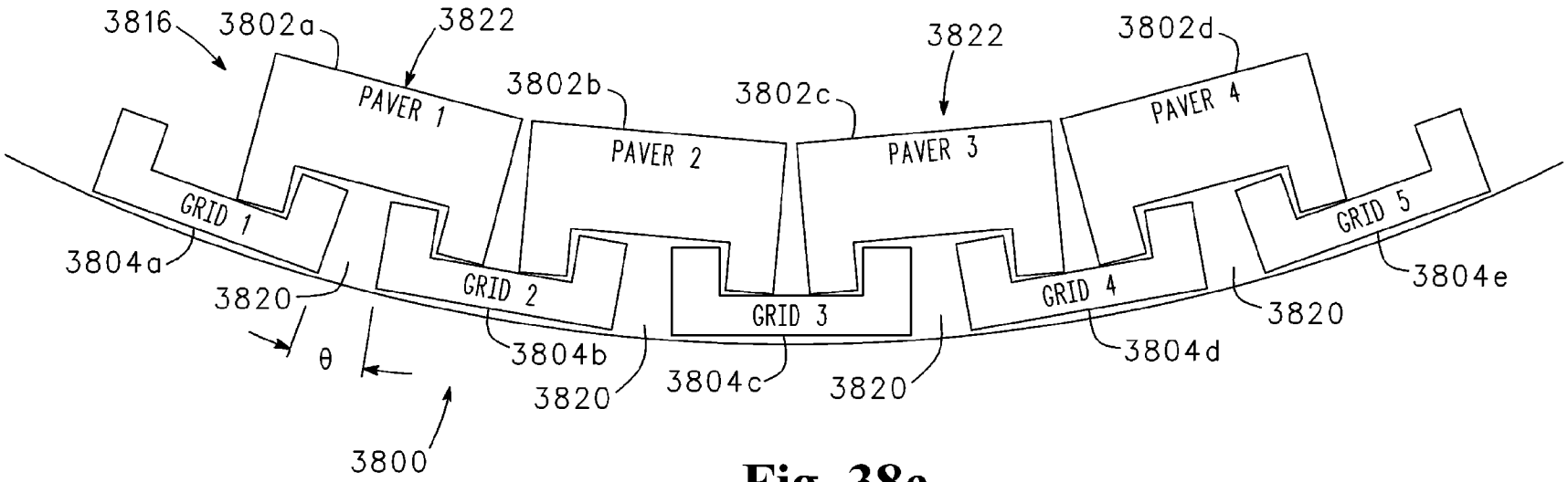
FIG. 38*c* is a side view of another example of a paver system including multiple grid substrates and paver pieces aligned with a concave vertically non-linear specified area.

Paver system 3800 is shown positioned along another surface 3815 having a concave vertically non linear specified area. The paver system 3800 shown in FIG. 38*c* is able to undulate in a vertical manner relative to the surface 3815, the upper paver surface 3822 thereby assuming a geometry complimentary to that of the surface 3815. Paver system 3800 including the articulated paver linkage 3816 is thereby able to easily traverse non-planar or broken ground. Inconsistencies in the underlying surfaces 3814, 3815 are thereby easily masked by undulating paver system 3800 to present a consistent and relatively smooth upper paving surface 3822.

In both examples shown in FIGS. 38*b, c* the articulated paver linkage 3816 includes radial tolerances 3818, 3820 that are consistent across at least a portion of the articulated paver linkage 3816. These consistent tolerances 3818, 3820 allow the paver system upper surface 3822 to have a substantially uniform and consistent spacing of gaps between the paver pieces 3802*a, b, c, d,* thereby presenting a consistent and aesthetically appealing appearance. In another example, where a plurality of paver pieces are positionable on a single grid substrate, such as substrate 3602 shown in FIG. 36, sufficient lateral tolerance is included between the grid substrates and the paver pieces to allow movement of paver pieces that do not otherwise bridge grid substrates 3602. This positional tolerance on the grid substrates allows movement of non-bridging paver pieces into positions that are equidistantly spaced from other paver pieces thereby maintaining a consistent and aesthetically appealing appearance to the paver system 3800 with lateral translation including rotation, vertical undulation and the like.

CONCLUSION

A paver system and method of installing a paver system are provided that quickly and easily provides a fitted paving surface over a specified area. Because the paver system is assembled as an articulated paver linkage the paver pieces and substrates are positioned and aligned relative to each other through the transmission of pushing and pulling forces through the linkage. Where the paver system as assembled does not fully extend across a specified area, the linkage is expanded by pulling on at least one of the paver pieces and substrates to transmit the pulling forces along the linkage and thereby expand the system to cover the area. Where the paver system as assembled extends beyond the specified area, the linkage is compressed by pushing at least one of the paver pieces and substrates to transmit pushing forces along the linkage and thereby compress the system to fit within the area. Similarly, the tolerances between the paver pieces and the substrates allow undulation of the paver system, so that deflection of the articulated paver linkage results in rotation of the paver pieces and substrates relative to each other to achieve a curved orientation (e.g., laterally and vertically).

Intensive labor, such as cutting and refitting of paver bricks on a per unit basis is substantially avoided because the paver system is adjusted to fit within areas as a linkage. Additionally, paving surfaces having decorative curved surfaces are much easier to assemble and position as the paving system is assembled in a linear manner and subsequently deflected into the curved orientation. Further still, underlying surfaces that are non-planar or broken are concealed by the paving system with vertical undulation to form a consistent and aesthetically pleasing paver surface.

Although the present invention has been described in reference to preferred embodiments, persons skilled in the art will recognize that changes may be made in form and detail without departing from the spirit and scope of the invention. For example, in alternative embodiments, the polymeric paver pieces may be used for retaining wall blocks, foundation blocks, flat roof coverings, decks and the like.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the invention should, therefore, be determined with reference to the appended claims, along with the full scope of equivalents to which such claims are entitled.

What is claimed is:

1. A method for installing a paver system within a specified area comprising:

positioning a first grid substrate adjacent to a second grid substrate, the first and second grid substrates extending partially across the specified area;

interlocking the first grid substrate with the second grid substrate with a first paver piece bridging the first and second grid substrates and positioned relatively above the first and second grid substrates, a first paver portion of the first paver piece received by the first grid substrate, the first paver portion extending toward the first grid substrate along a first longitudinal axis, and a first lateral moving tolerance is provided between the first paver portion and the first grid substrate on either side of the of the first longitudinal axis, and a second paver portion of the first paver piece received by the second grid substrate, the second paver portion extending toward the first grid substrate along a second longitudinal axis, and a second lateral moving tolerance is provided between the second paver portion and the second grid substrate on either side of the second longitudinal axis, the first and second grid substrates and the first paver piece forming an articulated paver linkage;

coupling a second paver piece with the second grid substrate, the second paver piece positioned relatively above the second grid substrate;

coupling a third paver piece with the first grid substrate, the third paver piece positioned relatively above the first grid substrate; and fitting the articulated linkage within the specified area, fitting including laterally expanding the articulated paver linkage across the specified area according to the first and second lateral moving tolerances provided on either side of the first and second longitudinal axes, respecitively, the second paver piece adjacent one side of the specified area, the third paver piece adjacent another side of the specified area.

2. The method for installing the paver system of claim 1, wherein coupling the second paver piece and coupling the third paver piece further comprises coupling at least a fourth paver piece with the second grid substrate and coupling a fifth paver piece with the first grid substrate, at least some of the first through fifth paver pieces arranged on the first and second grid substrates in a decorative pattern.

3. The method for installing the paver system of claim 1, wherein interlocking the first grid substrate with the second grid substrate includes inserting a first protrusion of the first paver piece within a first recess of the first grid substrate and inserting a second protrusion of the first paver piece within a second recess of the second grid substrate.

4. The method for installing the paver system of claim 3, wherein inserting the first protrusion of the first paver piece within the first recess of the first grid substrate includes inserting the first protrusion within the first recess, the first recess larger than the first protrusion by the first moving tolerance, the first protrusion slidable within the first recess.

5. The method for installing the paver system of claim 1, wherein expanding the articulated paver linkage includes:

pulling on the second paver piece, transmitting pulling forces from the second paver piece to the second grid substrate, transmitting pulling forces from the second grid substrate to the first paver piece, and transmitting pulling forces from the first paver piece to the first grid substrate.

6. The method for installing the paver system of claim 1, wherein expanding the articulated paver linkage includes expanding the articulated paver linkage to at least one of an expanded length and expanded width corresponding to at least one of a specified area length and specified area width, the articulated paver linkage having at least one of an unexpanded length and unexpanded width less than at least one of the specified area length and specified area width, respectively.

7. The method for installing the paver system of claim 1, wherein expanding the articulated paver linkage across the specified area includes forming gaps between the first and second paver pieces and the first and third paver pieces, and the gaps have substantially similar sizes where the first moving tolerance is identical to the second moving tolerance.

8. The method for installing the paver system of claim 7 further comprising filling the gaps and locking the first, second and third paver pieces relative to each other and the first and second grid substrates.

9. The method for installing the paver system of claim 1, wherein expanding the articulated paver linkage across the specified area includes the articulated paver linkage equidistantly positioning the second and third paver pieces relative to the first paver piece during expanding where the first moving tolerance is substantially identical to the second moving tolerance.

10. The method for installing the paver system of claim 1 further comprising:

positioning a third grid substrate adjacent the first grid substrate, the first and third grid substrates extending partially across a specified width of the specified area;

interlocking the first grid substrate with the third grid substrate with a fourth paver piece bridging the first and third grid substrates, the first and third grid substrates and the fourth paver piece forming an articulated paver linkage second portion, the first and second grid substrates and the first paver piece forming an articulated paver linkage first portion;

expanding the articulated paver linkage second portion across the specified width.

11. The method for installing the paver system of claim 1 further comprising:

positioning a third grid substrate adjacent the first grid substrate, the first and third grid substrates extending at least partially across a specified width of the specified area;

interlocking the first grid substrate with the third grid substrate with a fourth paver piece bridging the first and third grid substrates, the first and third grid substrates and the fourth paver piece forming an articulated paver linkage second portion;

selectively compressing or expanding the articulated paver linkage second portion to fit within the specified width.

12. The method of claim 1, wherein laterally expanding the articulated paver linkage includes laterally expanding the articulated paver linkage according to a total lateral moving tolerance between the first and second grid substrates equal to the first lateral moving tolerance of the first paver portion of the first paver piece and the first grid substrate combined with the second lateral moving tolerance of the second paver portion of the first paver piece and the second grid substrate.

13. A method for installing a paver system within a specified area comprising:

positioning a first grid substrate adjacent to a second grid substrate, at least one of the first and second grid substrates extending outside the specified area;

interlocking the first grid substrate with the second grid substrate with a first paver piece bridging the first and second grid substrates and positioned relatively above the first and second grid substrates, a first paver portion of the first paver piece received by the first grid substrate, the first paver portion extending toward the first grid substrate along a first longitudinal axis, and a first lateral moving tolerance is provided between the first paver portion and the first grid substrate on either side of the first longitudinal axis, and a second paver portion of the first paver piece received by the second grid substrate, the second paver portion extending toward the first grid substrate along a second longitudinal axis, and a second lateral moving tolerance is provided between the second paver portion and the second grid substrate on either side of the second longitudinal axis, the first and second grid substrates and the first paver piece forming an articulated paver linkage;

coupling a second paver piece with the second grid substrate, the second paver piece positioned relatively above the second grid substrate;

coupling a third paver piece with the first grid substrate, the third paver piece positioned relatively above the first grid substrate; and fitting the articulated linkage within the specified area, fitting including laterally compressing the articulated paver linkage to fit within the specified area according to the first and second lateral moving tolerances provided on either side of the first and second longitudinal axes, respectively, the second paver piece adjacent one side of the specified area, the third paver piece adjacent another side of the specified area.

14. The method for installing the paver system of claim 13, wherein coupling the second paver piece and coupling the third paver piece further comprises coupling at least a fourth paver piece with the second grid substrate and coupling a fifth paver piece with the first grid substrate, at least some of the first through fifth paver pieces arranged on the first and second grid substrates in a decorative pattern.

15. The method for installing the paver system of claim 13, wherein interlocking the first grid substrate with the second grid substrate includes inserting a first protrusion of at least one of the first paver piece and the first grid substrate within a first recess of the other of at least one of the first grid substrate and the first paver piece and inserting a second protrusion of at least one of the first paver piece and the second grid substrate within a second recess of the other of the at least one of the first paver piece and the second grid substrate.

16. The method for installing the paver system of claim 15, wherein inserting the first protrusion within the first recess includes inserting the first protrusion within the first recess, the first recess larger than the first protrusion by the first moving tolerance, the first protrusion slidable within the first recess.

17. The method for installing the paver system of claim 13, wherein compressing the articulated paver linkage includes:

pushing on the second paver piece, and at least one of the following:

transmitting pushing forces from the second paver piece to the second grid substrate, transmitting pushing forces from the second paver piece to the first paver piece, and at least one of the following transmitting pushing forces from the second grid substrate to the first grid substrate, transmitting pushing forces from the first paver piece to the first grid substrate.

18. The method for installing the paver system of claim 13, wherein compressing the articulated paver linkage includes compressing the articulated paver linkage to a compressed length corresponding to a specified area length, the articulated paver linkage having an expanded length greater than the specified area length.

19. The method for installing the paver system of claim 13, wherein compressing the articulated paver linkage includes compressing the articulated paver linkage to a compressed width corresponding to a specified area width, the articulated paver linkage having an expanded width greater than the specified area width.

20. The method for installing the paver system of claim 13, wherein compressing the articulated paver linkage to fit within the specified area includes minimizing gaps between the first and second paver pieces and the first and third paver pieces, and the gaps have substantially similar sizes where the first moving tolerance is identical to the second moving tolerance.

21. The method for installing the paver system of claim 20 further comprising filling the gaps and locking the first, second and third paver pieces relative to each other and the first and second grid substrates.

22. The method for installing the paver system of claim 13 wherein compressing the articulated paver linkage to fit within the specified area includes the articulated paver linkage equidistantly positioning the second and third paver pieces relative to the first paver piece during compressing where the first moving tolerance is substantially identical to the second moving tolerance.

23. The method for installing the paver system of claim 13 further comprising aligning the articulated paver linkage with a vertical non-linear portion of the specified area, the articulated paver linkage assuming a substantially identical vertical geometry to the vertical non-linear portion with the first, second and third paver pieces aligned along the non-linear portion.

24. The method for installing the paver system of claim 23, wherein aligning the articulated paver linkage with the vertical non-linear portion of the specified area includes vertically undulating the articulated paver linkage along the vertical non-linear portion, the articulated paver linkage vertically undulated into substantial alignment with the non-linear portion.

25. The method of claim 13, wherein laterally compressing the articulated paver linkage includes laterally compressing the articulated paver linkage according to a total lateral moving tolerance between the first and second grid substrates equal to the first lateral moving tolerance of the first paver portion of the first paver piece and the first grid substrate combined with the second lateral moving tolerance of the second paver portion of the first paver piece and the second grid substrate.

26. A method for installing a paver system within a specified area comprising:

positioning a first grid substrate adjacent to a second grid substrate;

flexibly bridging the first grid substrate and the second grid substrate with a first paver piece positioned relatively above the first and second grid substrates, a first paver portion of the first paver piece movably coupled with the first grid substrate at a first paver joint with a first lateral moving tolerance, and a second paver portion of the first paver piece movably coupled with the second grid substrate at a second paver joint with a second lateral moving tolerance, the first and second grid substrates and the first paver piece forming an articulated paver linkage configured for at least lateral articulation according to the first and second lateral moving tolerances between the first paver pieces and the first and second grid substrates;

laterally locking the first paver portion with the first grid substrate at the first paver joint;

laterally locking the second paver portion with the first grid substrate at the second paver joint;

coupling a second paver piece with the second grid substrate, the second paver piece positioned relatively above the second grid substrate;

coupling a third paver piece with the first grid substrate, the third paver piece positioned relatively above the first grid substrate;

laterally fitting the articulated paver linkage within the specified area by movement of at least one of the first, second and third paver pieces and the first and second grid substrates, the movement transmitted along the articulated paver linkage to maintain a specified alignment and spacing of the first, second and third paver pieces according to at least the first and second lateral moving tolerances, and securing the articulated linkage together during lateral fitting according to the lateral locking at the first and second paver joints.

27. The method for installing the paver system within a specified area of claim 26 further comprising:

positioning a third grid substrate adjacent the first grid substrate, the first and third grid substrates extending partially across a specified width of the specified area, a first and third grid orientation at least partially transverse to a first and second grid orientation;

interlocking the first grid substrate with the third grid substrate with a fourth paver piece bridging the first and third grid substrates, the first and third grid substrates and the fourth paver piece forming an articulated paver linkage second portion, the first and second grid substrates and the first paver piece forming an articulated paver linkage first portion;

selectively fitting the articulated paver linkage first portion and the articulated paver linkage second portion across the specified area and the specified width.

28. The method for installing the paver system within a specified area of claim 27, wherein selectively fitting the articulated paver linkage first portion and the articulated paver linkage second portion across the specified area and the specified width includes:

at least one of selectively expanding or compressing the articulated paver linkage first portion to fit within the specified area, and at least one of selectively expanding or compressing the articulated paver linkage second portion to fit within the specified width, wherein selectively expanding or compressing the articulated paver linkage second portion is in a second dimension at least partially transverse to expansion or compression of the articulated paver linkage first portion.

29. The method for installing the paver system within a specified area of claim 28, wherein selectively fitting the articulated paver linkage first portion and the articulated paver linkage second portion across the specified area and the specified width includes selectively fitting the articulated paver linkage first portion and the articulated paver linkage second portion across a specified area with non-parallel opposed borders.

30. The method for installing the paver system of claim 26, wherein coupling the second paver piece and coupling the third paver piece further comprises coupling at least a fourth paver piece with the second grid substrate and coupling a fifth paver piece with the first grid substrate, at least some of the first through fifth paver pieces arranged on the first and second grid substrates in a decorative pattern.

31. The method for installing the paver system of claim 26, wherein fitting the articulated paver linkage within the specified area includes positioning the second paver piece adjacent one side of the specified area, and positioning the third paver piece adjacent another side of the specified area, and positioning of the second and third paver pieces transmits movement along the articulated paver linkage and spaces the first paver piece equidistantly from the second and third paver pieces.

32. The method for installing the paver system of claim 26, wherein flexibly bridging the first grid substrate and the second grid substrate includes rotatably and slidably coupling the first and second grid substrates and the first paver piece at the first and second paver joints.

33. The method for installing the paver system of claim 32, wherein fitting the articulated paver linkage within the specified area includes at least one of rotating and sliding the first paver portion and the second paver portion at the first paver joint and the second paver joint relative to the first and second grid substrates.

34. The method for installing the paver system of claim 32, wherein fitting the articulated paver linkage within the specified area includes aligning the articulated paver linkage along a non-linear specified area by rotation of at least one of the first and second grid substrates relative to the first paver piece at the first and second paver joints.

35. The method for installing the paver system of claim 26, wherein fitting the articulated paver linkage within the specified area includes expanding the articulated paver linkage at the first and second paver joints with sliding movement between the first paver piece and the first and second grid substrates.

36. The method for installing the paver system of claim 26, wherein fitting the articulated paver linkage within the specified area includes compressing the articulated paver linkage at the first and second paver joints with sliding movement between the first paver piece and the first and second grid substrates.

37. The method of claim 26, wherein laterally fitting the articulated paver linkage includes laterally fitting the articulated paver linkage according to a total lateral moving tolerance between the first and second grid substrates equal to the first lateral moving tolerance of the first paver portion of the first paver piece and the first grid substrate combined with the second lateral moving tolerance of the second paver portion of the first paver piece and the second grid substrate.

* * * * *

UNITED STATES PATENT AND TRADEMARK OFFICE

CERTIFICATE OF CORRECTION

PATENT NO. : 8,747,018 B2
APPLICATION NO. : 12/990419
DATED : June 10, 2014
INVENTOR(S) : Smith et al.

It is certified that error appears in the above-identified patent and that said Letters Patent is hereby corrected as shown below:

In the Claims

Column 29, line 44, Claim 1, before “of”, delete “of the”, therefor

Column 32, line 26, Claim 17, after “following”, insert --:--, therefor

Signed and Sealed this
Sixteenth Day of December, 2014

Michelle K. Lee

Michelle K. Lee
*Deputy Director of the United States Patent and Trademark Office*